US006491840B1

(12) United States Patent
Frankenbach et al.

(10) Patent No.: US 6,491,840 B1
(45) **Date of Patent: *Dec. 10, 2002**

(54) POLYMER COMPOSITIONS HAVING SPECIFIED PH FOR IMPROVED DISPENSING AND IMPROVED STABILITY OF WRINKLE REDUCING COMPOSITIONS AND METHODS OF USE

(75) Inventors: Gayle Marie Frankenbach, Cincinnati, OH (US); Toan Trinh, Maineville, OH (US); Mary Vijayarani Barnabas, West Chester, OH (US); Alessandro Corona, III, Mason, OH (US); John Henry Shaw, Jr., Cincinnati, OH (US); John William Smith, Milford, OH (US); Donald Ray Brown, Middletown, OH (US); Timothy Roy Nijakowski, Mason, OH (US); Bruno Albert Jean Hubesch, Neerijse (BE); Gabrielle Holly (Spangler) Detzel, Cincinnati, OH (US); Todd Stephen Alwart, Cincinnati, OH (US); Anne Marie Candido, Mason, OH (US); Stephan Gary Bush, Sharonville, OH (US); Dimitris Ioannis Collias, Mason, OH (US); Ellis Bailey Gregg, Cincinnati, OH (US); Earl Bray, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/634,379

(22) Filed: Aug. 9, 2000

Related U.S. Application Data

(60) Provisional application No. 60/182,381, filed on Feb. 14, 2000.

(51) Int. Cl.[7] ..... D06M 15/263

(52) U.S. Cl. ..... 252/8.91; 252/8.61; 38/144; 427/370; 427/393.2

(58) Field of Search ..... 252/8.61, 8.91; 38/144; 427/393.2, 370

(56) References Cited

U.S. PATENT DOCUMENTS

| | | | | |
|---|---|---|---|---|
| 3,674,688 | A | | 7/1972 | Schwartz et al. |
| 3,965,014 | A | | 6/1976 | Giordano et al. |
| 4,085,243 | A | | 4/1978 | Giordano et al. |
| 4,565,647 | A | | 1/1986 | Llenado |
| 4,661,268 | A | | 4/1987 | Jacobson et al. |
| 4,780,499 | A | | 10/1988 | Villarreal et al. |
| 4,806,254 | A | | 2/1989 | Church |
| 4,818,242 | A | | 4/1989 | Burmeister et al. |
| 4,851,140 | A | | 7/1989 | Nuesslein et al. |
| 4,857,212 | A | | 8/1989 | Ona et al. |
| 4,923,623 | A | | 5/1990 | Coffindaffer |
| 5,021,264 | A | | 6/1991 | Kästele et al. |
| 5,042,986 | A | | 8/1991 | Kitchens et al. |
| 5,062,971 | A | | 11/1991 | Coffindaffer et al. |
| 5,064,543 | A | | 11/1991 | Coffindaffer et al. |
| 5,100,566 | A | * | 3/1992 | Agbomeirele et al. ..... 252/8.91 |
| 5,346,725 | A | | 9/1994 | Targosz |
| 5,520,827 | A | | 5/1996 | Danner |
| 5,532,023 | A | | 7/1996 | Vogel et al. |
| 5,573,694 | A | | 11/1996 | Danner |
| 5,573,695 | A | * | 11/1996 | Targosz ..... 252/8.91 |
| 5,645,751 | A | | 7/1997 | Haley |
| 5,695,677 | A | | 12/1997 | Silvester et al. |
| 5,798,107 | A | * | 8/1998 | Vogel et al. ..... 424/400 |
| 5,824,814 | A | | 10/1998 | Cray et al. |
| 5,851,431 | A | | 12/1998 | Ishikawa et al. |
| 5,965,517 | A | | 10/1999 | Mooney |
| 5,968,404 | A | * | 10/1999 | Trinh et al. ..... 252/8.91 |
| 6,001,343 | A | | 12/1999 | Trinh et al. |
| 6,013,683 | A | | 1/2000 | Hill et al. |

FOREIGN PATENT DOCUMENTS

| | | | |
|---|---|---|---|
| EP | 0190839 | | 8/1986 |
| GB | 1312247 | | 7/1970 |
| JP | 01168967 | | 7/1989 |
| JP | 01260064 | | 10/1989 |
| JP | 01292184 | | 11/1989 |
| JP | 02112477 | | 4/1990 |
| JP | 05239774 | | 9/1993 |
| JP | 07119044 | | 5/1995 |
| JP | 08246350 | | 9/1996 |
| JP | 08246351 | | 9/1996 |
| JP | 09105077 | | 4/1997 |
| JP | 09209274 | | 8/1997 |
| JP | 09241973 | | 9/1997 |
| JP | 10046471 | | 2/1998 |
| JP | 10072778 | | 3/1998 |
| JP | 10110386 | | 4/1998 |
| WO | 96/15309 | * | 5/1996 |
| WO | WO55/55949 | | 11/1999 |
| WO | WO99/55948 | | 11/1999 |
| WO | WO99/55950 | | 11/1999 |
| WO | WO99/55951 | | 11/1999 |
| WO | WO99/55952 | | 11/1999 |
| WO | WO99/55953 | | 11/1999 |
| WO | WO00/08127 | | 2/2000 |
| WO | WO00/24853 | | 5/2000 |
| WO | WO00/24857 | | 5/2000 |
| WO | WO00/27991 | | 5/2000 |

* cited by examiner

*Primary Examiner*—Anthony J. Green
(74) *Attorney, Agent, or Firm*—Jason J. Camp; Kim William Zerby; Steve W. Miller

(57) ABSTRACT

Polymer compositions, while providing suitable wrinkle control, also tend to dispense poorly when sprayed. The present invention shows that when viscosity of polymer compositions is minimized spray dispensing improves. Several approaches to minimizing the viscosity of polymer compositions are disclosed. Methods of controlling wrinkles in fabrics comprise treating fabrics with a variety of polymer compositions following a variety of methods. Articles of manufacture comprise (1) a container or substrate, (2) a wrinkle controlling composition, and (3) a set of instructions.

54 Claims, 2 Drawing Sheets

POLYMER COMPOSITIONS HAVING SPECIFIED PH FOR IMPROVED DISPENSING AND IMPROVED STABILITY OF WRINKLE REDUCING COMPOSITIONS AND METHODS OF USE

CROSS REFERENCE TO RELATED APPLICATION

This application claims the benefit of U.S. Provisional Application No. 60/182,381, filed Feb. 14, 2000.

TECHNICAL FIELD

The present invention relates to polymer compositions having a specified pH to provide improved dispensing for wrinkle removal and/or reduction. The specified pH prevents staining of treated fabrics and methods for treating fabrics are provided in order to improve various properties of fabrics, in particular, reduction, removal, or prevention of unwanted wrinkles.

For preferred polymer compositions containing additional components it is particularly important to maintain the specified pH of the polymer compositions to maintain acceptable dispensing while also preventing precipitate formation during processing.

BACKGROUND OF THE INVENTION

Wrinkles in textile fabrics are caused by the bending and creasing of the textile material which places an external portion of a filament in a yarn under tension while the internal portion of that filament in the yarn is placed under compression. Particularly with cotton fabrics, the hydrogen bonding that occurs between the cellulose molecules contributes to keeping wrinkles in place. The wrinkling of fabric, in particular clothing and certain household fabrics, is therefore subject to the inherent tensional elastic deformation and recovery properties of the fibers which constitute the yarn and fabrics.

In the modern world, with the increase of hustle and bustle and travel, there is a demand for a quick fix which will help to diminish the labor involved in home laundering and/or the cost and time involved in dry cleaning or commercial laundering. This has brought additional pressure to bear on textile technologists to produce a product that will sufficiently reduce wrinkles in fabrics, especially clothing and household fabrics, and to produce a good appearance through a simple, convenient application of a product.

U.S. Pat. No. 5,573,695, issued Nov. 12, 1996 to E. F. Targosz discloses an aqueous wrinkle removal composition containing a vegetable oil based cationic quaternary ammonium surfactant, and an anionic fluorosurfactant. Similarly, U.S. Pat. No. 4,661,268, issued Apr. 28, 1987 to Jacobson et al. discloses a wrinkle removal spray comprising an aqueous alcoholic composition containing a dialkyl quaternary ammonium salt and a silicone surfactant and/or a fluoro surfactant. U.S. Pat. No. 5,100,566, issued Mar. 31, 1992 to Agbomeirele et al., discloses a method of reducing wrinkles in fabric by spraying the fabric with an aqueous alcoholic solution of an anionic siliconate alkali metal salt. U.S. Pat. No. 4,806,254, issued Feb. 21, 1989 to J. A. Church discloses fabric wrinkle removal aqueous alcoholic solution containing glycerine and a nonionic surfactant. U.S. Pat. No. 5,532,023, issued Jul. 2, 1996 to Vogel, Wahl, Cappel and Ward discloses aqueous wrinkle control compositions containing silicone and film forming polymer.

In the present invention, wrinkle control in fabrics, including clothing, dry cleanables, linens, bed clothes, draperies, window curtains, shower curtains, table linens, and the like, is acheived without the need for ironing. The present invention can be used on wet, damp, or dry clothing to relax wrinkles and give clothes a ready to wear or use look that is demanded by today's fast paced world. The present invention also essentially eliminates the need for touch up ironing usually associated with closet, drawer, and suitcase storage of garments.

An additional benefit of using polymer-based compositions in the present invention is that polymers provide improved benefits including any or all of the benefits named in the following list: garment shape, body, rewrinkle prevention, and/or crispness.

When ironing is desired however, preferred compositions of the present invention can also act as an excellent ironing aid. The present invention makes the task of ironing easier and faster by plasticizing fabric fibers and thus making it easier to work wrinkles out of the fabric. When used as an ironing aid, the compositions of the present invention help produce a crisp, smooth appearance, but also retaining a quality of softness.

SUMMARY OF THE INVENTION

The present invention relates to aqueous wrinkle reducing, removing and/or controlling compositions comprising polymer containing carboxylic acid moieties, that are preferably stable, well-dispersed opaque, translucent, or clear suspensions, dispersions, or solutions with the dispersed or solubilized polymer particulates being very small in particle size, that distribute evenly from dispensers to prevent staining. Specified pH solutions are acceptable if these have the low viscosity that is necessary to provide acceptable dispensing. The present invention also relates to preferred compositions containing, in addition to the essential carboxylic acid containing polymer and carrier, optional, but preferred ingredients, e.g. polyalkylene oxide polysiloxane, fabric care polysaccharides, odor control components, solvent, and minors such as perfume and preservative, adjusted to a specified pH to provide both good dispensing properties and improved stability to shear forces (e.g. stirring during processing or shaking that occurs during transit). The present invention further relates to methods of formulating such compositions, as well as fabric wrinkle control methods and articles of manufacture that comprise such fabric wrinkle controlling compositions. The fabric wrinkle control compositions typically comprise:

(A) an effective amount to control wrinkles in fabric of a polymer preferably selected from the group of polymers comprising carboxylic acid moieties that can be suspended, dispersed or solubilized at a specified pH range to produce a solution with a viscosity lower than the viscosity of that polymer composition at a pH above the specified pH range and with the viscosity of the solution preferably below about 20 centipoise ("cP"), more preferably below about 15 cP, even more preferably below about 12 cP, even more preferably below about 10 cP, still more preferably below about 7 cP and most preferably below about 3 cP, with the polymer incorporated at a level that is at least about 0.001%, preferably at least about 0.01%, and more preferably at least about 0.05%, and still more preferrably at least about 0.1% and even more preferably at least about 0.25% and most preferrably at least about 0.5% and at a level of no greater than about 25%, more preferably no greater than about 10%, even more preferably no greater than about 7%, and still more preferably no greater than about 5% by weight of the usage composition; mixtures of polymers are also acceptable in the present composition; and (B) carrier, preferably water.

The preferred polymer compositions of the present invention can optionally further comprise:

(A) optionally, but preferably, silicone compounds and/or emulsions. Silicone compounds that impart lubricity and softness are highly preferred. Silicones that reduce surface tension are also highly preferred. A preferred class of silicone materials includes silicones modified with alkylene oxide moieties compounds;

mixtures of silicones that provide desired benefits are also acceptable in the present composition;

(B) optionally, an effective amount of a supplemental wrinkle control agent selected from the group consisting of (1) adjunct polymer (2) fabric care polysaccharides, (3) lithium salts, (4) fiber fabric lubricants, and (5) mixtures thereof;

(C) optionally, an effective amount of a supplemental surface tension control agent;

(D) optionally, an effective amount to soften fibers and/or polymer of hydrophilic plasticizer wrinkle control agent;

(E) optionally, but preferably, at least an effective amount to absorb or reduce malodor, of odor control agent;

(F) optionally, but preferably, an effective amount to provide olfactory effects of perfume;

(G) optionally, an effective amount of solubilized, water-soluble, antimicrobial preservative, preferably from about 0.0001% to about 0.5%, more preferably fromabout 0.0002% to about 0.2%, most preferably from about 0.0003% to about 0.1%, by weight of the composition;

(H) optionally, an effective amount to adjust and control pH of a pH adjustment system;

(I) optionally, other ingredients such as adjunct odor-controlling materials, chelating agents, viscosity control agents, additional antistatic agents if more static control is desired, insect and moth repelling agents, colorants, whiteness preservative; anti-clogging agents; and;

(J) mixtures of optional components (A) through (I).

The present compositions are preferably essentially free of materials that would soil or stain fabric under usage conditions, or preferably free of materials at a level that would soil or stain fabrics unacceptably under usage conditions.

The present invention also relates to concentrated compositions, including liquid, fluid and solid forms of concentrated compositions that may be diluted to form compositions with the usage concentrations for use under usage conditions. It is preferred that the concentrated compositions be delivered in forms that rapidly and smoothly dissolve or disperse to the usage concentration.

The present invention further relates to a method of making the present compositions.

The present invention also relates to articles of manufacture comprising the present compositions incorporated into a container, such as a spray dispenser, that can facilitate treatment of articles and/or surfaces with said compositions containing wrinkle control agent and other optional ingredients at a level that is effective, yet is not discernible when dried on the surfaces. The spray dispenser comprises manually activated and non-manual powered (operated) spray means and a container containing the wrinkle controlling composition.

The present invention also relates to the combining the composition with a substrate and/or device capable of containing said composition for release at a desirable time in a fabric treatment process to create an article of manufacture. Such articles of manufacture can facilitate treatment of fabric articles and/or surfaces with said pH adjusted polymer compositions containing wrinkle control agent and other optional ingredients at a level that is effective, yet not discernible when dried on the surfaces of said fabric. The article of manufacture can operate in mechanical devices designed to alter the physical properties of articles and/or surfaces such as, but not limited to, a clothes dryer or mechanical devices designed to spray fabric care compositions on fabrics or clothes.

The present article of manufacture can further comprise a set of instructions to communicate methods of using the present compositions to the consumer. When articles of manufacture comprise devices or substrates that dispense the said composition, preferred devices or substrates will disperse the said composition in a uniform manner so as to minimize staining.

The present invention also comprises the use of small particle diameter droplets of the present compositions to treat fabrics, in order to provide superior performance, e.g., the method of applying the compositions to fabrics, etc. as very small particles (droplets) preferably having weight average diameter particle sizes (diameters) of from about 5 $\mu$m to about 250 $\mu$m, more preferably from about 10 $\mu$m to about 120 $\mu$m, and even more preferably from about 20 $\mu$m to about 100 $\mu$m.

DETAILED DESCRIPTION OF THE INVENTION

Figure 1:
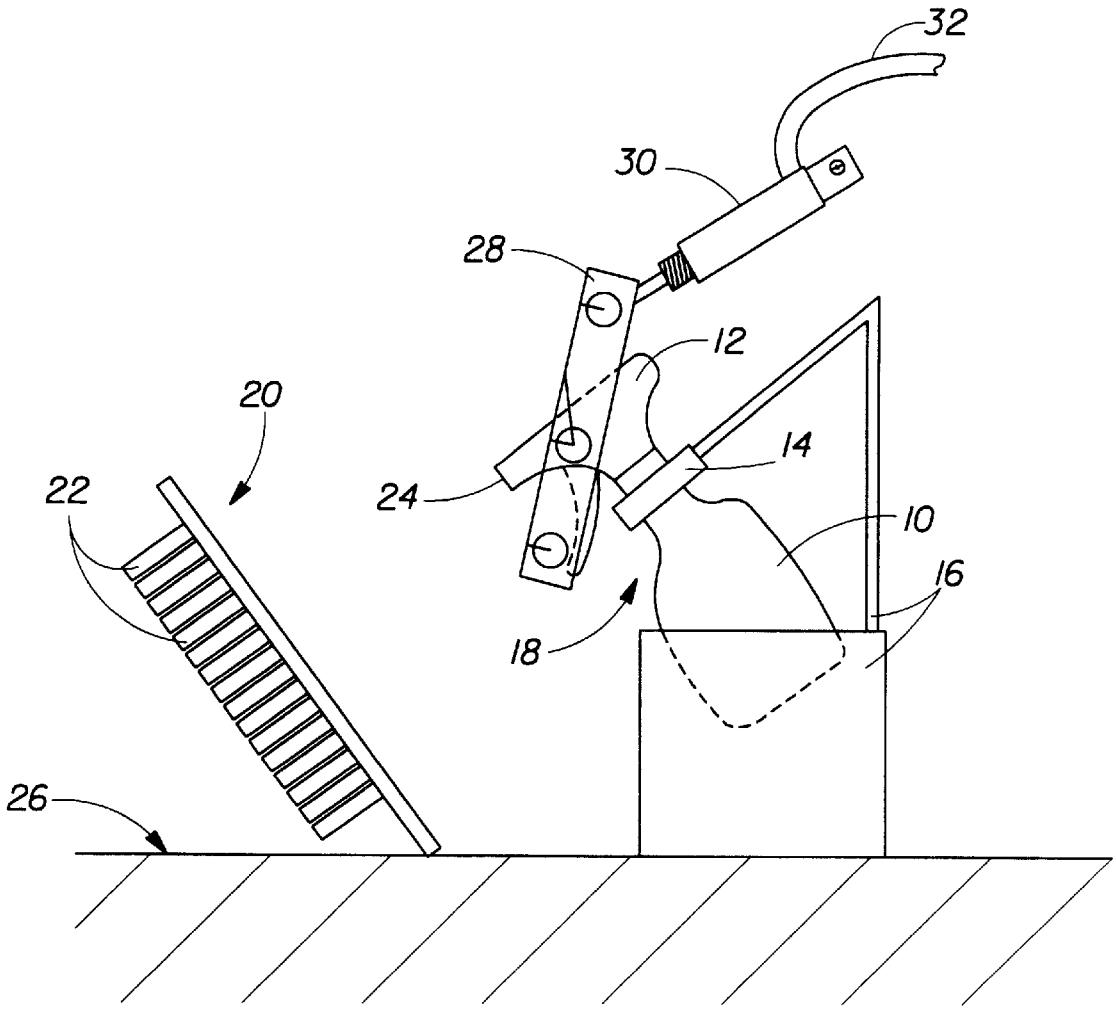
FIG. 1 is a schematic view of an apparatus for conducting the Patternator Test method described hereinafter in Section V.A.

The present invention relates primarily to pH adjusted polymer compositions, preferably for use in controlling wrinkles in fabrics, and to methods for treating fabrics in order to improve various properties of fabrics, in particular, reduction or removal of unwanted wrinkles. The present compositions are preferably well dispersed, and are preferably essentially free of any material that would soil or stain under usage conditions, or prefeably essentially free of material at a level that would unacceptably soil or stain fabric under usage conditions.

The present invention further relates to fabric wrinkle control methods and articles of manufacture that comprise the present pH adjusted polymer compositions. The present articles of manufacture preferably comprise the present compositions incorporated into a container, preferably a spray dispenser, to facilitate the treatment of fabric surfaces with said low-pH polymer compositions comprising polymer and other optional ingredients at a level that is effective, yet is not discernible when dried on the surfaces. The spray dispenser can comprise a manually-activated or non-manually powered spray means and container containing the present compositions. The present invention further relates to methods of making the present compositions.

The present invention also relates to articles of composition resulting from the combination of the said low-pH polymer compositions with a substrate and/or device capable of containing said composition when loaded into it and releasing said composition at an appropriate time with in a mechanical device designed to alter the physical properties of articles and/or surfaces such as, but not limited to, a clothes dryer or chambers designed to spray fabric care compositions on fabrics or clothes.

The present invention also relates to concentrated compositions, including liquids, solution, and solids (such as, but not limited to, granules and flakes), wherein the level of wrinkle control agent is typically at least about about 1% preferably at least about 5%, more preferably at least about 10%, still more preferably at least about 30% and typically less than about 100%, preferably less than about 99%, more preferably less than about 95%, and even more preferably less than about 90%, by weight of the concentrated composition. The concentrated composition is typically diluted to form usage compositions, with usage concentrations of, e.g., from about 0.025% to about 25%, by weight of the usage composition, of wrinkle control active as given hereinabove. Preferably the concentrated composition dilutes smoothly to appropriate usage levels. Specific levels of other optional ingredients in the concentrated composition can readily be determined from the desired usage composition and the desired degree of concentration.

Polymers comprising carboxylic acid moieties are preferred for fabric treatment because these polymers provide the desirable qualities of wrinkle removal, reduction and/or control, smoothness, and body desirable from polymers, but do not tend to attract build up of dingy soil in subsequent treatments (wash cycles) as do some other polymers especially cationic polymers. However, when polymers containing carboxylic acid moieties are neutralized, these tend to build a high level of viscosity in the composition, leading to poor dispensing in the form of a highly concentrated spray that will tend to stain fabrics. Not to be bound by theory, but as polymers comprising carboxylic acid moieties become completely neutralized at higher pH's (above about pH=7), the polymer head groups ionize and build up charge along the backbone. To reduce electrostatic repulsion between the ionized head groups, a highly neutralized, highly charged polymer will extend the backbone, thus effectively reducing charge repulsion between head groups and increase the size of polymer. As the polymer extends, it entangles with other polymers resulting in an increase in viscosity and a reduction in the spray quality. However it is suprisingly found that carboxylic acid comprising polymers can be adequately dispersed, particularly at lower pH values, such that visible residue will not occur. By maintaining a lower pH, the viscosity is reduced and dispensing from the a spray improves dramatically.

Suprisingly it is found that when preferred optional ingredients, e.g. alkylene oxide polysiloxane copolymer, fabric care polysaccharide, odor control components, solvent, and minor ingredients such as perfume and preservative, are added to the essential carboxylic acid polymer composition, the product tends to become unstable at pH's below a specified pH range. Many of the preferred optional ingredients (e.g. alkylene oxide polysiloxane, perfume) tend to be hydrophobic and therefore may complex with the polymer if the polymer is significantly protonated. The lower the pH, the more protonated a carboxylic acid containing polymer becomes and the less electrostatic charge it has thus, the said polymer also become less water soluble and less able to disperse via electrostatic charge mechanisms. Therefore, when the essential polymer is formulated with optional preferred ingredients, especially hydrophobic ingredients, it can tend to complex with these ingredients and form a precipitate. It is found that shear forces, such as the stirring that occurs during processing or the shaking that can occur druing transport, lead to precipitation of the formula. Suprisingly, it is found that by maintaining the pH within a specified pH range as the formulation is processed makes the formulation much more stable to shear forces and also maintains a low enough viscosity to allow for acceptable dispensing.

I. Composition

Water is inexpensive and effective at breaking hydrogen bonds and polymers are effective at helping to lubricate fibers, but especially at holding fibers and fabrics in place once the desired smoothness is achieved to retain the smoothness. Polymer compositions disclosed within are typically applied to fabrics by spraying either from a container or within a some type of mechanical chamber (e.g. dryer) for altering the properties of fabrics. Therefore to prevent fabric staining, it is important to have a polymer composition that mists or aerosolizes rather than streaming. In the present invention, it is shown that minimizing the viscosity of the carboxylic acid polymer composition by generating a low pH composition rather than using a higher pH composition favors dispensing the composition as a mist rather than dispensing as a stream. Another benefit to formulating carboxylic acid comprising polymers at the lower pH, is their ability to control amine odor at the lower pH's.

The polymer compositions of the present invention typically comprise:

(A) an effective amount to control wrinkles in fabric of a polymer preferably selected from the group consisting of polymers comprising carboxylic acid moieties that can be suspended or solubilized in at lower pH to produce a solution with a viscosity lower than the viscosity of that polymer composition when the pH is above the specified pH range and with the viscosity of the solution preferably below about 20 cP, more preferably below about 15 cP, even more preferably below about 12 cP, even more preferably below about 10 cP, still more preferably below about 7 cP and most preferably below about 3 cP with the said polymer incorporated at a level that is at least about 0.001%, preferably at least about 0.01%, and more preferably at least about 0.05%, and still more preferrably at least about 0. 1% and even more preferably at least about 0.25% and most preferrably at least about 0.5% and at a level of no greater than about 25%, more preferably no greater than about 10%, even more preferably no greater than about 7%, and still more preferably no greater than about 5% by weight of the usage composition; mixtures of polymers are also acceptable in the present composition; and (B) a carrier, that is preferably water. The preferred polymer compositions of the present invention can optionally further comprise:

(A) optionally, but preferably, silicone compounds and emulsions. Silicone compounds that impart lubricity and softness are highly preferred. Silicones that reduce surface tension are also highly preferred. A preferred class of silicone materials includes silicones modified with alkylene oxide moieties compounds; mixtures of silicones that provide desired benefits are also acceptable in the present composition;

(B) optionally, an effective amount of a supplemental wrinkle control agent selected from the group consisting of (1) adjunct polymer free of carboxylic acid moieties (2) polysaccharides, (3) lithium salts, (4) fiber fabric lubricants, and (5) mixtures thereof;

(C) optionally, an effective amount of a supplemental surface tension control agent;

(D) optionally, an effective amount to soften fibers and/or of hydrophilic plasticizer wrinkle control agent;

(E) optionally, but preferably, at least an effective amount to absorb or reduce malodor, of odor control agent;

(F) optionally, but preferably, an effective amount to provide olfactory effects of perfume;

(G) optionally, an effective amount of solubilized, water-soluble, antimicrobial preservative, preferably from about 0.0001% to about 0.5%, more preferably fromabout 0.0002% to about 0.2%, most preferably from about 0.0003% to about 0.1%, by weight of the composition;

(H) optionally, an effective amount to adjust and control pH of a pH adjustment system;

(I) optionally, other ingredients such as adjunct odor-controlling materials, chelating agents, viscosity control agents, additional antistatic agents if more static control is desired, insect and moth repelling agents, colorants; whiteness preservatives; and;

(J) mixtures of optional components (A) through (I).

The present polymer compositions are preferably essentially free of any material that would soil or stain fabric under usage conditions, or at least do not contain such materials at a level that would soil or stain fabrics unacceptably under usage conditions. The present compositions are preferably applied as small droplets to fabric when used as a wrinkle spray.

The following describes the ingredients, including optional ingredients, of the present polymer compositions in further detail.

(A) Polymer Comprising Carboxylic Acid Moieties

The polymers comprising carboxylic acid moieties can be natural, or synthetic, and hold fibers in place following drying by forming a film, providing adhesive properties, and/or by other mechanisms. The polymer is typically a homopolymer or a copolymer containing unsaturated organic mono-carboxylic and polycarboxylic acid monomers, and salts thereof, and mixtures thereof. The polymer comprising carboxylic acid moieties is incorporated in the present compositions at a level that is at least about 0.001%, preferably at least about 0.01%, and more preferably at least about 0.05%, and still more preferrably at least about 0.1% and even more preferably at least about 0.25% and most preferrably at least about 0.5% and at a level of no greater than about 25%, more preferably no greater than about 10%, even more preferably no greater than about 7%, and still more preferably no greater than about 5% by weight of the usage composition.

Polymers comprising carboxylic acid moieties provide the desired properties of wrinkle removal, reduction, and/or control as well as acting to retain the smooth appreance of fabrics as fibers dry and after fibers dry plus providing body without acting to attract soil as some other polymers tend to do, particularly cationic polymers. Polymers comprising carboxylic acid moieties have been typically formulated at pH's above about 6 in order to generate clear solutions. Clear solutions were believed to be preferred for preventing visible residue on fabrics after use. However, when polymers comprising carboxylic acid moieties are solubilized at relatively high pH's these tend to build an unacceptable level of viscosity of the composition which impares dispensing of the spray. Polymer compositions with high viscosities tend to dispense as streams which results in staining of fabric.

Suprisingly, it is found that when compositions are at a specified pH, even when these compositions are dispersions of small-size polymer particulates, as opposed to clear solutions containing solubilized polymer, that these compositions tend to dispense as a finer mist and actually result in less staining than polymer compositions at higher pH's.

As the pH of the carboxylic acid polymer compositions rises, the carboxylic acid moieties tend to deprotonate generating negatively charged head groups along the chain. Electrostatic repulsion between ionized head groups cause the polymers to increase their effective size in solution thus resulting in entanglements between polymers, which raises the viscosity. When viscosity rises, dispensing of the product in the form of a spray becomes difficult because the spray tends to stream, thus focusing an unacceptable volume of product on a small area of the fabric. It was suprisingly found that when the viscosity of the carboxylic acid polymer composition is reduced, by reducing the pH, streaming does not occur. Polymers suitable for this composition disperse or dissolve in solution at low pH to generate a composition with small particles having a viscosity preferably below about 20 cP, more preferably below about 15 cP, even more preferably below about 12 cP, even more preferably below about 10 cP, still more preferably below about 7 cP and most preferably below about 3 cP.

When preferred optional ingredients, e.g. alkylene oxide polysiloxane copolymer, fabric care polysaccharide, odor control components, solvent, and minor ingredients such as perfume and preservative, are added to the carboxylic acid polymer composition, the product tends to become unstable at pH's outside the specified pH range. Many of the preferred optional ingredients (e.g. alkylene oxide polysiloxane, perfume) tend to be hydrophobic and therefore may complex with the polymer if the polymer is significantly protonated. The lower the pH, the more protonated a carboxylic acid-containing polymer becomes and the less electrostatic charge it has. The polymer also become less water soluble and less able to disperse via electrostatic charge mechanisms. Therefore, when the essential polymer is formulated with optional preferred ingredients, especially hydrophobic ingredients, such as polyalkylene oxide polysiloxanes, it can tend to complex with these ingredients and form a precipitate. It is found that shear forces, such as the stirring that occurs during processing or the shaking that can occur druing transport, can lead to precipitation of the formula. It is further found that by maintaining a pH within a specified pH range as the formulation is processed, makes the formulation much more stable to shear forces and also maintains a low enough viscosity to allow for acceptable spray dispensing of the final composition. Therefore, when optional preferred ingredients are added to the polymer composition, it is preferred to maintain the pH throughout process and of the finished product within a specified pH range described herein.

Polymers comprising carboxylic acid moieties suitable for the present composition can be natural, or synthetic, and can, as disclosed above, act to hold fibers in place after wrinkles are smoothed out as the fabric dries and after the fabric dries by forming a film, and/or by providing adhesive properties and/or by other mechanisms that act to fix the fibers in place. By "adhesive", it is meant that when applied as a solution or a dispersion to a fiber surface and dried, the polymer can attach to the surface. The polymer can form a film on the surface, or when residing between two fibers and in contact with the two fibers, it can bond the two fibers together. Other polymers such as starches can form a film and/or bond the fibers together when the treated fabric is pressed by a hot iron. Such a film will have adhesive strength, cohesive breaking strength, and cohesive breaking strain.

The synthetic polymers useful in the present invention are comprised of monomers containing carboxylic acid moieties. The polymer can be a homopolymer or a copolymer. The polymer can comprise additional non-carboxylic acid monomers to form copolymers. Copolymers can be either graft or block copolymers. Cross-linked polymers are also acceptable. Some nonlimiting examples of carboxylic acid monomers which can be used to form the synthetic polymers of the present invention include: low molecular weight $C_1$–$C_6$ unsaturated organic mono-carboxylic and polycarboxylic acids, such as acrylic acid, methacrylic acid, crotonic acid, maleic acid and its half esters, itaconic acid, and mixtures thereof. Some preferred, but nonlimiting monomers include acrylic acid; methacrylic acid; and adipic acid. Salts of carboxylic acids can be useful in generating the synthetic polymers or copolymers as long as the final composition is within a specified pH range and has a viscosity consistent with generating a desireable spray pattern. Additional nonlimiting monomers that can be used to generate copolymers comprising carboxylic acid moieties include esters of said acids with $C_1$–$C_{12}$ alcohols, such as methanol, ethanol, 1-propanol, 2-propanol, 1-butanol, 2-methyl-1-propanol, 1-pentanol, 2-pentanol, 3-pentanol, 2-methyl-1-butanol, 1-methyl-1-butanol, 3-methyl-1-butanol, 1-methyl-1-pentanol, 2-methyl-1-pentanol, 3-methyl-1-pentanol, t-butanol, cyclohexanol, 2-ethyl-1-butanol, neodecanol, 3-heptanol, benzyl alcohol, 2-octanol, 6-methyl-1-heptanol, 2-ethyl-1-hexanol, 3,5-dimethyl-1-hexanol, 3,5,5-trimethyl-1-hexanol, 1-decanol, 1-dodecanol, and the like, and mixtures thereof. Nonlimiting examples of said esters are methyl acrylate, ethyl acrylate, t-butyl acrylate, methyl methacrylate, hydroxyethyl methacrylate, methoxy ethyl methacrylate, and mixtures thereof; amides and imides of said acids, such as N,N-dimethylacrylamide, N-t-butyl acrylamide, maleimides; low molecular weight unsaturated alcohols such as vinyl alcohol (produced by the hydrolysis of vinyl acetate after polymerization), allyl alcohol; esters of said alcohols with low molecular weight carboxylic acids, such as, vinyl acetate, vinyl propionate; ethers of said alcohols such as methyl vinyl ether; aromatic vinyl such as styrene, alpha-methylstyrene, t-butylstyrene, vinyl toluene, polystyrene macromer, and the like; polar vinyl heterocyclics, such as vinyl pyrrolidone, vinyl caprolactam, vinyl pyridine, vinyl imidazole, and mixtures thereof; other unsaturated amines and amides, such as vinyl amine, diethylene triamine, dimethylaminoethyl methacrylate, ethenyl formamide; vinyl sulfonate; salts of acids and amines listed above; low molecular weight unsaturated hydrocarbons and derivatives such as ethylene, propylene, butadiene, cyclohexadiene, vinyl chloride; vinylidene chloride; and mixtures thereof and alkyl quaternized derivatives thereof, and mixtures thereof. Preferably, said monomers are selected from the group consisting of vinyl alcohol; methyl acrylate; ethyl acrylate; methyl methacrylate; t-butyl acrylate; t-butyl methacrylate; n-butyl acrylate; n-butyl methacrylate; isobutyl methacrylate; 2-ethylhexyl methacrylate; dimethylaminoethyl methacrylate; N,N-dimethyl acrylamide; N,N-dimethyl methacrylamide; N-t-butyl acrylamide; vinylpyrrolidone; vinyl pyridine; diethylenetriamine; salts thereof and alkyl quaternized derivatives thereof, and mixtures thereof.

Preferably, said monomers form homopolymers and/or copolymers (i.e., the film-forming and/or adhesive polymer) having a glass transition temperature (Tg) of from about −20° C. to about 150° C., preferably from about −10° C. to about 150° C., more preferably from about 0° C. to about 100° C., most preferably, the adhesive polymer hereof, when dried to form a film will have a Tg of at least about 25° C., so that they are not unduly sticky, or "tacky" to the touch. Preferably said polymer comprising carboxylic acid moieties is soluble and/or dispersible in water and/or alcohol. Said polymer typically has a molecular weight of at least about 500, preferably from about 1,000 to about 2,000,000, more preferably from about 5,000 to about 1,000,000, and even more preferably from about 30,000 to about 300,000 for some polymers.

Some non-limiting examples of homopolymers and copolymers which can be used as film-forming and/or adhesive polymers of the present invention are: adipic acid/dimethylaminohydroxypropyl diethylenetriamine copolymer; ethyl acrylate/methacrylic acid copolymer, adipic acid/epoxypropyl diethylenetriamine copolymer; ethyl acrylate/methyl methacrylate/methacrylic acid/acrylic acid copolymer. Nonlimiting examples of preferred polymers that are commercially available include ethyl acrylate/methacrylic acid copolymer such as Luviflex® Soft and t-butyl acrylate/ethyl acrylate/methacrylic acid copolymer such as Luvime® 36D from BASF.

The present compositions containing polymer comprising carboxylic acid moieties are formulated such that the pH is within a specified pH range. As such, the present compositions have a pH that is at least about 1, preferably at least about 3, and more preferably at least about 5, and that is less than about 7. The preferred pH ranges are from about 3 to about 7, preferably from about 4 to about 6.5, and more preferably from about 5.0 to about 6.0. When optional preferred ingredients are added to the polymer composition it is preferred that the pH of the carboxylic acid polymer composition be within the specified pH range.

The viscosity of the present usage composition is typically below about 20 cP, preferably below about 15 cp, more preferably below about 12 cp, even more preferably below about 10 cp, still more preferably below about 7 cP, and most preferably below about 5 cP. The polymer comprising carboxylic acid moieties is incorporated at a level that is typically at least about 0.001%, preferably at least about 0.01%, more preferaly at least about 0.05%, still more preferably at least about 0.25% and most preferably at least about 0.5% and typically lower than about 25%, preferably lower than about 10%, more preferably lower than about 7%, still more preferably lower than about 5%. The level at which the polymer is incorporated is consistent with achieving a low viscosity composition that provides improved dispensing characteristics.

It is not intended to exclude the use of higher or lower levels of the polymers, as long as an effective amount is used to provide wrinkle removal, reduction, and/or control, body and the adhesive, film-forming properties or fixative properties necessary to hold fibers in a smooth conformation as drying occurs and after the fabric dries and as long as the composition can be formulated and effectively applied for its intended purpose and the viscosity of the final composition is acceptable.

Concentrated compositions can also be used in order to provide a less expensive product. When a concentrated product is used, i.e., the polymer is incorporated at a level that is typically about 1% to about 100%, by weight of the concentrated composition. It is preferable to dilute such a concentrated composition before treating fabric. Preferably, the concentrated composition is diluted with about 50% to about 400,000%, more preferably from about 50% to about 300,000%, and even more preferably from about 50% to about 200,000%, even more preferably from about 50% to about 125,000% by weight of the composition, of water. Liquid concentrates are acceptable, but solid concentrates are preferred. Preferred concentrates will dilute smoothly from the concentrated state to the usage state.

Another set of highly preferred adhesive and/or film forming polymers that are useful in the composition of the present invention comprise silicone moieties in the polymers. These preferred polymers include graft and block copolymers of silicone with moieties containing hydrophilic and/or hydrophobic monomers described hereinbefore. The silicone-containing copolymers in the spray composition of the present invention provide shape retention, body, and/or good, soft fabric feel.

Both silicone-containing graft and block copolymers useful in the present invention as polymers comprising carboxylic acid moieties typically have the following properties:

(1) The polymer comprises carboxylic acid moieties;

(2) the silicone portion is covalently attached to the non-silicone portion;

(3) the molecular weight of the silicone portion is from about 1,000 to about 50,000 and;

(4) the non-silicone portion must render the entire copolymer dispersible or soluble in the wrinkle control composition vehicle and permit the copolymer to deposit on/adhere to the treated fabrics.

Suitable silicone copolymers include the following:

(1) Silicone Graft Copolymers

Silicone-containing polymers useful in the present invention are the silicone graft copolymers comprising carboxylic acid moieties as disclosed above. Polymers of this description, along with methods for making them are are described in U.S. Pat. No. 5,658,557, Bolich et al., issued Aug. 19, 1997, U.S. Pat. No. 4,693,935, Mazurek, issued Sep. 15, 1987, and U.S. Pat. No. 4,728,571, Clemens et al., issued Mar. 1, 1988. Additional silicone-containing polymers are disclosed in U.S. Pat. Nos. 5,480,634, Hayama et al, issued Oct. 2, 1996, U.S. Pat. No. 5,166,276, Hayama et al., issued Nov. 24, 1992, 5,061,481, issued Oct. 29, 1991, Suzuki et al., U.S. Pat. No. 5,106,609, Bolich et al., issued Apr. 21, 1992, U.S. Pat. No. 5,100,658, Bolich et al., issued Mar. 31, 1992, U.S. Pat. No. 5,100,657, Ansher-Jackson, et al., issued Mar. 31, 1992, U.S. Pat. No. 5,104,646, Bolich et al., issued Apr. 14, 1992; all silicone-containing polymers suitable for the present invention and disclosed in patents listed above are incorporated herein by reference.

These polymers preferably include copolymers having a vinyl polymeric backbone having grafted onto it monovalent siloxane polymeric moieties, and components consisting of non-silicone hydrophilic and hydrophobic monomers of the type disclosed above including carboxylic acid moieties.

The silicone-containing monomers are exemplified by the general formula:

$$X(Y)_nSi(R)_{3-m}Z_m$$

wherein X is a polymerizable group, such as a vinyl group, which is part of the backbone of the polymer; Y is a divalent linking group; R is a hydrogen, hydroxyl, lower alkyl (e.g. $C_1$–$C_4$), aryl, alkaryl, alkoxy, or alkylamino; Z is a monovalent polymeric siloxane moiety having an average molecular weight of at least about 500, is essentially unreactive under copolymerization conditions, and is pendant from the vinyl polymeric backbone described above; n is 0 or 1; and m is an integer from 1 to 3.

The preferred silicone-containing monomer has a weight average molecular weight of from about 1,000 to about 50,000, preferably from about 3,000 to about 40,000, most preferably from about 5,000 to about 20,000.

Nonlimiting examples of preferred silicone-containing monomers have the following formulas:

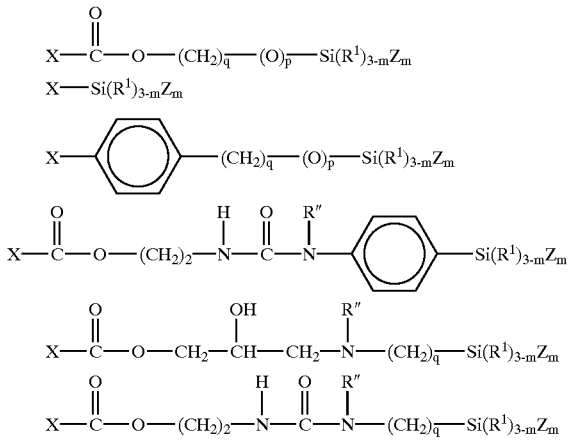

In these structures m is an integer from 1 to 3, preferably 1; p is 0 or 1; q is an integer from 2 to 6; n is an integer from 0 to 4, preferably 0 or 1, more preferably 0; $R^1$ is hydrogen, lower alkyl, alkoxy, hydroxyl, aryl, alkylamino, preferably R is alkyl; $R^1$ is alkyl or hydrogen; X is $$CH(R^3)=\!=C(R^4)-$$

$R^3$ is hydrogen or —COOH, preferably hydrogen; $R^4$ is hydrogen, methyl or —$CH_2$COOH, preferably methyl; Z is $$R^5-[Si(R^6)(R^7)-O-]_r$$

wherein $R^5$, $R^6$, and $R^7$, independently are lower alkyl, alkoxy, alkylamino, hydrogen or hydroxyl, preferably alkyl; and r is an integer of from about 5 to about 700, preferably from about 60 to about 400, more preferably from about 100 to about 300. Most preferably, $R^5$, $R^6$, and $R^7$ are methyl, p=0, and q=3.

The silicone-containing copolymers preferably have a weight average molecular weight of from about 10,000 to about 1,000,000, preferably from about 30,000 to about 300,000.

The preferred polymers comprise a vinyl polymeric backbone, preferably having a Tg or a Tm as defined above of about −20° C. and, grafted to the backbone, a polydimethylsiloxane macromer having a weight average molecular weight of from about 1,000 to about 50,000, preferably from about 5,000 to about 40,000, most preferably from about 7,000 to about 20,000. The polymer is such that when it is formulated into the finished composition, and then dried, the polymer phase separates into a discontinuous phase which includes the polydimethylsiloxane macromer and a continuous phase which includes the backbone.

Silicone-containing graft copolymers suitable for the present invention contain hydrophobic monomers, silicone-containing monomers and hydrophilic monomers which comprise unsaturated organic mono- and polycarboxylic acid monomers, such as acrylic acid, methacrylic acid, crotonic acid, maleic acid and its half esters, itaconic acid, and salts thereof, and mixtures thereof. These preferred polymers surprisingly also provide control of certain amine type malodors in fabrics, in addition to providing the fabric wrinkle control benefit. A nonlimiting example of such copolymer is n-butylmethacrylate/acrylic acid/(polydimethylsiloxane macromer, 20,000 approximate molecular weight) copolymer of average molecular weight of about 100,000, and with an approximate monomer weight ratio of about 70/10/20. A highly preferred copolymer is composed of acrylic acid, t-butyl acrylate and silicone-containing monomeric units, preferably with from about 20% to about 90%, preferably from about 30% to about 80%, more preferably from about 50% to about 75% t-butyl acrylate; from about 5% to about 60%, preferably from about 8% to about 45%, more preferably from about 10% to about 30% of acrylic acid; and from about 5% to about 50%, preferably from about 10% to about 40%, more preferably from about 15% to about 30% of polydimethylsiloxane of an average molecular weight of from about 1,000 to about 50,000, preferably from about 5,000 to about 40,000, most preferably from about 7,000 to about 20,000. Nonlimiting examples of acrylic acid/tert-butyl acrylate/polydimethyl siloxane macromer copolymers useful in the present invention, with approximate monomer weight ratio, are: t-butylacrylate/acrylic acid/(polydimethylsiloxane macromer, 10,000 approximate molecular weight) (70/10/20 w/w/w), copolymer of average molecular weight of about 300,000; t-butyl acrylate/acrylic acid/(polydimethylsiloxane macromer, 10,000 approximate molecular weight) (63/20/17), copolymer of average molecular weight of from about 120,000 to about 150,000; and n-butylmethacrylate/acrylic acid/(polydimethylsiloxane macromer—20,000 approximate molecular weight) (70/10/20 w/w/w), copolymer of average molecular weight of about 100,000. A useful and commercially available copolymer of this type is Diahold® ME from Mitsubishi Chemical Corp., which is a t-butyl acrylate/acrylic acid/(polydimethylsiloxane macromer, 12,000 approximate molecular weight) (60/20/20), copolymer of average molecular weight of about 128,000.

(2) Silicone Block Copolymers

Also useful herein are silicone block copolymers comprising repeating block units of polysiloxanes, as well as carboxylic acid moieties.

Examples of silicone-containing block copolymers are found in U.S. Pat. No. 5,523,365, to Geck et al., issued Jun. 4, 1996; U.S. Pat. No. 4,689,289, to Crivello, issued Aug. 25, 1987; U.S. Pat. No. 4,584,356, to Crivello, issued Apr. 22, 1986; *Macromolecular Design, Concept & Practice*, Ed: M. K. Mishra, Polymer Frontiers International, Inc., Hopewell Jct., NY (1994), and Block Copolymers, A. Noshay and J. E. McGrath, Academic Press, NY (1977) and silicone-containing block copolymers disclosed in these references which contain carboxylic acid groups all incorporated by reference herein.

The silicone-containing block copolymers useful in the present invention can be described by the formulas A—B, A—B—A, and $—(A—B)_n—$ wherein n is an integer of 2 or greater. A—B represents a diblock structure, A—B—A represents a triblock structure, and $—(A—B)_n—$ represents a multiblock structure. The block copolymers can comprise mixtures of diblocks, triblocks, and higher multiblock combinations as well as small amounts of homopolymers.

The silicone block portion, B, can be represented by the following polymeric structure $$—(SiR_2O)_m—,$$

wherein each R is independently selected from the group consisting of hydrogen, hydroxyl, $C_1$–$C_6$ alkyl, $C_1$–$C_6$ alkoxy, $C_2$–$C_6$ alkylamino, styryl, phenyl, $C_1$–$C_6$ alkyl or alkoxy-substituted phenyl, preferably methyl; and m is an integer of about 10 or greater, preferably of about 40 or greater, more preferably of about 60 or greater, and most preferably of about 100 or greater.

The non-silicone block, A, comprises carboxylic acid moieties. These polymers can also contain monomers selected from the monomers as described hereinabove in reference to the non-silicone hydrophilic and hydrophobic monomers for the silicone grafted copolymers. The non-silicone block A can contain also comprises amino acids (e.g. including but not limited to cystine as represented by the nonlimiting example Crodasone Cystine® from Croda).

When the optional cyclodextrin is present in the composition, the polymer useful in the composition of the present invention should be cyclodextrin-compatible, that is it should not substantially form complexes with cyclodextrin so as to diminish performance of the cyclodextrin and/or the polymer. Complex formation affects both the ability of the cyclodextrin to absorb odors and the ability of the polymer to impart shape retention to fabric. In this case, the monomers having pendant groups that can complex with cyclodextrin are not preferred because they can form complexes with cyclodextrin. Examples of such monomers are acrylic or methacrylic acid esters of $C_7$–$C_{18}$ alcohols, such as neodecanol, 3-heptanol, benzyl alcohol, 2-octanol, 6-methyl-1-heptanol, 2-ethyl-1-hexanol, 3,5-dimethyl-1-hexanol, 3,5,5-trimethyl-1-hexanol, and 1-decanol; aromatic vinyls, such as styrene; t-butylstyrene; vinyl toluene; and the like.

(B) Carrier

The preferred carrier of the present invention is water. The water which is used can be distilled, deionized, or tap water. Water is the preferred main liquid carrier due to its low cost, availability, safety, and environmental compatibility. Aqueous solutions are preferred for wrinkle control and odor control.

Water is very useful for fabric wrinkle removal or reduction. It is believed that water breaks many intrafiber and interfiber hydrogen bonds that keep the fabric in a wrinkle state. It also swells, lubricates and relaxes the fibers to help the wrinkle removal process.

Water also serves as the liquid carrier for the cyclodextrins, and facilitates the complexation reaction between the cyclodextrin molecules and any malodorous molecules that are on the fabric when it is treated. The dilute aqueous solution also provides the maximum separation of cyclodextrin molecules on the fabric and thereby maximizes the chance that an odor molecule will interact with a cyclodextrin molecule. It has also been discovered that water has an unexpected odor controlling effect of its own. It has been discovered that the intensity of the odor generated by some polar, low molecular weight organic amines, acids, and mercaptans is reduced when the odor-contaminated fabrics are treated with an aqueous solution. It is believed that water solubilizes and depresses the vapor pressure of these polar, low molecular weight organic molecules, thus reducing their odor intensity.

The level of liquid carrier in the compositions of the present invention is typically greater than about 70%, preferably greater than about 90%, and more preferably greater than about 92%, by weight of the composition. When a concentrated composition is used, the level of liquid carrier is typically equal to or below about 90%, by weight of the composition, preferably equal to or below about about 70%, more preferably equal to or below about 50%, even more preferably equal to or below about 30% by weight of the concentrated composition.

Solvents and/or Plasticizers

Optionally, in addition to water, the carrier can further comprise solvents and plasticizers that act to aid the natural ability of water to plasticize fibers. Acceptable solvents and plasticizers include compounds having from one to ten carbons. The following non-limiting classes of compounds are suitable: mono- alcohols, diols, polyhydric alcohols, ethers, ketones, esters, organic acids, and alkyl glyceryl ethers, and hydrocarbons. Preferred solvents are soluble in water and/or miscible in the presence of optional surfactant. Some nonlimiting examples include methanol, ethanol, isopropanol, hexanol, 1,2-hexanediol, hexylene glycol, (e.g. 2-methyl-2,4-pentanediol), isopropylen glycol (3-methyl-1, 3-butanediol), 1,2-butylene glycol, 2,3-butylene glycol, 1,3-butylene glycol, 1,4-butylene glycol, 1,3-propylene glycol, 1,2-propylene glycol, isomers of cyclohexanedimethanol, isomers of propanediol, isomers of butanediol, the isomers of trimethylpentanediol, the isomers of ethylmethylpentanediol, alcohol ethoxylates of 2-ethyl-1,3-hexanediol, 2,2,4-trimethyl-1 ,3-pentanediol, alcohol ethoxylates of 2,2,4-trimethyl-1,3-pentanediol glycerol, ethylene glycol, diethylene glycol, dipropylene glycol, sorbitol, 3-methyl-3-methoxybutanol, 3-methoxybutanol, 1-ethoxy-2-propanol, diethylene glycol monoethyl ether, diethylene glycol monopropyl ether, diethylene glycol monobutyl ether, triethylene glycol monoethyl ether, erythritol, and mixtures of solvents and plasticizers. When optional cyclodextrin is present, the plasticizer should be compatible with it. Mixtures of solvents are also suitable. When solvent is used, it is used typically at a level of at least about 0.5%, preferably at least about 1%, more preferably at least about 2%, even more preferably at least about 3% and still more preferably at least about 4% and typically less than about 30%, preferably less than about 25%, more preferably less than about 20%, even more preferably less than about 15% by weight of the composition.

(C) Optional Ingredients

In highly preferred compositions, the present low-viscosity polymer compositions can also comprise: (1) optional, but highly preferable, silicone compounds and emulsions; (2) optional supplemental wrinkle control agents selected from adjunct polymers, fabric care polysaccharides, lithium salts, fiber-fabric lubricants, and mixtures thereof; (3) optional surface tension control agents; (4) optional viscosity control compounds; (5) optional hydrophilic plasticizer; (6) optional, but preferable, odor control agent; (7) optional, but preferable, perfume; (8) optional, but preferable, antimicrobial active; (9) optional chelator, e.g. aminocarboxylate chelator; (10) optional buffer system, (11) optional water-soluble polyionic polymer; (12) viscosity control agent; (13) optional antistatic agent; (14) optional insect repellant; (15) optional colorant; (16) optional anti-clogging agent; (17) optional whiteness preservative; and (18) mixtures thereof.

(1) Silicone Compounds and Emulsions

Silicones compounds and emulsions of silicone compounds are optional, but highly preferred and desirable agents to be incorporated in the present composition because these typically impart lubricity and smoothness to fibers that allows them to slip or glide easily past one another and therefore enhances the process of wrinkle release or wrinkle control. Due to the versatility of silicone chemistry a variety of silicone, organo-silicones, substituted silicones compounds as well as emulsions of silicone compounds are offered by many manufacturers and therefore silicone compounds and emulsions offer a diverse array of benefits for the present composition. Silicones are especially facile at lubricating fibers and therefore in addition to providing good efficacy at reduction and/or removal of unwanted wrinkles, various silicones can also provide a multitude of other fabric care benefits, including the following fabric wear reduction; fabric pill prevention and/or reduction; and/or fabric color maintenance and/or fading reduction.

Silicones also provide a variety of formulation benfits such as surface tension control and sudsing control.

Since a variety of silicones are available, specific silicones may be chosen for specific usage situations. For instance, a silicone may be chosen for its ability to provide maximum lubricity and/or smoothness to a surface to provide the most efficacious removal and/or reduction of wrinkles. A silicone may be chosen for its ability to hold fibers in place after treatment to provide a degree of resistance to rewrinkling. A volatile silicone or a volatile silicone emulsion may be chosen for situations where the overspray is possible thus reducing the presence of silicone residue on surfaces. Silicones may be chosen for imparting low surface tension to formulations, thus adding in the emulsion of oily compounds (especially silicone oils) useful in the composition. Low surface tension is also useful for reducing the particle size of droplets in a spray. In cases when formulations tend to foam during processing or in use, silicone suds suppresors for foam control may be used. Silicones may be chosen that provide a variety of above benefits. Combinations of silicones are also useful in the present composition to achieve a benefit or a combination of benefits.

A preferred, but nonlimiting class of nonionic silicone surfactants are the polyalkylene oxide polysiloxanes. Typically the polyalkylene oxide polysiloxanes have a dimethyl polysiloxane hydrophobic moiety and one or more hydrophilic polyalkylene chains. The hydrophilic polyakylene chains can be incorporated as side chains (pendant moieties) or as block copolymer moieties with the polysiloxane hydrophobic moiety. Polyalkylene oxide polysiloxanes are described by the following general formulas:

$$R^1—(CH_3)_2SiO—[(CH_3)_2SiO]_a—[(CH_3)(R^1)SiO]_b—Si(CH_3)_2—R^1$$

wherein a+b are from about 1 to about 50, preferably from about 1 to about 30, more preferably from about 1 to about 25, and each R is the same or different and is selected from the group consisting of methyl and a poly(ethyleneoxide/propyleneoxide) copolymer group having the general formula:

$$—(CH_2)_nO(C_2H_4O)_c(C_3H_6O)_dR^2$$

with at least one $R^1$ being a poly(ethyleneoxy/propyleneoxy) copolymer group, and wherein n is 3 or 4, preferably 3; total c (for all polyalkyleneoxy side groups) has a value of from 1 to about 100, preferably from about 6 to about 100; total c+d has a value of from about 5 to about 150, preferably from about 7 to about 100 and each $R^2$ is the same or different and is selected from the group consisting of hydrogen, an alkyl having 1 to 4 carbon atoms, and an acetyl group, preferably hydrogen and/or methyl group. Each polyalkylene oxide polysiloxane has at least one $R^1$ group being a poly(ethyleneoxide/propyleneoxide) copolymer group.

Nonlimiting examples of these type of surfactants are the Silwet® surfactants which are available from Crompton Corp. Representative Silwet® surfactants which contain only ethyleneoxy ($C_2H_4O$) groups are as follows.

| Name | Average MW | Average a + b | Average total c |
|---|---|---|---|
| L-7608 | 600 | 1 | 8 |
| L-7607 | 1,000 | 2 | 17 |
| L-77 | 600 | 1 | 9 |
| L-7605 | 6,000 | 20 | 99 |
| L-7604 | 4,000 | 21 | 53 |

-continued

| Name | Average MW | Average a + b | Average total c |
|---|---|---|---|
| L-7600 | 4,000 | 11 | 68 |
| L-7657 | 5,000 | 20 | 76 |
| L-7602 | 3,000 | 20 | 29 |
| L-7622 | 10,000 | 88 | 75 |
| L-8600 | 2,100 | | |
| L-8610 | 1,700 | | |
| L-8620 | 2,000 | | |

Nonlimiting examples of Silwet® surfactants which contain both ethyleneoxy ($C_2H_4O$) and propyleneoxy ($C_3H_6O$) groups are as follows:

| Name | Average MW | EO/PO ratio |
|---|---|---|
| L-720 | 12,000 | 50/50 |
| L-7001 | 20,000 | 40/60 |
| L-7002 | 8,000 | 50/50 |
| L-7210 | 13,000 | 20/80 |
| L-7200 | 19,000 | 75/25 |
| L-7220 | 17,000 | 20/80 |

Nonlimiting examples of Silwet® surfactants which contain only propyleneoxy ($C_3H_6O$) groups are as follows:

| Name | Average MW |
|---|---|
| L7500 | 3,000 |
| L7510 | 13,000 |
| L7550 | 300 |
| L8500 | 2,800 |

The molecular weight of the polyalkyleneoxy group ($R^1$) is less than or equal to about 10,000. Preferably, the molecular weight of the polyalkyleneoxy group is less than or equal to about 8,000, and most preferably ranges from about 300 to about 5,000. Thus, the values of c and d can be those numbers which provide molecular weights within these ranges. However, the number of ethyleneoxy units (—$C_2H_4O$) in the polyether chain ($R^1$) must be sufficient to render the polyalkylene oxide polysiloxane water dispersible or water soluble. If propyleneoxy groups are present in the polyalkylenoxy chain, they can be distributed randomly in the chain or exist as blocks. Preferred polyalkylene oxide polysiloxanes provide lubricity to aid in wrinkle removal and can also provide softness which is especially preferred when the polymer leaves a rough feeling on the surface of the fabric. Nonlimiting examples of preferred Silwets® include L7001, L7200, and L7087. Other nonlimiting examples polyalkylene oxide polysiloxanes useful in the present invention include 190 Surfactant, 193 Surfactant, FF-400 Fluid, Q2-5220, Q4-3667, Q2-5211 available from Dow Corning®, SH3771C, SH3772C, SH3773C, SH3746, SH3748, SH3749, SH8400, SF8410, and SH8700 available from Toray Dow Corning Silicone Co., Ltd.; KF351 (A), KF352 (A), KF354 (A), and KF615 (A) available from Shin-Etsu Chemical Co., Ltd.; and TSF4440, TSF4445, TSF4446, TSF4452 available from GE Toshiba Silicone Co., Ltd.

Mixtures of polyalkylene oxide polysiloxaneswith preferred properties are also preferred. A nonlimiting example of a useful preferred mixture will include a polyalkylene oxide polysiloxane with a higher molecular weight, typically at least about 10,000 and preferably at least about 20,000 and a polysiloxane together with a lower molecular weight typically less than about 2000 and preferably less than about 1000 and having an aqueous surface tension less than about 30 dyne/cm and preferably less than about 25 dyne/cm. Such mixtures will provide a desireable blend of softness performance with wrinkle release.

Besides surface activity, polyalkylene oxide polysiloxane surfactants can also provide other benefits, such as antistatic benefits, lubricity, softness to fabrics, and improvements in fabric appearance.

The preparation of polyalkylene oxide polysiloxanes is well known in the art. Polyalkylene oxide polysiloxanes of the present invention can be prepared according to the procedure set forth in U.S. Pat. No. 3,299,112, incorporated herein by reference. Typically, polyalkylene oxide polysiloxanes of the surfactant blend of the present invention are readily prepared by an addition reaction between a hydrosiloxane (i.e., a siloxane containing silicon-bonded hydrogen) and an alkenyl ether (e.g., a vinyl, allyl, or methallyl ether) of an alkoxy or hydroxy end-blocked polyalkylene oxide). The reaction conditions employed in addition reactions of this type are well known in the art and in general involve heating the reactants (e.g., at a temperature of from about 85° C. to 110° C.) in the presence of a platinum catalyst (e.g., chloroplatinic acid) and a solvent (e.g., toluene).

Other nonlimiting silicone compounds and emulsions useful to the present invention include non-curable silicones (such as but not limited to volatile silicones, silicone oils, and polydimethyl silicones) and curable silicones (such as, but not limited to aminosilicones, phenylsilicones, and hydroxylsilicones. Also useful in the present compositions are silicone emulsions that comprise silicone oils such as 346 Emulsion, 347 Emulsion, and HV-490 available from Dow Corning. Specifically, the preferred silicone oil is dimethylsiloxane silicone, more preferably volatile dimethylsiloxane. The volatile silicones provide surprisingly good fiber lubrication without the risk of unacceptable build-up on the fabric and/or surrounding surfaces due to their volatile nature. The volatile silicones also provide a desirable control over the formation of wrinkles in fabrics while the fabrics are being dried.

Preferred silicones are neither irritating, toxic, nor otherwise harmful when applied to fabric or when they come in contact with human skin, and are chemically stable under normal use and storage conditions, and are capable of being deposited on fabric.

When the composition of this invention is to be dispensed from a spray dispenser in a consumer household setting, the noncurable silicones such as polydimethylsilicone, and especially the volatile silicones, are preferred. Curable and/or reactive silicones such as amino-functional silicones and silicones with reactive groups such as Si—OH, Si—H, silanes, and the like, are not preferred in this situation, because the portion of the composition that is sprayed but misses the garment, and falls instead on flooring surfaces, such as rug, carpet, concrete floor, tiled floor, linoleum floor, bathtub floor, can leave a silicone layer that is cured and/or bonded to the flooring surfaces. Such silicones that are bonded to surfaces are difficult to remove from the flooring surfaces. The flooring surfaces thus become slippery and can present a safety hazard to the household members. The curable and reactive silicones can be used in compositions specifically designed for use in enclosed areas such as in a dewrinkling enclosure, e.g., cabinet. Many types of amino-functional silicones also cause fabric yellowing. Thus, the silicones that cause fabric discoloration are also not preferred.

The preferred silicone is volatile silicone fluid which can be cyclic silicone fluid of the formula $[(CH_3)_2SiO]_n$ where n ranges between about 3 to about 7, preferably about 5, or a linear silicone polymer fluid having the formula $(CH_3)_3SiO[(CH_3)_2SiO]_mSi(CH_3)_3$ where m can be 0 or greater and has an average value such that the viscosity at 25° C. of the silicone fluid is preferably about 5 centistokes or less.

The non-volatile silicones that are useful in the composition of the present invention are polyalkyl and/or phenyl-silicones silicone fluids and gums with the following structure:

$$A—Si(R_2)—O—[Si(R_2)—O—]_q—Si(R_2)—A$$

The alkyl groups substituted on the siloxane chain (R) or at the ends of the siloxane chains (A) can have any structure as long as the resulting silicones remain fluid at room temperature.

Each R group preferably can be alkyl, aryl, hydroxy, or hydroxyalkyl group, and mixtures thereof, more preferably, each R is methyl, ethyl, propyl or phenyl group, most preferably R is methyl. Each A group which blocks the ends of the silicone chain can be hydrogen, methyl, methoxy, ethoxy, hydroxy, propoxy, and aryloxy group, preferably methyl. Suitable A groups include hydrogen, methyl, methoxy, ethoxy, hydroxy, and propoxy. q is preferably an integer from about 7 to about 8,000. The preferred silicones are polydimethyl siloxanes; more preferred silicones are polydimethyl siloxanes having a viscosity of from about 50 to about 1000,000 centistokes at 25° C. Mixtures of volatile silicones and non-volatile polydimethyl siloxanes are also preferred. Suitable examples include silicones offered by Dow Corning Corporation under the trade names 200 Fluid and 245 Fluid, and the General Electric Company under the trade names SF 1173, SF 1202, SF 1204, SF96, and Viscasil®.

Other useful silicone materials, but less preferred than polydimethylsiloxanes, include materials of the formula:

$$HO—[Si(CH_3)_2—O]_x—\{Si(OH)[(CH_2)_3—NH—(CH_2)_2—NH_2]O\}_y—H$$

wherein x and y are integers which depend on the molecular weight of the silicone, preferably having a viscosity of from about 10,000 cst to about 500,000 cst at 25° C. This material is also known as "amodimethicone". Although silicones with a high number, e.g., greater than about 0.5 millimolar equivalent of amine groups can be used, they are not preferred because they can cause fabric yellowing.

Similarly, silicone materials which can be used correspond to the formulas:

$$(R^1)_aG_{3-a}—Si—(—OSiG_2)_n—(OSiG_b(R^1)_{2-b})_m—O—SiG_{3-a}(R^1)_a$$

wherein G is selected from the group consisting of hydrogen, phenyl, OH, and/or $C_1$–$C_8$ alkyl; a denotes 0 or an integer from 1 to 3; b denotes 0 or 1; the sum of n+m is a number from 1 to about 2,000; $R^1$ is a monovalent radical of formula $C_pH_{2p}L$ in which p is an integer from 2 to 8 and L is selected from the group consisting of:

$—N(R^2)CH_2—CH_2—N(R^2)_2$;

$—N(R^2)_2$;

$—N+(R^2)_3\ A^-$; and $—N+(R^2)CH_2—CH_2N^+H_2\ A^-$ wherein each $R^2$ is chosen from the group consisting of hydrogen, phenyl, benzyl, saturated hydrocarbon radical, and each $A^-$ denotes compatible anion, e.g., a halide ion; and $$R^3—N^+(CH_3)_2—Z—[Si(CH_3)_2O]_f—Si(CH_3)_2—Z—N^+(CH_3)_2—R^3.2CH_3COO^-$$

wherein $Z=—CH_2—H(OHHCH_2O—CH_2)_3—$ $R^3$ denotes a long chain alkyl group; and f denotes an integer of at least about 2.

In the formulas herein, each definition is applied individually and averages are included.

Another silicone material which can be used, but is less preferred than polydimethyl siloxanes, has the formula:

$$(CH_3)_3Si—[O—Si(CH_3)_2]_n—\{OSi(CH_3)[(CH_2)_3—NH—(CH_2)_2—NH_2]\}_m—OSi(CH_3)_3$$

wherein n and m are the same as before. The preferred silicones of this type are those which do not cause fabric discoloration.

Alternatively, the silicone material can be provided as a moiety, or a part, of a non-silicone molecule. Examples of such materials are copolymers having siloxane macromers grafted thereto, which meet the functional limitations as defined above. That is, the non-silicone backbone of such polymers should have a molecular weight of from about 5,000 to about 1,000,000, and the polymer should preferably have a glass transition temperature (Tg), i.e., the temperature at which the polymer changes from a brittle vitreous state to a plastic state, of greater than about −20° C.

(2) Supplemental Wrinkle Control Agents

An effective amount of an optional supplemental wrinkle control agent, is preferably selected from the group consisting of: (a) adjunct polymers (b) fabric care polysaccharides, (c) lithium salts (d) synthetic solid particles, (e) quaternary ammonium compounds, (f) vegetable oils and vegetable oil derivatives (g) mixtures thereof, and can be utilized in the present preferred low-viscosity polymer compositions as described below.

Adjunct polymers are polymers that aid wrinkle control by removing and reducing wrinkles and by holding fibers and fabrics in place after the composition dries to prevent rewrinkling. These are polymers that comprise all monomers disclosed in I.A. above, but are essentially free of carboxylic acid moieties. When optional adjunct polymers are used these are typically included at levels of at least about 0.001% preferably 0.01%, more preferably at least about 0.1%, even more preferably at least about 0.5% and less than about 25%, more preferably less than about 10%, even more preferably less than about 7%, still more preferably less than about 5% by weight of the composition.

Fabric care polysaccharides suitable for this invention are those polysaccharides that typically assume compact and/or globular structures in dilute aqueous solutions. Not to be bound by theory, but due to these structural properties, fabric care polysaccharides are believed to bind effectively to fibers and fibrils, and particularly natural fibers fibrils, and particularly act to fit into or fill in damaged, amorphous, or weakened areas of a fiber to and act to bind fibrils back onto fibers and bind fibers to fibers. These actions are believed to strengthen fibers and impart a variety of fabric care benefits, including, but not limited to wrinkle removal and/or reduction, fabric strengthening, fabric wear resistance and/or reduction, fabric pilling prevention and/or reduction, fabric color maintenance and/or fading reduction, fabric shrinkage prevention and/or reduction and/or improving fabric feel/smoothness, scratchiness reduction for a variety of fabrics such as cellulosic (cotton, rayon, etc.) wool, silk, and the like. Typically, compositions will contain, depending on application at least about 0.001%, preferably at least about 0.01%, and more preferably at least about 0.1% and less than about 20%, preferably less than about 10%, and more preferably less than about 5% of a fabric care polysaccharide chosen from the group of primary fabric care polysaccharides, adjunct fabric care polysacchrides or mixtures thereof.

Aqueous compositions comprising lithium salts and/or lithium salt hydrates provide improved fabric wrinkle control. The preferred lithium salt is lithium bromide, lithium lactate, and/or mixtures thereof. Useful levels of lithium salts are from about 0.1% to about 10%, preferably from about 0.5% to about 7%, and more preferably from about 1% to about 5%, by weight of the usage composition.

Fiber lubricants impart a lubricating property or increased gliding ability to fibers in fabric, particularly clothing. Water and other alcoholic solvents typically break or weaken the hydrogen bonds that hold the wrinkles, and the fabric lubricant facilitates the ability of the fibers to glide on one another to further release the fibers from the wrinkle condition in wet or damp fabric. After the fabric is dried, the residual silicone can provide lubricity to reduce the tendency of fabric rewrinkling.

(a) Adjunct Polymers Free of Carboxylic Acid Moieties

Adjunct polymers can comprise all monomers disclosed above, but are essentially free of monocarboxylic acid moieties and do not raise the viscosity above levels useful for the present invention. Adjunct polymers can also comprise polymers typically referred to in literature as 'starches' which may or may not comprise monocarboxylic acids. Adjunct polymers suitable for the present invention will not interact with polymers or other ingredients, e.g. cyclodextrin in a way such that these materials are rendered nonfunctional or in a way that adversely affects composition solubility (e.g. separation).

Some nonlimiting examples of adjunct polymers include: poly(vinylpyrrolidone/dimethylaminoethyl methacrylate); polyvinyl alcohol; polyvinylpyridine n-oxide; polyamine resins; and polyquaternary amine resins; poly (ethenylformamide); poly(vinylamine) hydrochloride; poly (vinyl alcohol-co-6% vinylamine); poly(vinyl alcohol-co-12% vinylamine); poly(vinyl alcohol-co-6% vinylamine hydrochloride); and poly(vinyl alcohol-co-12% vinylamine hydrochloride). Some nonlimiting examples of preferred commecially available adjunct polymers include: polyvinylpyrrolidone/dimethylaminoethyl methacrylate copolymer, such as Copolymer 958®, molecular weight of about 100,000, polyvinyl alcohol copolymer resin, such as Vinex 2019®, available from Air Products and Chemicals; polyamine resins, such as Cypro 514®, Cypro 515®, Cypro 516®, available from Cytec Industries; polyquaternary amine resins, such as Kymene 557H®, available from Hercules Incorporated.

Silicone-containing block and graft copolymers suitable as adjunct polymers are that conform to structures disclosed above in section A, but are essentially free of carboxylic acid moieties.

(i) Silcone Graft Copolymeres

Silicone graft copolymers that are suitable as adjunct polymers are those adhereing to the description disclosed above for silicone graft copolymers, but are essentially free of carboxylic acid groups.

Exemplary silicone grafted polymers for use as adjunct polymers in the present invention include the following, where the composition of the copolymer is given with the approximate weight percentage of each monomer used in the polymerization reaction to prepare the copolymer: N,N-dimethylacrylamide/isobutyl methacrylate/(PDMS macromer—20,000 approximate molecular weight) (20/60/20 w/w/w), copolymer of average molecular weight of about 400,000; N,N-dimethylacrylamide/(PDMS macromer—20,000 approximate molecular weight) (80/20 w/w), copolymer of average molecular weight of about 300,000; and t-butylacrylate/N,N-dimethylacrylamide/(PDMS macromer—10,000 approximate molecular weight) (70/10/20), copolymer of average molecular weight of about 400,000.

(ii) Silicone Block Copolymers

Silicone block copolymers that are useful as adjunct polymers for the present invention are those polymers that conform to the description of silicone block copolymers herein above, but are essentially free of carboxylic acid moieties.

(iii) Sulfur-linked Silicone-containing Copolymers

Also useful herein are sulfur-linked silicone containing copolymers, including block copolymers. As used herein in reference to silicone containing copolymers, the term "sulfur-linked" means that the copolymer contains a sulfur linkage (i.e., —S—), a disulfide linkage (i.e., —S—S—), or a sulfhydryl group (i.e., —SH).

These sulfur-linked silicone-containing copolymers are represented by the following general formula:

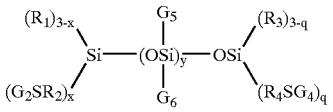

wherein each $G_5$ and $G_6$ is independently selected from the group consisting of alkyl, aryl, alkaryl, alkoxy, alkylamino, fluoroalkyl, hydrogen, and —ZSA, wherein A represents a vinyl polymeric segment consisting essentially of polymerized free radically polymerizable monomer, and Z is a divalent linking group (Useful divalent linking groups Z include but are not limited to the following: $C_1$ to $C_{10}$ alkylene, alkarylene, arylene, and alkoxyalkylene. Preferably, Z is selected from the group consisting of methylene and propylene for reasons of commercial availability.);

each G2 comprises A;

each $G_4$ comprises A;

each $R_1$ is a monovalent moiety selected from the group consisting of alkyl, aryl, alkaryl, alkoxy, alkylamino, fluoroalkyl, hydrogen, and hydroxyl (Preferably, $R_1$ represents monovalent moieties which can independently be the same or different selected from the group consisting of $C_{1-4}$ alkyl and hydroxyl for reasons of commercial availability. Most preferably, $R_1$ is methyl.);

each $R_2$ is a divalent linking group (Suitable divalent linking groups include but are not limited to the following: $C_1$ to $C_{10}$ alkylene, arylene, alkarylene, and alkoxyalkylene. Preferably, $R_2$ is selected from the group consisting of $C_{1-3}$ alkylene and $C_7$–$C_{10}$ alkarylene due to ease of synthesis of the compound. Most preferably, $R_2$ is selected from the group consisting of —$CH_2$—, 1,3-propylene, and

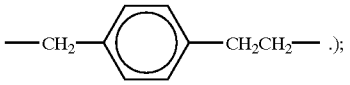

each $R_3$ represents monovalent moieties which can independently be the same or different and are selected from the group consisting of alkyl, aryl, alkaryl, alkoxy, alkylamino, fluoroalkyl, hydrogen, and hydroxyl (Preferably, $R_3$ represents monovalent moieties which can independently be the same or different selected from the group consisting of $C_{1-4}$ alkyl and hydroxyl for reasons of commercial availability. Most preferably, $R_3$ is methyl.);

each $R_4$ is a divalent linking group(Suitable divalent linking groups include but are not limited to the following: $C_1$ to $C_{10}$ alkylene, arylene, alkarylene, and alkoxyalkylene. Preferably, $R_4$ is selected from the group consisting of $C_{1-3}$ alkylene and $C_7$–$C_{10}$ alkarylene for ease of synthesis. Most preferably, $R_4$ is selected from the group consisting of —$CH_2$—, 1,3-propylene, and

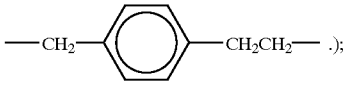

x is an integer of 0–3;

y is an integer of 5 or greater (preferably y is an integer ranging from about 14 to about 700, preferably from about 20 to about 200); and q is an integer of 0–3; wherein at least one of the following is true:

q is an integer of at least 1;

x is an integer of at least 1;

$G_5$ comprises at least one —ZSA moiety; or $G_6$ comprises at least one —ZSA moiety.

As noted above, A is a vinyl polymeric segment formed from polymerized free radically polymerizable monomers. The selection of A is typically based upon the intended uses of the composition, and the properties the copolymer must possess in order to accomplish its intended purpose. If A comprises a block in the case of block copolymers, a polymer having AB and/or ABA architecture will be obtained depending upon whether a mercapto functional group —SH is attached to one or both terminal silicon atoms of the mercapto functional silicone compounds, respectively. The weight ratio of vinyl polymer block or segment, to silicone segment of the copolymer can vary. The preferred copolymers are those wherein the weight ratio of vinyl polymer segment to silicone segment ranges from about 98:2 to 50:50, in order that the copolymer possesses properties inherent to each of the different polymeric segments while retaining the overall polymer's solubility. Sulfur linked silicone copolymers are described in more detail in U.S. Pat. No. 5,468,477, to Kumar et al., issued Nov. 21, 1995, and PCT Application No. WO 95/03776, assigned to 3M, published Feb. 9, 1995, which are incorporated by reference herein in their entirety.

(b) Starches

Starch is not normally preferred, since it makes the fabric resistant to deformation. However, it does provide increased "body" which is often desired. Any type of starch, e.g. those derived from corn, wheat, rice, grain sorghum, waxy grain sorghum, waxy maize or tapioca, or mixtures thereof and water soluble or dispersible modifications or derivatives thereof, can be used in the composition of the present invention. Modified starches that can be used include natural starches that have been degraded to obtain a lower viscosity by acidic, oxidative or enzymatic depolymerization. Additionally, low viscosity commercially available propoxylated and/or ethoxylated starches are useable in the present composition and are preferred since their low viscosity at relatively high solids concentrations make them very adaptable to spraying processes. Suitable alkoxylated, low viscosity starches are submicron sized particles of hydrophobic starch that are readily dispersed in water and are prepared by alkoxylation of granular starch with a monofunctional alkoxylating agent which provides the starch with ether linked hydrophilic groups. A suitable method for their preparation is taught in U.S. Pat. No. 3,462,283. In accordance with the invention, the propoxylated or ethoxylated starch derivatives are dispersed in the aqueous medium in an amount of from about 0.1% to about 10%, preferably from about 0.5% to about 6%, more preferably from about 1% to about 4% by weight of the usage composition.

Combinations of polymers are also useful in the present composition. One highly preferred polymer combination comprises a copolymer containing ethyl acrylate and methacrylate monomers and a silicone block copolymer containing alkylene oxide units as the non-silicone block portion.

(c) Fabic Care Saccharides (i) Primary Fabric Care Polysaccharide

Suitable fabric care polysaccharides for use in the fabric care composition of the present invention are those which have a globular conformation in dilute aqueous solution, via a random coiling structure. Said polysaccharides include homo- and/or hetero-polysaccharides with simple helical structure with or without branching, e.g., with 1,4-α-linked backbone structure (e.g., 1,4-α-glucan, 1,4-α-xylan) with or without branching, 1,3-β-linked backbone with or without branching (e.g., galactan), and all 1,6-linked backbones with or without branching (e.g., dextran, pullulan, pustulan), and with a weight-average molecular weight of from about 5,000 to about 500,000, preferably from about 8,000 to about 250,000, more preferably from about 10,000 to about 150,000, typically with sizes ranging from about 2 nm to about 300 nm, preferably from about 3 nm to about 100 nm, more preferably from about 4 nm to about 30 nm. The size is defined as the gyration length occupied by the molecule in dilute aqueous solutions.

Preferably the fabric care polysaccharide is selected from the group consisting of arabinogalactan, pachyman, curdlan, callose, paramylon, sceleroglucan, lentinan, lichenan, laminarin, szhizophyllan, grifolan, sclerotinia sclerotiorum glucan (SSG), Ompharia lapidescence glucan (OL-2), pustulan, dextran, pullulan, substituted versions thereof, derivatised versions thereof, and mixtures thereof. More preferably the fabric care polysaccharide is selected from the group consisting of arabinogalactan, dextran, curdlan, substituted versions thereof, derivatised versions thereof, and mixtures thereof, and even more preferably the fabric care polysaccharide comprises arabinogalactan, substituted versions thereof, derivatised versions thereof, and mixtures thereof. Substituted and/or derivatised materials of the fabric care polysaccharides listed hereinabove are also preferred in the present invention. Nonlimiting examples of these materials include: carboxyl and hydroxymethyl substitutions (e.g., some uronic acid instead of neutral sugar units); amino polysaccharides (amine substitution); cationic quaternized polysaccharides; $C_1$–$C_{18}$ alkylated polysaccharides; acetylated polysaccharide ethers; polysaccharides having amino acid residues attached (small fragments of glycoprotein); polysaccharides containing silicone moieties, and the like. Some hydrophobic derivatives of the polysaccharides help the polysaccharides maintaining the globular conformation.

A preferred class of fabric care polysaccharides suitable for use in the present invention include those that have the backbone comprising at least some, but preferably almost entirely of 1,3-β-glycosidic linkages, preferably branched, preferably with either side chains attached with 1,6-linkages or derivatised for better water solubility and/or to maintain the globular structure. The 1,6-linked branched polysaccharides with 1,3-β-linked backbone have higher water solubility and/or dispersibility than the non-branched polysaccharides, so that branched polysaccharides can be used at higher molecular weight ranges. Inserting other types of linkages, such as some 1,4-β-linkages in the 1,3-β-linked backbone also improves the solubility of the polysaccharides. Nonlimiting examples of useful fabric care polysaccharides with 1,3-β-linked backbone include arabinogalactan, pachyman, curdlan, callose, paramylon, sceleroglucan, lentinan, lichenan, laminarin, szhizophyllan, grifolan, sclerotinia sclerotiorum glucan (SSG), Ompharia lapidescence glucan (OL-2), and mixtures thereof. Low molecular weight materials are preferred for polysaccharides with less or no branching, such as curdlan, while higher molecular weight materials for highly branched polysaccharides, such as arabinogalactan, can be used. Higher molecular weight polysaccharides with mixed 1,3-β and 1,4-Pβ linkages, such as lichenan, can also be used.

A preferred fabric care branched polysaccharide with 1,3-β-linked backbone is arabinogalactan (also named as galactoarabinan or epsilon-galactan). Arabinogalactans are long, densely branched high-molecular weight polysaccharides. Arabinogalactan that is useful in the composition of the present invention has a molecular weight range of from about 5,000 to about 500,000, preferably from about 6,000 to about 250,000, more preferably from about 10,000 to about 150,000. These polysaccharides are highly branched, consisting of a galactan backbone with side-chains of galactose and arabinose units (consisting of Sgalactopyranose, β-arabinofuranose, and Farabinopyranose). The major source of arabinogalactan is the larch tree. The genus Larix (larches) is common throughout the world. Two main sources of larch trees are western larch (*Larix occidentalis*) in Western North America and Mongolian larch (*Larix dahurica*). Examples of other larches are eastern larch (*Larix laricina*) in eastern North America, European larch (*Larix dicidua*), Japanese larch (*Larix leptolepis*), and Siberian larch (*Larix siberica*). Most commercial arabinogalactan is produced from western larch, through a counter-current extraction process. Larch arabinogalactan is water soluble and is composed of arabinose and galactose units in about a 1:6 ratio, with a trace of uronic acid. Glycosyl linkage analysis of larch arabinogalactan is consistent with a highly branched structure comprising a backbone of 1,3-β-linked galactopyranose connected by 1,3-β-glycosidic linkages, comprised of 3,4,6-, 3,6-, and 3,4- as well as 3-linked residues. The molecular weights of the preferred fractions of larch arabinogalactan include one fraction in the range of from about 14,000 to about 22,000, mainly from about 16,000 to about 21,000, and the other in the range of from about 60,000 to about 500,000, mainly from about 80,000 to about 120,000. The fraction that has the average molecular weight of from about 16,000 to about 20,000 is highly preferred for use in direct applications to fabric, such as in spray-on products. The high molecular weight fraction (of about 100,000 molecular weight), as well as the low molecular weight fraction are suitable for use in processes that involve subsequent water treatments, such as, pre-soak, wash-added and/or rinse-added laundry processes and products. High grade larch arabinogalactan is composed of greater than about 98% arabinogalactan. Larch arabinogalactan and some of its derivatives, such as cationic derivatives are commercially available from Larex, Inc., St Paul, Minn.

Arabinogalactans are also present as minor, water-soluble components of softwoods such as hemlock, black spruce, parana pine, mugo pine, Douglas fir, incense cedar, juniper, and the sapwood of sugar maple. Many edible and inedible plants are also rich sources of arabinogalactans, mostly in glycoprotein form, bound to a protein spine of either threonine, proline, or serine ("arabinogalactan-protein"). These plants include leek seeds, carrots, radish, black gram beans, pear, maize, wheat, red wine, Italian ryegrass, tomatoes, ragweed, sorghum, bamboo grass, and coconut meat and milk. Many herbs with well established immune-enhancing properties, such as *Echinacea purpurea, Baptisia tintoria, Thuja occidentalis, Angelica acutiloba*, and *Curcuma longa* contain significant amounts of arabinogalactans. Small quantities of arabinogalactans also occur in other plants, such as, green coffee bean (sugar ratio about 2:5), centrosema seeds (sugar ratio about 1:13), and wheat flour (sugar ratio about 7:3). About 70% of the water solubles from soybean flour is an arabinogalactan with a sugar ratio of about 1:2.

Examples of other fabric care polysaccharides that have 1,3-β-linkage as a part of the backbone include: 1,3-β-xylan (from, e.g., *Pencillus dumetosus*), curdlen, a 1,3-β-glucan (from e.g., *Alcaligenes faecalis*), paramylon B, a 1,3-β-glucan (from, e.g., *Euglena gracilis*), lichenin, a (1,3),(1,4)-β-glucan (from various sources including *Cetraria islandica*), sceleroglucan, a (1,3),(1,6)-β-glucan (from, e.g., *Sclerotium rolfii*), and lentinen, a (1,3),(1,6)-β-glucan (from, e.g., *Lentinus edodes*). More details about these and other polysaccharides with 1,3-β-linked backbone are given in "Chemistry and Biology of (1→3)-,Glucans", B. A. Stone and A. E. Clarke, La Trobe University Press, Victoria, Australia, 1992, pp. 68–71, and 82–83, incorporated herein by reference.

Substituted and/or derivatised materials of arabinogalactans are also preferred in the present invention. Nonlimiting examples of these materials include: carboxyl and hydroxymethyl substitutions (e.g., some uronic acid instead of neutral sugar units); amino polysaccharides (amine substitution); cationic quaternized polysaccharides; $C_1$–$C_{18}$ alkylated polysaccharides; acetylated polysaccharide ethers; polysaccharides having amino acid residues attached (small fragments of glycoprotein); polysaccharides containing silicone moieties. These substituted and/or derivatised polysaccharides can provide additional benefits, such as: amine substitution can bind and/or condense with oxidatively damaged regions of the fiber to rejuvenate aged fabrics; acetylated sugar ethers can serve as bleach activators in subsequent processes where hydrogen peroxide is present; polysaccharides having amino acid residues can improve delivery of fabric care benefits for fabrics containing proteinaceous fibers, e.g., wool and silk; and silicone-derivatised polysaccharides can provide additional fabric softness and lubricity. Examples of derivatised arabinogalactan include the 3-chloro-2-hydroxypropyltrimethyl ammonium chloride derivative, available from Larex, Inc and the arabinogalactan-proteins given hereinabove.

The 1,3-β-linked backbone of the fabric care polysaccharides of the present invention (as in 1,3-β-galactans, 1,3-β-D-mannans, 1,3-β-xylans and 1,3-β-D-glucans) has a pseudohelical conformation. As such, these polysaccharides have a backbone chain that is flexible and in aqueous solution, has a tendency to coil into a globular structure to substantially reduce their apparent dimension (gyration volume), as opposed to the backbone chain of 1,4-β-glucan which has an extended dimension. The polysaccharides with 1,3-β-linked backbone and extensive branching via 1,6-linkages, or polysaccharides with helical confirmation or polysaccharides with 1,6-linked backbone have added flexibility due to the "coiling" nature of the 1,6-linkages. In water these polysaccharides with 1,3-β-linked backbone and 1,6-branching, e.g., arabinogalactans, have a globular conformation with high flexibility to coil into compact, flexible and deformable microscopic particles. For example, an arabinogalactan having a nominal molecular weight of about 18,000 has a size (gyration length) of only from 5 nm to about 10 nm in dilute aqueous solutions. This structural feature of the globular polysaccharides with helical conformation and random coiling nature improves physical properties such as water-solubility, low viscosity and emulsification. Not to be bound by theory it is believed that the globular, compact and flexible structural property and low viscosity of the fabric care polysaccharides with 1,3-β-linked backbone of the present invention, such as arabinogalactans, is important for providing the fabric care benefits, either via efficient deposition of the polysaccharide globules on the rough fabric surface or via appropriate fitting/filling of these globules in the openings and/or defective spaces on the fabric fiber surface, where they can orient itself to conform to the space available. Furthermore, it is believed that at low levels, these low molecular weight (about 10,000 to about 150,000) polysaccharide globules of the present invention can very effectively bond fibers and/or microfibrils together by "spot bonding". This way, the fabric care polysaccharide globules can provide many desired benefits such as: fabric strengthening, fabric wear resistance and/or reduction, wrinkle removal and/or reduction, fabric pilling prevention and/or reduction, fabric color maintenance and/or fading reduction, color restoration, fabric soiling reduction, fabric shape retention, fabric shrinkage reduction, and/or improving fabric feel/smoothness, scratchiness reduction, for different types of fabrics such as cellulosic (cotton, rayon, etc.), wool, silk, and the like.

Polysaccharides with helical conformation, but not within the range of the molecular weight range specified above have different physical properties such as low solubility and gelling characteristics (e.g., starch, a high molecular weight 1,4-α-D-glucan).

The fabric care polysaccharides with globular structure of the present invention can provide at least some fabric care benefits to all types of fabrics, including fabrics made of natural fibers, synthetic fibers, and mixtures thereof. Non-limiting examples of fabric types that can be treated with the fabric care compositions of the present invention, to obtain fabric care benefits include fabrics made of (1) cellulosic fibers such as cotton, rayon, linen, Tencel, (2) proteinaceous fibers such as silk, wool and related mammalian fibers, (3) synthetic fibers such as polyester, acrylic, nylon, and the like, (4) long vegetable fibers from jute, flax, ramie, coir, kapok, sisal, henequen, abaca, hemp and sunn, and (5) mixtures thereof. Other unanimated substrates and/or surfaces made with natural fibers and/or synthetic fibers, and/or materials, such as non-woven fabrics, paddings, carpets, paper, disposable products, films, foams, can also be treated with the fabric care polysaccharides with 1,3-β-linked backbone to improve their properties.

For specific applications, the composition can contain from about 0.001% to about 20% of fabric care polysaccharide with globular structure, preferably from about 0.01% to about 10%, more preferably from about 0.1% to about 5%, by weight of the usage composition. The present invention also relates to concentrated liquid or solid compositions, which are diluted to form compositions with the usage concentrations, for use in the "usage conditions". Concentrated compositions comprise a higher level of fabric care polysaccharide, typically from about 1% to about 99%, preferably from about 2% to about 65%, more preferably from about 3% to about 40%, by weight of the concentrated fabric care composition. Depending on the target fabric care benefit to be provided, the concentrated compositions should also comprise proportionally higher levels of the desired optional ingredients.

Typical composition to be dispensed from a sprayer contains a level of fabric care polysaccharide with globular structure of from about 0.01% to about 5%, preferably from about 0.05% to about 2%, more preferably from about 0.1% to about 1%, by weight of the usage composition.

Dryer-added compositions typically contain a level of fabric care polysaccharide with globular structure of from about 0.01% to about 40% by weight of the dryer-added compositions.

(ii) Adjunct Fabric Care Oligosaccharides

An optional but preferred adjunct fabric care agent in the present invention is selected from the group consisting of oligosaccharides, especially mixtures of oligosaccharides, especially, isomaltooligosaccharides (IMO) (including mixtures), the individual components of said mixtures, substituted versions thereof, derivatised versions thereof, and mixtures thereof. The adjunct fabric care oligosaccharides help to provide fabric benefits such as wrinkle removal and/or reduction, anti-pilling, anti-wear, fabric color maintenance, and overall appearance benefits, especially to cellulosic fibers/fabrics, such as cotton, rayon, ramie, jute, flax, linen, polynosic-fibers, Lyocell (Tencel ®), polyester/cotton blends, other cotton blends, and the like, and mixtures thereof.

Suitable adjunct fabric care oligosaccharides that are useful in the present invention include oligosaccharides with a degree of polymerization (DP) of from about 1 to about 15, preferably from about 2 to about 10, and wherein each monomer is selected from the group consisting of reducing saccharide containing 5 and/or 6 carbon atoms, including isomaltose, isomaltotriose, isomaltotetraose, isomaltooligosaccharide, fructooligosaccharide, levooligosaccharides, galactooligosaccharide, xylooligosaccharide, gentiooligosaccharides, disaccharides, glucose, fructose, galactose, xylose, mannose, arabinose, rhamnose, maltose, sucrose, lactose, maltulose, ribose, lyxose, allose, altrose, gulose, idose, talose, trehalose, nigerose, kojibiose, lactulose, oligosaccharides, maltooligosaccharides, trisaccharides, tetrasaccharides, pentasaccharides, hexasaccharides, oligosaccharides from partial hydrolysates of natural polysaccharide sources, and the like, and mixtures thereof, preferably mixtures of isomaltooligosaccharides, especially mixtures including isomaltooligosaccharides, comprising from about 3 to about 7 units of glucose, respectively, and which are linked by 1,2-α, 1,3-α, 1,4-α- and 1,6-α-linkages, and mixtures of these linkages. Oligosaccharides containing β-linkages are also preferred. Preferred oligosaccharides are acyclic and have at least one linkage that is not an α-1,4-glycosidic bond. A preferred oligosaccharide is a mixture containing IMO: from 0 to about 20% by weight of glucose, from about 10 to about 65% of isomaltose, from about 1% to about 45% of each of isomaltotriose, isomaltetraose and isomaltopentaose, from 0 to about 3% of each of isomaltohexaose, isomaltoheptaose, isomaltooctaose and isomaltononaose, from about 0.2% to about 15% of each of isomaltohexaose and isomaltoheptaose, and from 0 to about 50% by weight of said mixture being isomaltooligosaccharides of 2 to 7 glucose units and from 0 to about 10% by weight of said mixture being isomaltooligosaccharides of about 7 to about 10 glucose units. Other nonlimiting examples of preferred acyclic oligosaccharides, with approximate content by weight percent, are:

| | |
|---|---|
| Isomaltooligosaccharide Mixture I | |
| Trisaccharides (maltotriose, panose, isomaltotriose) | 40–65% |
| Disaccharides (maltose, isomaltose) | 5–15% |
| Monosaccharide (glucose) | 0–20% |
| Higher branched sugars (4 < DP < 10) | 10–30% |
| Isomaltooligosaccharide Mixture II | |
| Trisaccharides (maltotriose, panose, isomaltotriose) | 10–25% |
| Disaccharides (maltose, isomaltose) | 10–55% |
| Monosaccharide (glucose) | 10–20% |
| Higher branched sugars (4 < DP < 10) | 5–10% |
| Isomaltooligosaccharide Mixture III | |
| Tetrasaccharides (stachyose) | 10–40% |
| Trisaccharides (raffinose) | 0–10% |
| Disaccharides (sucrose, trehalose) | 10–50% |
| Monosaccharide (glucose, fructose) | 0–10% |
| Other higher branched sugars (4 < DP < 10) | 0–5% |

Oligosaccharide mixtures are either prepared by enzymatic reactions or separated as natural products from plant materials. The enzymatic synthesis of oligosaccharides involves either adding monosaccharides, one at a time, to a di- or higher saccharide to produce branched oligosaccharides, or it can involve the degradation of polysaccharides followed by transfer of saccharides to branching positions. For instance, Oligosaccharide Mixtures I and II are prepared by enzymatic hydrolysis of starch to maltooligosaccharides, which are then converted to isomaltooligosaccharides by a transglucosidase reaction. Oligosaccharide Mixture III, for example, is a mixture of oligosaccharides isolated from soybean. Soybean oligosaccharides such as Mixture III, are of pure natural origin.

Cyclic oligosaccharides can also be useful in the fabric care composition of the present invention. Preferred cyclic oligosaccharides include α-cyclodextrin, Scyclodextrin, γ-cyclodextrin, their branched derivatives such as glucosyl-β-cyclodextrin, diglucosyl-α-cyclodextrin, maltosyl-α-cyclodextrin, glucosyl-β-cyclodextrin, diglucosyl-β-cyclodextrin, and mixtures thereof. The cyclodextrins also provide an optional but very important benefit of odor control, and are disclosed more fully hereinbelow.

Substituted and/or derivatised materials of the oligosaccharides listed hereinabove are also preferred in the present invention. Nonlimiting examples of these materials include: carboxyl and hydroxymethyl substitutions (e.g., glucuronic acid instead of glucose); amino oligosaccharides (amine substitution, e.g., glucosamine instead of glucose); cationic quaternized oligosaccharides; $C_1$–$C_6$ alkylated oligosaccharides; acetylated oligosaccharide ethers; oligosaccharides having amino acid residues attached (small fragments of glycoprotein); oligosaccharides containing silicone moieties. These substituted and/or derivatised oligosaccharides can provide additional benefits, such as: carboxyl and hydroxymethyl substitutions can introduce readily oxidizable materials on and in the fiber, thus reducing the probability of the fiber itself being oxidized by oxidants, such as bleaches; amine substitution can bind and/or condense with oxidatively damaged regions of the fiber to rejuvenate aged fabrics; acetylated sugar ethers can serve as bleach activators in subsequent processes where hydrogen peroxide is present; oligosaccharides having amino acid residues can improve delivery of fabric care benefits for fabrics containing proteinaceous fibers, e.g., wool and silk; and silicone-derivatised oligosaccharides can provide additional fabric softness and lubricity. $C_6$ alkyl oligosaccharide is disclosed (along with other higher, viz., $C_6$–$C_{30}$, alkyl polysaccharides) in U.S. Pat. No. 4,565,647, issued Jan. 21, 1986 to Llenado, for use as foaming agent in foaming compositions such as laundry detergents, personal and hair cleaning compositions, and fire fighting compositions. The $C_6$ alkyl oligosaccharide is a poor surfactant and not preferred for use as surfactant in the present invention, but preferably can be used to provide the fabric care benefits that are not known, appreciated and/or disclosed in U.S. Pat No. 4,565,647. U.S. Pat. No. 4,488,981, issued Dec. 18, 1984 discloses the use of some $C_1$–$C_6$ alkylated oligosaccharides (lower alkyl glycosides) in aqueous liquid detergents to reduce their viscosity and to prevent phase separation. $C_1$–$C_6$ alkylated oligosaccharides can be used to provide the fabric care benefits that are not known, appreciated and/or disclosed in U.S. Pat. No. 4,488,981. These patents are incorporated herein by reference.

It is believed that the fabric care oligosaccharide is adsorbed and binds with cellulosic fabrics to improve the properties of the fabrics. It is believed that the fabric care oligosaccharide is bound to the cellulosic fibers, diffuses in and fills the defect sites (the amorphous region) of the fiber, to provide the above dewrinkling, increased strength and improved appearance benefits. The extent of the amorphous, non-crystalline region varies with cellulosic fiber types, e.g., the relative crystallinity of cotton is about 70.% and for regenerated cellulose, such as, rayon it is about 30% , as reported by P. H. Hermans and A. Weidinger, "X-ray studies on the crystallinity of cellulose" in the *Journal of Polymer Science*, Vol IV, p135–144, 1949. It is believed that the amorphous regions are accessible for chemical and physical modifications, and that in the durable press treatment, the amorphous regions are filled with molecules that can crosslink cellulose polymers by covalent bonds, to deliver wrinkle-free benefits (cf. S. P. Rawland, in "Modified Cellulosics," R. M. Rowell and R. A. Young, Eds., Academic Press, New York, 1978, pp. 147–167, cited by G. C. Tesoro, in 'Crosslinking of cellulosics', Handbook of Fiber Science and Technology, Vol. II, p.6, edited by M. Lewin and S. B. Sello, published by Marcel Dekker, 1983. These publications are incorporated herein by reference.

For specific applications, the composition can contain from about 0.001% to about 20% of the optional, but preferred oligosaccharide, preferably from about 0.01% to about 10%, more preferably from about 0.1% to about 5%, by weight of the usage composition.

A typical composition to be dispensed from a sprayer contains a level of optional fabric care oligosaccharide of from about 0.01% to about 3%, preferably from about 0.05% to about 2%, more preferably from about 0.1% to about 1%, by weight of the usage composition.

Dryer-added compositions typically contain a level of optional fabric care oligosaccharide of from about 0.01% to about 40%, preferably from about 0.1% to about 20%, more preferably from about 1% to about 10%, by weight of the dryer-added compositions. Aqueous dryer-added compositions to be applied directly to the fabric, e.g., via a spraying mechanism, contain lower levels of fabric care polysaccharide, typically from about 0.01% to about 25%, preferably from about 0.1% to about 10%, more preferably from about 0.2% to about 5%, even more preferably from about 0.3% to about 3%, by weight of the compositions.

Both the primary fabric care polysaccharides and the adjunct fabric care oligosaccharides have a compact structure, but they have different sizes. The smaller oligosaccharides are believed to be able to diffuse and penetrate into small defective sites, such as the amorphous region of cotton fibers, while the larger polysaccharides can fill in larger openings and/or defective sites on the fabric fiber surface. Therefore depending on the fabric care benefit target, the primary fabric care polysaccharides and the adjunct fabric care polysaccharide can be used alone, or in mixtures. When the adjunct fabric care polysaccharide (e.g. oligosaccharides) are present, the weight ratio between said oligosaccharides and the fabric care polysaccharides is typically from about 1:99 to about 99:1, preferably from about 15:85 to about 85:15, and more preferably from about 30:70 to about 70:30.

(d) Lithium Salts

Lithium salts are disclosed as solubilizing aids, e.g., lithium bromide in the production of silk fibroin, (U.S. Pat. No. 4,233,212, issued Nov. 11, 1980 to Otoi et al.), and lithium thiocyanate,(U.S. Pat. No. 5,252,285, issued Oct. 12, 1993 to Robert L. Lock). U.S. Pat. No. 5,296,269, issued Mar. 22, 1994 to Yang et al. discloses a process to produce crease-resistant silk using lithium bromide and lithium chloride. U.S. Pat. No. 5,199,954, issued Apr. 6, 1993 to Schultz et al. discloses a hair dye composition containing lithium bromide. U.S. Pat. No. 5,609,859, issued Mar. 11, 1997 to D. R. Cowsar discloses methods for preparing hair relaxer creams containing a lithium salt. Lithium salts are disclosed as static control agents in a liquid softener composition in U.S. Pat. No. 4,069,159, issued Jan. 17, 1978 to Mason Hayek. All of these patents are incorporated herein by reference.

It is now found that aqueous compositions comprising lithium salts provide improved fabric wrinkle control. Non-limiting examples of lithium salts that are useful in the present invention are lithium bromide, lithium chloride, lithium lactate, lithium benzoate, lithium acetate, lithium sulfate, lithium tartrate, and/or lithium bitartrate, preferably lithium bromide and/or lithium lactate. Some water soluble salts such as , lithium benzoate are not preferred when the optional cyclodextrin is present because they can form complexes with cyclodextrin. Useful levels of lithium salts are from about 0.1% to about 10%, preferably from about 0.5% to about 7%, more preferably from about 1% to about 5%, by weight of the usage composition.

(e) Fiber Fabric Lubricant

The fabric care composition of the present invention can comprise optional fiber lubricants to impart a lubricating property, or increased gliding ability, to fibers in fabric, particularly clothing. Not to be bound by theory, it is believed that fiber lubricants facilitate the ovement of fibers with respect to one another (glide) to release the fibers from the wrinkle ondition in wet or damp fabrics. After the fabric is dried, the fiber lubricant, especially silicone, an provide lubricity to reduce the tendency of fabric to rewrinkle.

(i) Synthetic Solid Particles

Solid polymeric particles of average particle size smaller than about 10 microns, preferably smaller than 5 microns, more preferably smaller than about 1 micron, e.g., Velustrol® P-40 oxidized polyethylene emulsion available from Clariant, can be used as a lubricant, also Tospearl™ 105, 120, 130, 145, 240 polydimethyl siloxane polymers available from GE Silicones, since they can provide a "roller-bearing" action. When solid polymeric particles are present, they are present at an effective amount to provide lubrication of the fibers, typically from about 0.01% to about 5%, preferably from about 0.025% to about 3%, more preferably from about 0.05% to about 1.5% and even more preferably from about 0.10% to about 0.5%, by weight of the usage composition.

(ii) Quaternary Ammonium Compounds

Although many quaternary ammonium compounds with alkyl substituents are suitable for this composition, quaternary ammonium compounds that contain hydrocarbon groups, including substituted groups and groups that are part of, e.g., acyl groups, which are unsaturated or branched are particularly suited for this composition. In some cases, amine precursors of the quaternary ammonium compounds can themselves be useful in this composition.

Typical levels of incorporation of the quaternary ammonium compound (active) in the wrinkle composition are of from about 0.025% to about 10% by weight, preferably from about 0.05% to about 5%, more preferably from about 0.1% to about 3%, and even more preferably from about 0.2% to about 2%, by weight of the composition, and preferably is biodegradable as disclosed hereinafter.

Suitable quaternary ammonium compounds for use in the wrinkle composition have been previously disclosed in U. S. Pat. No. 5,759,990, issued Jun. 2, 1998 in the names of E. H. Wahl, H. B. Tordil, T. Trinh, E. R. Carr, R. O. Keys, and L. M. Meyer, for Concentrated Fabric Softening Composition with Good Freeze/Thaw Recovery and Highly Unsaturated Fabric Softener Compound Therefor, and in U.S. Pat. No. 5,747,443, issued May 5, 1998 in the names of Wahl, Trinh, Gosselink, Letton, and Sivik for Fabric Softening Compound/Composition, said patents being incorporated herein by reference. An indicator of the suitability of quaternary ammonium actives for use in the compositions of the present invention is the phase transition temperature. Preferably, the phase transition temperature of the quaternary ammonium active or mixture of actives, containing less than about 5% organic solvent or water, is less than about 70° C., preferably less than about 50° C., more preferably less than about 35° C., even more preferably less than about 20° C., and yet even more preferably less than about 10° C., or is amorphous and has no significant endothermic phase transition in the region from about −50° C. to about 100° C.

The phase transition temperature can be measured with a Mettler TA 3000 differential scanning calorimeter with Mettler TC 10A Processor.

Typical suitable quaternary ammonium compounds or amine precursors are defined hereinafter.

Preferred Diester Quaternary Ammonium Active Compound (DEQA)

(1) The first type of DEQA preferably comprises, as the principal active, [DEQA (1)] compounds of the formula:

$$\{R_{4-m}—N^+—[(CH_2)_n—Y—R^1]_m\}X^-$$

wherein each R substituent is either hydrogen, a short chain $C_1$–$C_6$, preferably $C_1$–$C_3$ alkyl or hydroxyalkyl group, e.g., methyl (most preferred), ethyl, propyl, hydroxyethyl, and the like, poly ($C_{2-3}$ alkoxy), preferably polyethoxy, group, benzyl, or mixtures thereof; each m is 2 or 3; each n is from 1 to about 4, preferably 2; each Y is —O—(O)C—, —C(O)—O—, —NR—C(O)—, or —C(O)—NR—; the sum of carbons in each $R^1$, plus one when Y is —O—(O)C— or —NR—C(O)—, is $C_{12}$–$C_{22}$, preferably $C_{14}$–$C_{20}$, with each $R^1$ being a hydrocarbyl, or substituted hydrocarbyl group, and $X^-$ can be any quaternary ammonium-compatible anion, preferably, chloride, bromide, methylsulfate, ethylsulfate, sulfate, and nitrate, more preferably chloride or methyl sulfate (As used herein, the "percent of quaternary ammonium active" containing a given $R^1$ group is based upon taking a percentage of the total active based upon the percentage that the given $R^1$ group is, of the total $R^1$ groups present.);

(2) A second type of DEQA active [DEQA (2)] has the formula:

$$[R_3N^+CH_2CH(YR^1)(CH_2YR^1)]X^-$$

wherein each Y, R, $R^1$, and $X^-$ have the same meanings as before. Such compounds include those having the formula:

$$[CH_3]_3N^{(+)}[CH_2CH(CH_2O(O)CR^1)O(O)CR^1]Cl^{(-)}$$

wherein each R is a methyl or ethyl group and preferably each $R^1$ is in the range of $C_{15}$ to $C_{19}$. As used herein, when the diester is specified, it can include the monoester that is present. The amount of monoester that can be present is the same as in DEQA (1). These types of agents and general methods of making them are disclosed in U.S. Pat. No. 4,137,180, Naik et al., issued Jan. 30, 1979, which is incorporated herein by reference. An example of preferred DEQA (2) is the "propyl" ester quaternary ammonium active having the formula 1,2-di(acyloxy)-3-trimethylammoniopropane chloride, where the acyl is the same as that of $FA^1$ disclosed hereinafter.

Some preferred wrinkle compositions of the present invention contain as an essential component from about 0.025% to about 10%, preferably from about 0.05% to about 5%, more preferably from about 0.1% to about 3%, and even more preferably from about 0.2% to about 2% by weight of the composition, of quaternary ammonium active having the formula:

$$[R^1C(O)OC_2H_4]_mN^+(R)_{4-m}X^-$$

wherein each $R^1$ in a compound is a $C_6$–$C_{22}$ hydrocarbyl group, typically having an IV from about 10 to about 140, but preferrably from 70 to about 140 based upon the IV of the equivalent fatty acid with the cis/trans ratio preferably being as described hereinafter, m is a number from 1 to 3 on the weight average in any mixture of compounds, each R in a compound is a $C_{1-3}$ alkyl or hydroxy alkyl group, the total of m and the number of R groups that are hydroxyethyl groups equaling 3, and X is a quaternary ammonium compatible anion, preferably methyl sulfate. Preferably the cis-:trans isomer ratio of the fatty acid (of the $C_{18:1}$ component) is at least about 1:1, preferably about 2:1, more preferably about 3:1, and even more preferably about 4:1, or higher.

These preferred compounds, or mixtures of compounds, have (a) either a Hunter "L" transmission of at least about 85, typically from about 85 to about 95, preferably from about 90 to about 95, more preferably above about 95, if possible, (b) only low, relatively non-detectable levels, at the conditions of use, of odorous compounds selected from the group consisting of: isopropyl acetate; 2,2'-ethylidenebis (oxy)bis-propane; 1,3,5-trioxane; and/or short chain fatty acid (4–12, especially 6–10, carbon atoms) esters, especially methyl esters; or (c) preferably, both.

The Hunter L transmission is measured by (1) mixing the quaternary ammonium active with solvent at a level of about 10% of active, to assure clarity, the preferred solvent being ethoxylated (one mole EO) 2,2,4-trimethyl-1,3-pentanediol and (2) measuring the L color value against distilled water with a Hunter ColorQUEST$^0$ colorimeter made by Hunter Associates Laboratory, Reston, Virginia.

The level of odorant is defined by measuring the level of odorant in a headspace over a sample of the quaternary ammonium active (about 92% active). Chromatograms are generated using about 200 mL of head space sample over about 2.0 grams of sample. The head space sample is trapped on to a solid absorbent and thermally desorbed onto a column directly via cryofocussing at about −100° C. The identifications of materials is based on the peaks in the chromatograms. Some impurities identified are related to the solvent used in the quaternization process, (e.g., ethanol and isopropanol). The ethoxy and methoxy ethers are typically sweet in odor. There are $C_6$–$C_8$ methyl esters found in a typical current commercial sample, but not in the typical quaternary ammonium actives of this invention. These esters contribute to the perceived poorer odor of the current commercial samples. The level of each odorant in ng/L found in the head space over a preferred active is as follows: Isopropyl acetate—<1; 1,3,5-trioxane—<5; 2,2'-ethylidenebis(oxy)-bispropane—<1; $C_6$ methyl ester—<1; C. Methyl ester—<1; and $C_{10}$ Methyl ester—<1.

The acceptable level of each odorant is as follows: isopropyl acetate should be less than about 5, preferably less than about 3, and more preferably less than about 2, nanograms per liter (ηg/L.); 2,2'-ethylidenebis(oxy)bis-propane should be less than about 200, preferably less than about 100, more preferably less than about 10, and even more preferably less than about 5, nanograms per liter (ηg/L.); 1,3,5-trioxane should be less than about 50, preferably less than about 20, more preferably less than about 10, and even more preferably less than about 7, nanograms per liter (ηg/L.); and/or each short chain fatty acid (4–12, especially 6–10, carbon atoms) ester, especially methyl esters should be less than about 4, preferably less than about 3, and more preferably less than about 2, nanograms per liter (ηg/L.).

The elimination of color and odor materials can either be accomplished after formation of the compound, or, preferably, by selection of the reactants and the reaction conditions. Preferably, the reactants are selected to have good odor and color. For example, it is possible to obtain fatty acids, or their esters, for sources of the long fatty acyl group, that have good color and odor and which have extremely low levels of short chain ($C_{4-12}$, especially $C_{6-10}$) fatty acyl groups. Also, the reactants can be cleaned up prior to use. For example, the fatty acid reactant can be double or triple distilled to remove color and odor causing bodies and remove short chain fatty acids. Additionally, the color of a triethanolamine reactant, if used, needs to be controlled to a low color level (e.g., a color reading of about 20 or less on the APHA scale). The degree of clean up required is dependent on the level of use, clarity of the product, and the presence of other ingredients. For example, adding a dye or starting with an opaque product can cover up some colors. However, for clear and/or light colored products, the color must be almost non-detectable. This is especially true as the level of the quaternary ammonium compound used in the product goes up. The degree of clean up would be especially important in products sold as concentrates that are intended for dilution by the consumer. Similarly, the odor can be covered up by higher levels of perfume, but as perfume level increases, cost associated with this approach increases too, also many consumers prefer a product with a lighter scent which precludes the approach of using higher perfume levels. Odor quality can be further improved by use of, e.g., ethanol as the quaternization reaction solvent.

Preferred biodegradable quaternary ammonium compounds comprise quaternary ammonium salt, the quaternary ammonium salt being a quaternized product of the condensation reaction between: a)-a fraction of saturated or unsaturated, linear or branched fatty acids, or of derivatives of said acids, said fatty acids or derivatives each possessing a hydrocarbon chain in which the number of atoms is between 5 and 21, and b)-triethanolamine, characterized in that said condensation product has an acid value, measured by titration of the condensation product with a standard KOH solution against a phenolphthalein indicator, of less than about 6.5.

The acid value is preferably less than or equal to about 5, more preferably less than about 3.

The acid value is determined by titration of the condensation product with a standard KOH solution against a phenolphthalein indicator according to ISO#53402. The Acid Value (AV) is expressed as mg KOHI/g of the condensation product.

These quaternary ammonium compounds for use herein are typically mixtures of materials. The weight percentages of compounds wherein one (monoester), two (diester), or three (triester) of the triethanolamine hydroxy groups is esterified with a fatty acyl group are as follows: Monoester—from about 12% to about 22%; diester—from about 43% to about 57%; and triester—from about 13% to about 28%. These compounds, as formed and used in the formulation of wrinkle compositions, typically contain from about 6% to about 20% by weight of solvent, e.g., from about 3% to about 10% of a lower molecular alcohol like ethanol and from about 3% to about 10% of solvent that is more hydrophobic, like hexylene glycol.

Quaternary compounds for use herein can also be mixtures generated by starting with diethanolamine as a starting material. In this case, typical mixtures generated include compounds wherein one (monoester) and two (diester) of the diethanolamine hydroxy groups are esterified with a fatty acyl group as follows: Monoester—from about 5% to about 15%; and diester from about 85% to about 95%. These compounds as formed and used in the formulation of wrinkle compositions, typically contain from about 6% to about 20% by weight of solvent, e.g., from about 3% to about 20% of lower molecular alcohol like ethanol and/or isopropanol and from about 3% to about 20% of solvent that is more hydrophobic, like hexylene glycol.

Preferred cationic, preferably biodegradable, quaternary, ammonium compounds can contain the group —(O)CR$^1$ which is derived from animal fats, unsaturated, and polyunsaturated, fatty acids, e.g., oleic acid, and/or partially hydrogenated fatty acids, derived from vegetable oils and/or partially hydrogenated vegetable oils, such as, canola oil, safflower oil, peanut oil, sunflower oil, corn oil, soybean oil, tall oil, rice bran oil, etc. Non-limiting examples of fatty acids (FA) are listed in U.S. Pat. No. 5,759,990 at column 4, lines 45–66.

Mixtures of fatty acids, and mixtures of FAs that are derived from different fatty acids can be used, and are preferred. Nonlimiting examples of FA's that can be blended, to form FA's of this invention are as follows:

| Fatty Acyl Group | FA$^1$ | FA$^2$ | FA$^3$ |
|---|---|---|---|
| $C_{14}$ | 0 | 0 | 1 |
| $C_{16}$ | 3 | 11 | 25 |
| $C_{18}$ | 3 | 4 | 20 |
| C14:1 | 0 | 0 | 0 |
| C16:1 | 1 | 0 | 0 |
| C18:1 | 79 | 27 | 45 |
| C18:2 | 13 | 50 | 6 |
| C18:3 | 1 | 7 | 0 |
| Unknowns | 0 | 0 | 3 |
| Total | 100 | 100 | 100 |
| IV | 99 | 125–138 | 56 |
| cis/trans (C18:1) | 5–6 | Not Available | 7 |
| TPU | 14 | 57 | 6 |

FA$^1$ is a partially hydrogenated fatty acid prepared from canola oil,
FA$^2$ is a fatty acid prepared from soy bean oil, and
FA$^3$ is a slightly hydrogenated tallow fatty acid.

FA$^1$ is a partially hydrogenated fatty acid prepared from canola oil, FA$^2$ is a fatty acid prepared from soy bean oil, and FA$^3$ is a slightly hydrogenated tallow fatty acid.

Preferred quaternary ammonium actives contain an effective amount of molecules containing two ester linked hydrophobic groups [R$^1$C(CO)O—], said actives being referred to herein as "DEQA's", are those that are prepared as a single DEQA from blends of all the different fatty acids that are represented (total fatty acid blend), rather than from blends of mixtures of separate finished DEQA's that are prepared from different portions of the total fatty acid blend.

It is preferred that at least a majority of the fatty acyl groups are unsaturated, e.g., from about 50% to 100%, preferably from about 55% to about 99%, more preferably from about 60% to about 98%, and that the total level of active containing polyunsaturated fatty acyl groups (TPU) be preferably from 0% to about 30%. The cis/trans ratio for the unsaturated fatty acyl groups is usually important, with the cis/trans ratio being from about 1:1 to about 50:1, the minimum being about 1:1, preferably at least about 3:1, and more preferably from about 4:1 to about 20:1. (As used herein, the "percent of quaternary ammonium active" containing a given R$^1$ group is the same as the percentage of that same R$^1$ group is to the total R$^1$ groups used to form all of the quaternary ammonium actives.). Less preferred, but still suitable quaternary ammonium actives can have as little as 10% unsaturation or even essentially no unsaturation.

The preferred unsaturated, including the preferred polyunsaturated, fatty acyl and/or alkylene groups, discussed hereinbefore and hereinafter, surprisingly provide good dewrinkling and effective softening.

Highly unsaturated actives are also easier to process at lower temperatures. These highly unsaturated materials (total level of active containing polyunsaturated fatty acyl groups (TPU) being typically from about 3% to about 30%, with only the low amount of solvent that normally is associated with such materials, i.e., from about 5% to about 20%, preferably from about 8% to about 25%, more preferably from about 10 to about 20%, weight of the total quaternary ammonium/solvent mixture are easier to formulate into the product and remain in stable solutions, emulsions, and or dispersions longer. This ability to process the actives at low temperatures is especially important for the polyunsaturated groups, since it minimizes degradation. Additional protection against degradation can be provided when the compounds and wrinkle compositions contain effective antioxidants, chelants, and/or reducing agents, as disclosed hereinafter.

It will be understood that substituents R and $R^1$ can optionally be substituted with various groups such as alkoxy or hydroxyl groups, and can be straight, or branched so long as the $R^1$ groups maintain their basically hydrophobic character.

A preferred long chain DEQA is the DEQA prepared from sources containing high levels of polyunsaturation, i.e., N,N-di(acyl-oxyethyl)-N,N-methylhydroxyethylammonium methyl sulfate, where the acyl is derived from fatty acids containing sufficient polyunsaturation, e.g., mixtures of tallow fatty acids and soybean fatty acids. Another preferred long chain DEQA is the dioleyl (nominally) DEQA, i.e., DEQA in which N,N-di(oleoyl-oxyethyl)-N,N-methylhydroxyethylammonium methyl sulfate is the major ingredient. Preferred sources of fatty acids for such DEQAs are vegetable oils, and/or partially hydrogenated vegetable oils, with high contents of unsaturated, e.g., oleoyl groups.

As used herein, when the DEQA diester (m=2) is specified, it can include the monoester (m=1) and/or triester (m=3) that are present. Preferably, at least about 30% of the DEQA is in the diester form, and from 0% to about 30% can be DEQA monoester, e.g., there are three R groups and one $R^1$ group.

The above compounds can be prepared using standard reaction chemistry. In one synthesis of a di-ester variation of DTDMAC, triethanolamine of the formula $N(CH_2CH_2OH)_3$ is esterified, preferably at an average of about two hydroxyl groups, with an acid chloride of the formula $R^1C(O)Cl$, to form an amine which can be made cationic by acidification (one R is H) to be one type of active, or then quaternized with an alkyl halide, RX, to yield the desired reaction product (wherein R and $R^1$ are as defined hereinbefore). However, it will be appreciated by those skilled in the chemical arts that this reaction sequence allows a broad selection of agents to be prepared.

In preferred DEQA (1) and DEQA (2) quaternary ammonium actives, each $R^1$ is a hydrocarbyl, or substituted hydrocarbyl, group, preferably, alkyl, monounsaturated alkenyl, and polyunsaturated alkenyl groups, with the quaternary ammonium active containing polyunsaturated alkenyl groups being preferably at least about 3%, more preferably at least about 5%, more preferably at least about 10%, and even more preferably at least about 15%, by weight of the total quaternary ammonium active present; the actives preferably containing mixtures of $R^1$ groups, especially within the individual molecules.

The DEQAs herein can also contain a low level of fatty acid, which can be from unreacted starting material used to form the DEQA and/or as a by-product of any partial degradation (hydrolysis) of the quaternary ammonium active in the finished composition. It is preferred that the level of free fatty acid be low, preferably below about 15%, more preferably below about 10%, and even more preferably below about 5%, by weight of the quaternary ammonium active.

The quaternary ammonium actives herein are preferably prepared by a process wherein a chelant, preferably a diethylenetriaminepentaacetate (DTPA) and/or an ethylene diamine-N,N'-disuccinate (EDDS) is added to the process. Another acceptable chelant is tetrakis-(2-hydroxylpropyl) ethylenediamine (TPED). Also, preferably, antioxidants are added to the fatty acid immediately after distillation and/or fractionation and/or during the esterification reactions and/or post-added to the finished quaternary ammonium active. The resulting active has reduced discoloration and malodor associated therewith.

The total amount of added chelating agent is preferably within the range of from about 10 ppm to about 5,000 ppm, more preferably within the range of from about 100 ppm to about 2500 ppm by weight of the formed quaternary ammonium active. The source of triglyceride is preferably selected from the group consisting of animal fats, vegetable oils, partially hydrogenated vegetable oils, and mixtures thereof. More preferably, the vegetable oil or partially hydrogenated vegetable oil is selected from the group consisting of canola oil, partially hydrogenated canola oil, safflower oil, partially hydrogenated safflower oil, peanut oil, partially hydrogenated peanut oil, sunflower oil, partially hydrogenated sunflower oil, corn oil, partially hydrogenated corn oil, soybean oil, partially hydrogenated soybean oil, tall oil, partially hydrogenated tall oil, rice bran oil, partially hydrogenated rice bran oil, and mixtures thereof. Most preferably, the source of triglyceride is canola oil, partially hydrogenated canola oil, and mixtures thereof. The process can also include the step of adding from about 0.01% to about 2% by weight of the composition of an antioxidant compound to any or all of the steps in the processing of the triglyceride up to, and including, the formation of the quaternary ammonium active.

The above processes produce a quaternary ammonium active with reduced coloration and malodor.

Other Quaternary Ammonium Actives

Other less preferred quaternary ammonium actives include, but are not limited to, those disclosed hereinafter. When quaternary ammonium compounds are include in the wrinkle composition, these less preferred quaternary ammonium actives can be present in minor amounts, either alone, or as part of the total amount of quaternary ammonium in the said composition, said other fabric quaternary ammonium active being selected from:

(1) quaternary ammonium having the formula:

$$[R_{4-m}—N^{(+)}—R^1{}_m]A^-$$

wherein each m is 2 or 3, each $R^1$ is a $C_6$–$C_{22}$, preferably $C_{14}$–$C_{20}$, but no more than one being less than about $C_{12}$ and then the other is at least about 16, hydrocarbyl, or substituted hydrocarbyl substituent, preferably $C_{10}$–$C_{20}$ alkyl or alkenyl (unsaturated alkyl, including polyunsaturated alkyl, also referred to sometimes as "alkylene"), most preferably $C_{12}$–$C_{18}$ alkyl or alkenyl, and where the Iodine Value (hereinafter referred to as "IV") of a fatty acid containing this $R^1$ group is from about 70 to about 140, more preferably from about 80 to about 130; and most preferably from about 90 to about 115 (as used herein, the term "Iodine Value" means the Iodine Value of a "parent" fatty acid, or "corresponding" fatty acid, which is used to define a level of unsaturation for an $R^1$ group that is the same as the level of unsaturation that would be present in a fatty acid containing the same $R^1$ group) with, preferably, a cis/trans ratio of from about 1:1 to about 50:1, the minimum being 1:1, preferably from about 2:1 to about 40:1, more preferably from about 3:1 to about 30:1, and even more preferably from about 4:1 to about 20:1; less preferred, but still suitable for these wrinkle compositions are quaternary ammonium compounds with an IV as low as 10; each $R^1$ can also preferably be a branched chain $C_{14}$–$C_{22}$ alkyl group, preferably a branched chain $C_{16}$—$C_{18}$ group; each R is H or a short chain $C_1$–$C_6$, preferably $C_1$–$C_3$ alkyl or hydroxyalkyl group, e.g., methyl (most preferred), ethyl, propyl, hydroxyethyl, and the like, benzyl, or $(R^2O)_{2-4}H$ where each $R^2$ is a $C_{1-6}$ alkylene group; and $A^-$ is a quaternary ammonium compatible anion, preferably, chloride, bromide, methylsulfate, ethylsulfate, sulfate, and nitrate, more preferably chloride and methyl sulfate;

(2) quaternary ammonium having the formula:

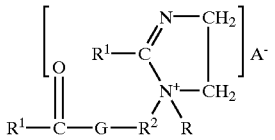

wherein each R, $R^1$, and $A^-$ have the definitions given above; each $R^2$ is a $C_{1-6}$ alkylene group, preferably an ethylene group; and G is an oxygen atom or an —NR— group;

(3) active having the formula:

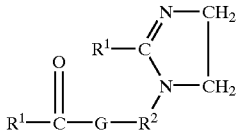

wherein $R^1$, $R^2$ and G are defined as above;

(4) reaction products of substantially unsaturated and/or branched chain higher fatty acids with dialkylenetriamines in, e.g., a molecular ratio of about 2:1, said reaction products containing compounds of the formula:

$$R^1—(O)—NH—R^2—NH—R_3—NH—C(O)—R^1$$

wherein $R^1$, $R^2$ are defined as above, and each $R^3$ is a $C_{1-6}$ alkylene group, preferably an ethylene group;

(5) quaternary ammonium having the formula:

$$[R^1—C(O)—NR—R^2—N(R)_2—R^3—NR—C(O)—R^1]^+A^-$$

wherein R, $R^1$, $R^2$, $R^3$ and $A^-$ are defined as above;

(6) the reaction product of substantially unsaturated and/or branched chain higher fatty acid with hydroxyalkylalkylenediamines in a molecular ratio of about 2:1, said reaction products containing compounds of the formula:

$$R_1—C(O)—NH—R^2—N(R^3OH)—C(O)—R^1$$

wherein $R^1$, $R^2$ and $R^3$ are defined as above;

(7) quaternary ammonium having the formula:

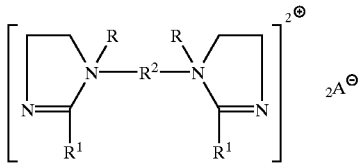

wherein R, $R^1$, $R^2$, and $A^-$ are defined as above; and (8) mixtures thereof.

Other optional but highly desirable cationic compounds which can be used in combination with the above quaternary ammonium actives are compounds containing one long chain acyclic $C_8$–$C_{22}$ hydrocarbon group, selected from the group consisting of:

(8) acyclic quaternary ammonium salts having the formnula:

$$[R^1—N(R^5)_2—R^6]^+A^-$$

wherein $R^5$ and $R^6$ are $C_1$–$C_4$ alkyl or hydroxyalkyl groups, and $R^1$ and $A^-$ are defined as herein above;

(9) substituted imidazolinium salts having the formula:

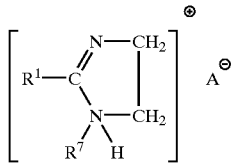

wherein $R^7$ is hydrogen or a $C_1$–$C_4$ saturated alkyl or hydroxyalkyl group, and $R^1$ and $A^-$ are defined as hereinabove;

(10) substituted imidazolinium salts having the formula:

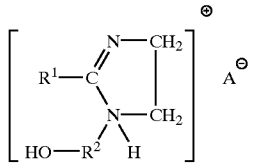

wherein $R^5$ is a $C_1$–$C_4$ alkyl or hydroxyalkyl group, and $R^1$, $R^2$, and $A^-$ are as defined above;

(11) alkylpyridinium salts having the formula:

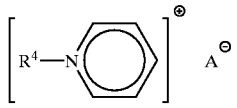

wherein $R^4$ is an acyclic aliphatic $C_8$–$C_{22}$ hydrocarbon group and $A^-$ is an anion; and

(12) alkanamide alkylene pyridinium salts having the formula:

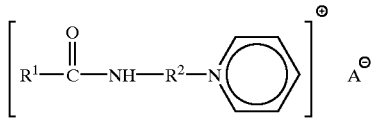

wherein $R^1$, $R^2$ and $A^-$ are defined as herein above; and mixtures thereof.

Examples of Compound (8) are the monoalkenyltrimethylammonium salts such as monooleyltrimethylammonium chloride, monocanolatrimethylammonium chloride, and soyatrimethylammonium chloride. Monooleyltrimethylammonium chloride and monocanolatrimethylammonium chloride are preferred. Other examples of Compound (8) are soyatrimethylammonium chloride available from Witco Corporation under the trade name Adogen® 415, erucyltrimethylammonium chloride wherein $R_1$ is a $C_{22}$ hydrocarbon group derived from a natural source; soyadimethylethylammonium ethylsulfate wherein $R^1$ is a $C_{16}$–$C_{18}$ hydrocarbon group, $R^5$ is a methyl group, $R^6$ is an ethyl group, and $A^-$ is an ethylsulfate anion; and methyl bis(2-hydroxyethyl)

oleylammonium chloride wherein $R^1$ is a $C_{18}$ hydrocarbon group, $R^5$ is a 2-hydroxyethyl group and $R^6$ is a methyl group.

Additional actives that can be used herein are disclosed, at least generically for the basic structures, in U.S. Pat. No. 3,861,870, Edwards and Diehl; U.S. Pat. No. 4,308,151, Cambre; U.S. Pat. No. 3,886,075, Bernardino; U.S. Pat. No. 4,233,164, Davis; U.S. Pat. No. 4,401,578, Verbruggen; U.S. Pat. No. 3,974,076, Wiersema and Rieke; and U.S. Pat. No. 4,237,016, Rudkin, Clint, and Young, all of said patents being incorporated herein by reference. The additional actives herein are preferably those that are highly unsaturated versions of the traditional quaternary ammonium actives, i.e., di-long chain alkyl nitrogen derivatives, normally cationic materials, such as dioleyldimethylammonium chloride and imidazolinium compounds as described hereinafter. Examples of more biodegradable fabric quaternary ammonium actives can be found in U.S. Pat. No. 3,408,361, Mannheimer, issued Oct. 29, 1968; U.S. Pat. No. 4,709,045, Kubo et al., issued Nov. 24, 1987; U.S. Pat. No. 4,233,451, Pracht et al., issued Nov. 11, 1980; U.S. Pat. No. 4,127,489, Pracht et al., issued Nov. 28, 1979; U.S. Pat. No. 3,689,424, Berg et al., issued Sep. 5, 1972; U.S. Pat. No. 4,128,485, Baumann et al., issued Dec. 5, 1978; U.S. Pat. No. 4,161,604, Elster et al., issued Jul. 17, 1979; 4,189,593, Wechsler et al., issued Feb. 19, 1980; and U.S. Pat. No. 4,339,391, Hoffman et al., issued Jul. 13, 1982, said patents being incorporated herein by reference.

Examples of Compound (1) are dialkylenedimethylammonium salts such as dicanoladimethylammonium chloride, dicanoladimethylammonium methylsulfate, di(partially hydrogenated soybean, cis/trans ratio of about 4:1) dimethylammonium chloride, dioleyldimethylammonium chloride. Dioleyldimethylammonium chloride and di(canola)dimethylammonium chloride are preferred. An example of commercially available dialkylenedimethylammonium salts usable in the present invention is dioleyldimethylammonium chloride available from Witco Corporation under the trade name Adogen® 472.

An example of Compound (2) is 1-methyl-1-oleylamidoethyl-2-oleylimidazolinium methylsulfate wherein $R_1$ is an acyclic aliphatic $C_{15}$–$C_{17}$ hydrocarbon group, $R^2$ is an ethylene group, G is a NH group, $R^5$ is a methyl group and $A^-$ is a methyl sulfate anion, available commercially from the Witco Corporation under the trade name Varisoft® 3690.

An example of Compound (3) is 1-oleylamidoethyl-2-oleylimidazoline wherein $R^1$ is an acyclic aliphatic $C_{15}$–$C_{17}$ hydrocarbon group, $R^2$ is an ethylene group, and G is a NH group.

An example of Compound (4) is reaction products of oleic acids with diethylenetriamine in a molecular ratio of about 2:1, said reaction product mixture containing N,N"-dioleoyldiethylenetriamine with the formula:

$$R^1—C(O)—NH—CH_2CH_2—NH—CH_2CH_2—NH—C(O)—R^1$$

wherein $R^1$—C(O) is oleoyl group of a commercially available oleic acid derived from a vegetable or animal source, such as Emersol® 223LL or Emersol® 7021, available from Henkel Corporation, and $R^2$ and $R^3$ are divalent ethylene groups.

An example of Compound (5) is a difatty amidoamine based active having the formula:

$$[R^1—C(O)—NH—CH_2CH_2—N(CH_3)(CH_2CH_2OH)—CH_2CH_2—NH—C(O)—R^1]^+CH_3SO_4^-$$

wherein $R^1$—C(O) is oleoyl group, available commercially from the Witco Corporation under the trade name Varisoft® 222LT.

An example of Compound (6) is reaction products of commercial "oleic" acids with N-2-hydroxyethylethylenediamine in a molecular ratio of about 2:1, said reaction product mixture containing a compound of the formula:

$$R^1—C(O)—NH—CH_2CH_2—N(CH_2CH_2OH)—C(O)—R^1$$

wherein $R^1$—C(O) is oleoyl group of a commercially available oleic acid derived from a vegetable or animal source, such as Emersol® 223LL or Emersol® 7021, available from Henkel Corporation.

An example of Compound (7) is the diquaternary compound having the formula:

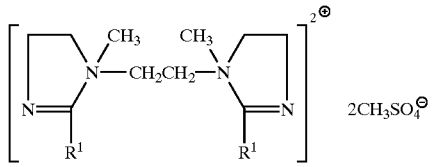

wherein $R^1$ is derived from oleic acid, and the compound is available from Witco Company.

An example of Compound (11) is 1-ethyl-1-(2-hydroxyethyl)-2-isoheptadecylimidazolinium ethylsulfate wherein $R^1$ is a $C_{17}$ hydrocarbon group, $R^2$ is an ethylene group, $R^5$ is an ethyl group, and $A^-$ is an ethylsulfate anion.

Other materials containing at least one long hydrocarbon group and one, or more, quaternary ammonium moieties can also be used. E.g., diquaternary, and polyquaternary ammonium compounds with the quaternary groups being linked by, e.g., alkylene, ester, ether, etc. groups.

It will be understood that suitable wrinkle compositions can include combinations of quaternary ammonium actives disclosed herein.

Anion A

In the cationic nitrogenous salts herein, the anion $A^-$, which is any quaternary ammonium compatible anion, provides electrical neutrality. Most often, the anion used to provide electrical neutrality in these salts is from a strong acid, especially a halide, such as chloride, bromide, or iodide. However, other anions can be used, such as methylsulfate, ethylsulfate, acetate, formate, sulfate, carbonate, and the like. Chloride and methylsulfate are preferred herein as anion A. The anion can also, but less preferably, carry a double charge in which case $A^-$ represents half a group.

In addition to lubricating fibers, quaternary ammonium compound disclosed herein can offer addition benefits including improved softening and handfeel as well as protection and/or restoration of fibers and fabric appearance.

Polyquaternary amine compounds also act as suitable quaternary compounds to increase fabric (fiber) lubricity and these are diclosed for use herein by reference to prior art including: European Patent Application EP 0,803,498, A1, Robert 0. Keys and Floyd E. Friedli, filed Apr. 25, 1997;

British Pat. 808,265, issued Jan. 28, 1956 to Arnold Hoffman & Co., Incorporated;

British Pat. 1,161,552, Koebner and Potts, issued Aug. 13, 1969;

DE 4,203,489 A1, Henkel, published Aug. 12, 1993;

EP 0,221,855, Topfl, Heinz, and Jorg, issued Nov. 3, 1986;

EP 0,503,155, Rewo, issued Dec. 20, 1991;

EP 0,507,003, Rewo, issued Dec. 20, 1991

EPA 0,803,498, published Oct. 29, 1997;

French Pat. 2,523,606, Marie-Helene Fraikin, Alan Dillarstone, and Marc Couterau, filed Mar. 22, 1983;

Japanese Pat. 84-273918, Terumi Kawai and Hiroshi Kitamura, 1986;

Japanese Pat. 2-011,545, issued to Kao Corp., Jan. 16, 1990;

U.S. Pat. No. 3,079,436, Hwa, issued Feb. 26, 1963;

U.S. Pat. No. 4,418,054, Green et al., issued Nov. 29, 1983;

U.S. Pat. No. 4,721,512, Topfl, Abel, and Binz, issued Jan. 26, 1988;

U.S. Pat. No. 4,728,337, Abel, Topfl, and Riehen, issued Mar. 1, 1988;

U.S. Pat. No. 4,906,413, Topfl and Binz, issued Mar. 6, 1990;

U.S. Pat. No. 5,194,667, Oxenrider et al., issued Mar. 16, 1993;

U.S. Pat. No. 5,235,082, Hill and Snow, issued Aug. 10, 1993;

U.S. Pat. No. 5,670,472, Keys, issued Sep. 23, 1997;

Weirong Miao, Wei Hou, Lie Chen, and Zongshi Li, Studies on Multifunctional Finishing Agents, Riyong Huaxue Gonye, No. 2, pp. 8–10, 1992;

Yokagaku, Vol 41, No. 4 (1992); and

Disinfection, Sterilization, and Preservation, 4th Edition, published 1991 by Lea & Febiger, Chapter 13, pp. 226–30. All of these references are incorporated herein, in their entirety, by reference.

(f) Vegetable Oils and Derivatized Vegetable Oils

Vegetable oils, and derivatives of vegetable oils are found to be acceptable fiber-fabric lubricants. Preferrably, the vegetable oils will be emulsified by optional surfactants or self-emulsifying due to derivatization with ionic functionalities. Nonlimiting examples of vegetable oils derivatized with ionic head groups include sulfated canola oil and sulfated castor oil (Freedom SCO-75) available from the Freedom Chemical Co., Charlotte N.C. (owned by BF Goodrich). Other nonlimiting examples of derivatized vegetable oils are disclosed in international patents WO0024857 and WO0024853 issued on May 4, 2000 and assigned to Unilever.

(g) Mixtures Thereof

A variety of mixtures of fabric care saccharides, synthetic solid particles, fiber, fabric lubricants, quaternary ammonium compounds, vegetable oils and derivatives of vegetable oils, can be used as fabric lubricants in the present compositions.

(3) Surface Tension Control Agents

Surfactant is also useful in the present compositions to facilitate the dispersion, emulsification and/or solubilization of polymer and/or optional ingredients such as silicone and supplemental wrinkle control such as certain water insoluble silicone oils such as cyclomethicones. The surfactant can provide some plasticizing effect to polymers resulting in a more flexible polymer network. Surfactant can also provide a low surface tension that permits the composition to spread readily and more uniformly on hydrophobic surfaces like polyester and nylon. Surfactants also help the composition penetrate fibers more thoroughly to provide hydrogen bond breaking, lubricity and plasticity at every level of the fiber structure. Surfactants are also useful when the composition is used in a spray dispenser and/or a dispenser for use in a clothes dryer other fabric modifying machine in order to enhance the spray and/or dispensing characteristics of the composition and allow the composition to distribute more evenly, and to prevent clogging of the spray apparatus and/or dispenser apparatus. The spreading of the composition can also allow it to dry faster, so that the treated material is ready to use sooner. For concentrated compositions, the surfactant facilitates the dispersion of many actives such as antimicrobial actives and perfumes in the concentrated aqueous compositions.

Surfactants normally fall into several groups, nonionic, ionic and amphoteric. Another special class of surfactants are cyclodextrin compatible surfactants which are disclosed under the section titled 'Odor Control Agents'. It is preferred to use cyclodextrin compatible surfactants when cyclodextrin is incorporated in the formulation. Surfactants should be chosen based on their compatibility with other formulation components and their ability to enhance the stability, performance, dispensing qualities and other properties of the formulations. Preferred surfactants will not form complexes with other ingredients that either cause precipitation of ingredients or deactivate ingredients.

When surfactant is used, it is typically incorporated at a level of at least about 0.0001%, preferably at least about 0.001%, more preferably at least about 0.005%, even more preferably at least about 0.01%, still more preferably at least about 0.05% and most preferably at least about 0.1% and typically less than about 7% preferably less than about 5%, more preferably less than about 3%, even more preferably less than about 2.5%, still more preferably less than about 2%, and most preferably less than about 1%.

(a) Nonionic Surfactant

A preferred, but nonlimiting, type of nonionic surfactant is alkyl ethoxylated surfactant, such as addition products of ethylene oxide with fatty alcohols, fatty acids, fatty amines, etc. Optionally, addition products of mixtures of ethylene oxide and propylene oxide with fatty alcohols, fatty acids, fatty amines can be used. The ethoxylated surfactant includes compounds having the general formula:

$$R^8—Z—(CH_2CH_2O)_sB$$

wherein $R^8$ is an alkyl group or an alkyl aryl group, selected from the group consisting of primary, secondary and branched chain alkyl hydrocarbyl groups, primary, secondary and branched chain alkenyl hydrocarbyl groups, and/or primary, secondary and branched chain alkyl- and alkenyl-substituted phenolic hydrocarbyl groups having from about 6 to about 20 carbon atoms, preferably from about 8 to about 18, more preferably from about 10 to about 15 carbon atoms; s is an integer from about 2 to about 45, preferably from about 2 to about 20, more preferably from about 2 to about 15; B is hydrogen, a carboxylate group, or a sulfate group; and linking group Z is selected from the group consisting of: —O—, —$N(R)_x$—, —C(O)O—, —C(O)N(R)—, —C(O)N(R)—, and mixtures thereof, in which R, when present, is $R^8$, a lower alkyl with about 1 to about 4 carbons, a polyalkylene oxide, or hydrogen, and x is 1 or 2.

The nonionic alkyl ethoxylated surfactants herein are characterized by an HLB (hydrophilic-lipophilic balance) of from about 5 to about 20, preferably from about 6 to about 15.

Nonlimiting examples of preferred alkyl ethoxylated surfactants are:

- straight-chain, primary alcohol ethoxylates, with $R^8$ being $C_8$—$C_{18}$ alkyl and/or alkenyl group, more preferably $C_{10}$–$C_{14}$, and s being from about 2 to about 8, preferably from about 2 to about 6;
- straight-chain, secondary alcohol ethoxylates, with $R^8$ being $C_8$–$C_{18}$ alkyl and/or alkenyl, e.g., 3-hexadecyl, 2-octadecyl, 4-eicosanyl, and 5-eicosanyl, and s being from about 2 to about 10;
- alkyl phenol ethoxylates wherein the alkyl phenols having an alkyl or alkenyl group containing from about 3 to about 20 carbon atoms in a primary, secondary or branched chain configuration, preferably from about 6 to about 12 carbon atoms, and s is from about 2 to about 12, preferably from about 2 to about 8;

branched chain alcohol ethoxylates, wherein branched chain primary and secondary alcohols (or Guerbet alcohols) which are available, e.g., from the well-known "OXO" process, or modification thereof, are ethoxylated.

Especially preferred are alkyl ethoxylate surfactants with each $R^8$ being $C_8$–$C_{16}$ straight chain and/or branch chain alkyl and the number of ethyleneoxy groups s being from about 2 to about 6, preferably from about 2 to about 4, more preferably with $R^8$ being $C_8$–$C_{15}$ alkyl and s being from about 2.25 to about 3.5. These nonionic surfactants are characterized by an HLB of from 6 to about 11, preferably from about 6.5 to about 9.5, and more preferably from about 7 to about 9. Nonlimiting examples of commercially available preferred surfactants are Neodol 91–2.5 ($C_9$–$C_{10}$, s=2.7, HLB=8.5), Neodol 23–3 ($C_{12}$–$C_{13}$, s=2.9, HLB=7.9) and Neodol 25-3 ($C_{12}$–$C_{15}$, s=2.8, HLB=7.5). It is found, very surprisingly, that these preferred surfactants which are themselves not very water soluble (0.1% aqueous solutions of these surfactants are not clear), can at low levels, effectively solubilize and/or disperse polymers, and these surfactants emulsify and/or disperse silicone oils into clear compositions, even without the presence of a low molecular weight alcohol. Many nonlimiting examples of suitable nonionic surfactants are given in the table below.

Other useful nonionic alkyl alkoxylated surfactants are ethoxylated alkyl amines derived from the condensation of ethylene oxide with hydrophobic alkyl amines, with $R^8$ having from about 8 to about 22 carbon atoms and s being from about 3 to about 30.

Other examples of useful ethoxylated surfactant include carboxylated alcohol ethoxylate, also known as ether carboxylate, with $R^8$ having from about 12 to about 16 carbon atoms and s being from about 5 to about 13; ethoxylated alkyl amine or quaternary ammonium surfactants, $R^8$ having from about 8 to about 22 carbon atoms and s being from about 3 to about 30, such as PEG-5 cocomonium methosulfate, PEG-15 cocomonium chloride, PEG-15 oleammonium chloride and bis(polyethoxyethanol) tallow ammonium chloride.

Additional suitable nonionic surfactants include surfactants derived from carbohydrates such as sorbitan esters, especially sorbitan monoesters, also alkyl glucosides, and alkyl polyglucosides. A specific description of many surfactants which are derived from carbohydrates can be found in *Handbook of Surfactants*, M. R. Porter, 1991, Blackie & Son Ltd, pp. 142–145. Glucamines are additional examples of surfactants derived from carbohydrates and are included herein by reference to U.S. Pat. No. 5,194,639 issued March 16, 1993 to D. S. Connor, J. J. Scheibel, and R. G. Severson; U.S. Pat. No. 5,338,487 issued August 16, 1993 to D. S. Connor, J. J. Scheibel, and J.-N. Kao; U.S. Pat. No. 5,489,393 issued Feb. 6, 1996 to D. S. Connor, J. J. Scheibel, and Y. C. Fu; and U.S. Pat. No. 5,512,699 issued Apr. 30, 1996 to D. S. Connor, Y. C. Fu, and J. J. Scheibel. Preferred alkyl polyglucosides are those having aqueous surface tension below about 35 mN/m such as AG 6202 and AG6210 from Akzo Nobel Chemicals, Inc., Chicago, Ill.

Nonlimiting Examples of some suitable nonionic surfactants include those in the following table:

| Name | Structure | HLB Value | Suppliers |
|---|---|---|---|
| Neodol ® 91-2.5 | $C_9$–$C_{10}$-2.7EO | 8.5 | Shell Chemical Co. |
| Neodol ® 23-1 | $C_{12}$–$C_{13}$-1.0EO | 3.7 | Shell Chemical Co. |
| Neodol ® 23-2 | $C_{12}$–$C_{13}$-2.0EO | 5.9 | Shell Chemical Co. |
| Neodol ® 23-3 | $C_{12}$–$C_{13}$-2.9EO | 7.9 | Shell Chemical Co. |
| Neodol ® 25-3 | $C_{12}$–$C_{15}$-2.8EO | 7.5 | Shell Chemical Co. |
| Neodol ® 23-5 | $C_{12}$–$C_{13}$-5.0EO | 10.7 | Shell Chemical Co. |
| Neodol ® 25-9 | $C_{12}$–$C_{15}$-8.9EO | 13.1 | Shell Chemical Co. |
| Neodol ® 25-12 | $C_{12}$–$C_{15}$-11.9EO | 14.4 | Shell Chemical Co. |
| Hetoxol ® TD-3 | $C_{13}$-3EO | 7.9 | Heterene Inc. |
| Hetoxol ® OL-5 | Oleyl-5EO | 8.0 | Heterene Inc. |
| Kessco ® PEG-8 Mono-oleate | Oleoyl -8EO | 11.0 | Stepan Co. |
| Kessco ® Glycerol monooleate | Glyceryl mono-oleate | 3.8 | Stepan Co. |
| Arlacel ® 20 | Sorbitan mono-laurate | 8.6 | ICI Americas |

(b) Ionic Surfactant

Nonlimiting preferred ionic surfactants are the class of anionic surfactants. Anionic surfactants are preferred ionic surfactants since they are least likely to leave residues. Many suitable nonlimiting examples from the class of anionic surfactants can be found in *Surfactants and Interfacial Phenomena*, 2nd Ed., Milton J. Rosen, 1989, John Wiley & Sons, Inc., pp. 7–16, which is hereby incorporated by reference. Additional suitable nonlimiting examples of anionic surfactants can be found in *Handbook of Surfactants*, M. R. Porter, 1991, Blackie & Son Ltd, pp. 54–115 and references therein, the disclosure of which is incorporated herein by reference.

Structurally, suitable anionic surfactants contain at least one hydrophobic moiety and at least one hydrophilic moiety. The surfactant can contain multiple hydrophobic moieties and/or multiple hydrophilic moieties, but preferably less than or equal to about 2 hydrophobic moieties and less than or equal to about 3 hydrophilic moieties. The hydrophobic moiety is typically comprised of hydrocarbons either as an alkyl group or an alkyl-aryl group. Alkyl groups typically contain from about 6 to about 22 carbons, preferably about 10 to about 18 carbons, and more preferably from about 12 to about 16 carbons; aryl groups typically contain alkyl groups containing from about 4 to about 6 carbons. Each alkyl group can be a branched or linear chain and is either saturated or unsaturated. A typical aryl group is benzene. Some typical hydrophilic groups for anionic surfactants include but are not limited to $—CO_2^-$, $—OSO_3^-$, $—SO_3^-$, $—(OR_1)_x$, $—CO_2^-$, $—(OR_1)_x—OSO_3—$, $—(OR_1)_x—SO_3^-$. With x being less than about 10 and preferably less than about 5. Some nonlimiting examples of suitable surfactants includes, Stepanol® WAC, Biosoft® 40 (Stepan Co., Northfield, Ill.).

Other suitable ionic surfactants include the cationic and amphoteric surfactants. Nonlimiting examples of these classes of surfactants can be found in *Handbook of Surfactants*, M. R. Porter, 1991, Blackie & Son Ltd, pp. 179–202 as well as in *Surfactants and Interfacial Phenomena*, 2nd Ed., Milton J. Rosen, 1989, John Wiley & Sons, Inc., pp. 17–20 and pp. 28–31 and references therein, the disclosures of which are hereby incorporated herein by reference.

(c) Zwitterionic Surfactants

Zwitterionics are suitable for use in the present invention. Zwitterionic surfactants, also referred to as amphoteric surfactants comprise moieties that can have both negative and positive charges. Zwitterionics have advantages over other surfactants since these are less irritating to the skin and yet still provide good wetting. Some nonlimiting examples of zwitterionic surfactants useful for the present invention are: betaines, amine-oxides, sulfobetaines, sultaines, glycinates, aminoipropionates, imidazoline-based amphoterics. Various zwitterionic surfactants are disclosed in the "Handbook of Surfactants" by M. R. Porter, Chapman & Hall, 1991 and references therein and in "Surfactants and Interfacial Phenomena" by M. Rosen, 2nd Ed., John Wiley & Sons, 1989 and references therein. Zwitterionics disclosed in the "Handbook of Surfactants" and in "Surfactants and Interfacial Phenomena" and references therein are incorporated herein by reference.

(d) Fluorine-based Surfactants

Fluorocarbon surfactants are the class of surfactants wherein the hydrophobic part of the amphiphile comprises at least in part some portion of a carbon-based linear or cyclic moiety having fluorines attached to the carbon where typically hydrogens would be attached to the carbons together with a hydrophilic head group. Some typical nonlimiting fluorocarbon urfactants include fluorinated alkyl polyoxyalkylene, and fluorinated alkyl esters as well as ionic urfactants. Representative structures for these compounds are given below:

$$R_fR(R_1O)_xR_2 \quad (1)$$

$$R_fR—OC(O)R_3 \quad (2)$$

$$R_fR—Y—Z \quad (3)$$

$$R_fRZ \quad (4)$$

Where $R_f$ contains from about 6 to about 18 carbons each having from about 0 to about 3 fluorines attached. R is either an alkyl or alkylene oxide group which when present, has from about 1 to about 10 carbons and $R_1$ represents an alkylene radical having from about 1 to about 4 carbons, $R_2$ is either a hydrogen or a small alkyl capping group having from about 1 to about 3 carbons. $R_3$ represents a hydrocarbon moiety comprising from about 2 to about 22 including the carbon on the ester group. This hydrocarbon can be linear, branched or cyclic saturated or unsaturated and contained moieties based on oxygen, nitrogen, and sulfur including, but not limited to ethers, alcohols, esters, carboxylates, amides, amines, thio-esters, and thiols; these oxygen, nitrogen, and sulfur moieties can either interrupt the hydrocabon chain or be pendant on the hydrocarbon chain. In structure 3, Y represents a hydrocarbon group that can be an alkyl, pyridine group, amidopropyl, etc. that acts as a linking group between the fluorinated chain and the hydrophilic head group. In structures 3 and 4, Z represents a cationic, anionic, and amphoteric hydrophilic head groups including, but not limited to carboxylates, sulfates, sulfonates, quaternary ammonium groups, and betaines. Nonlimiting commercially available examples of these structures include Zonyl® 9075, FSO, FSN, FS-300, FS-310, FSN-100, FSO-100, FTS, TBC from DuPont and Fluoradrm surfactants FC-430, FC-431, FC-740, FC-99, FC-120, FC-754, $FC_{170}C$, and FC-171 from the 3MTM company in St. Paul, Minn.

(4) Optional Viscosity Control Compounds

Electrolytes are useful for lowering viscosity in the present compositions. Not to be bound by theory, but when carboxylic acid polymers have some degree of charge, these can build viscosity via electrostatic repulsion, electrolytes can provide shielding between charges that reduces electrostatic repulsion and thus reduces viscosity.

Inorganic salts suitable for reducing dilution viscosity include $MgI_2$, $MgBr_2$, $MgCl_2$, $Mg(NO_3)_2$, $Mg_3(PO_4)_2$, $Mg_2P_2O_7$, $MgSO_4$, magnesium silicate, NaI, NaBr, NaCl, NaF, $Na_3(PO_4)$, $NaSO_3$, $Na_2SO_4$, $Na_2SO_3$, $NaNO_3$, $NaIO_3$, $Na_3(PO_4)$, $Na_4P_2O_7$, sodium metasilicate, sodium tetrachloroaluminate, sodium tripolyphosphate (STPP), $Na_2Si_3O_7$, sodium zirconate, $CaF_2$, $CaCI_2$, $CaBr_2$, $CaI_2$, $CaSO_4$, $Ca(NO_3)_2$, Ca, KI, KBr, KCI, KF, $KNO_3$, $KIO_3$, $K_2SO_4$, $K_2SO_3$, $K_3(PO_4)$, $K_4(P_2O_7)$, potassium pyrosulfate, potassium pyrosulfite, LiI, LiBr, LiCl, LiF, $LiNO_3$, $AIF_3$, $AICl_3$, $AlBr_3$, $AlI_3$, $Al_2(SO_4)_3$, $Al(PO_4)$, $Al(NO_3)_3$, alluminum silicate; including hydrates of these salts and including combinations of these salts or salts with mixed cations e.g. potassium alum $AIK(SO_4)_2$ and salts with mixed anions, e.g. potassium tetrachloroaluminate and sodium tetrafluoroaluminate. Salts incorporating cations from groups IIIa, IVa, Va, VIa, VIIa, VIII, Ib, and IIb on the periodic chart with atomic numbers >13 are also useful in reducing dilution viscosity but less preferred due to their tendency to change oxidation states and thus they can adversely affect the odor or color of the formulation or lower weight efficiency. Salts with cations from group Ia or IIa with atomic numbers >20 as well as salts with cations from the lactinide or actinide series are useful in reducing dilution viscosity, but less preferred due to lower weight efficiency or toxicity. Mixtures of above salts are also useful.

Organic salts useful in this invention include, magnesium, sodium, lithium, potassium, zinc, and aluminum salts of the carboxylic acids including formate, acetate, proprionate, pelargonate, citrate, gluconate, lactate aromatic acids e.g. benzoates, phenolate and substituted benzoates or phenolates, such as phenolate, salicylate, polyaromatic acids terephthalates, and polyacids e.g. oxylate, adipate, succinate, benzenedicarboxylate, benzenetricarboxylate. Other useful organic salts include carbonate and/or hydrogencarbonate ($HCO_3^{-1}$) when the pH is suitable, alkyl and aromatic sulfates and sulfonates e.g. sodium methyl sulfate, benzene sulfonates and derivatives such as xylene sulfonate, and amino acids when the pH is suitable. Electrolytes can comprise mixed salts of the above, salts neutralized with mixed cations such as potassium/sodium tartrate, partially neutralized salts such as sodium hydrogen tartrate or potassium hydrogen phthalate, and salts comprising one cation with mixed anions.

Other useful organic salts include amino compounds that be protonated to form cationic salts either prior to addition or in situ such as Tris Amino® (2-amino-2-hydroxymethyl-1,3-propanediol) or AMPD™ (2-amino-2-methyl-1,3-propanediol) Both available from Angus Chemical Company.

Generally, inorganic electrolytes are preferred over organic electrolytes for better weight efficiency and lower costs. Mixtures of inorganic and organic salts can be used. Typical levels of electrolyte in the compositions are less than about 10%. Preferably from about 0.5% to about 5% by weight, more preferably from about 0.75% to about 2.5%, and most preferably from about 1% to about 2% by weight of the composition.

(5) Optional Odor Control Agent

The compositions for odor control are of the type disclosed in U.S. Pat. Nos. 5,534,165; 5,578,563; 5,663,134; 5,668,097; 5,670,475; and 5,714,137, Trinh et al. issued Jul. 9, 1996; Nov. 26, 1996; Sep. 2, 1997; Sep. 16, 1997; Sep. 23, 1997; and Feb. 3, 1998 respectively, all of said patents being incorporated herein by reference. Such compositions can contain several different optional odor control agents in addition to the polymers described hereinbefore that can control amine odors.

(a) Cyclodextrin

As used herein, the term "cyclodextrin" includes any of the known cyclodextrins such as unsubstituted cyclodextrins containing from six to twelve glucose units, especially, alpha-cyclodextrin, beta-cyclodextrin, gamma-cyclodextrin and/or their derivatives and/or mixtures thereof. The alpha-cyclodextrin consists of six glucose units, the beta-cyclodextrin consists of seven glucose units, and the gamma-cyclodextrin consists of eight glucose units arranged in donut-shaped rings. The specific coupling and conformation of the glucose units give the cyclodextrins a rigid, conical molecular structures with hollow interiors of specific volumes. The "lining" of each internal cavity is formed by hydrogen atoms and glycosidic bridging oxygen atoms; therefore, this surface is fairly hydrophobic. The unique shape and physical-chemical properties of the cavity enable the cyclodextrin molecules to absorb (form inclusion complexes with) organic molecules or parts of organic molecules which can fit into the cavity. Many odorous molecules can fit into the cavity including many malodorous molecules and perfume molecules. Therefore, cyclodextrins, and especially mixtures of cyclodextrins with different size cavities, can be used to control odors caused by a broad spectrum of organic odoriferous materials, which may, or may not, contain reactive functional groups. The complexation between cyclodextrin and odorous molecules occurs rapidly in the presence of water. However, the extent of the complex formation also depends on the polarity of the absorbed molecules. In an aqueous solution, strongly hydrophilic molecules (those which are highly water-soluble) are only partially absorbed, if at all. Therefore, cyclodextrin does not complex effectively with some very low molecular weight organic amines and acids when they are present at low levels on wet fabrics. As the water is being removed however, e.g., the fabric is being dried off, some low molecular weight organic amines and acids have more affinity and will complex with the cyclodextrins more readily.

The cavities within the cyclodextrin in the solution of the present invention should remain essentially unfilled (the cyclodextrin remains uncomplexed) while in solution, in order to allow the cyclodextrin to absorb various odor molecules when the solution is applied to a surface. Non-derivatised (normal) beta-cyclodextrin can be present at a level up to its solubility limit of about 1.85% (about 1.85g in 100 grams of water) at room temperature. Beta-cyclodextrin is not preferred in compositions which call for a level of cyclodextrin higher than its water solubility limit. Non-derivatised beta-cyclodextrin is generally not preferred when the composition contains surfactant since it affects the surface activity of most of the preferred surfactants that are compatible with the derivatised cyclodextrins.

Preferably, the cyclodextrins used in the present invention are highly water-soluble such as, alpha-cyclodextrin and/or derivatives thereof, gamma-cyclodextrin and/or derivatives thereof, derivatised beta-cyclodextrins, and/or mixtures thereof. The derivatives of cyclodextrin consist mainly of molecules wherein some of the OH groups are converted to OR groups. Cyclodextrin derivatives include, e.g., those with short chain alkyl groups such as methylated cyclodextrins, and ethylated cyclodextrins, wherein R is a methyl or an ethyl group; those with hydroxyalkyl substituted groups, such as hydroxypropyl cyclodextrins and/or hydroxyethyl cyclodextrins, wherein R is a —$CH_2$—CH(OH)—$CH_3$ or a —$CH_2CH_2$—OH group; branched cyclodextrins such as maltose-bonded cyclodextrins; cationic cyclodextrins such as those containing 2-hydroxy-3-(dimethylamino)propyl ether, wherein R is $CH_2$—CH(OH)—$CH_2$—$N(CH_3)_2$ which is cationic at low pH; quaternary ammonium, e.g., 2-hydroxy-3-(trimethylammonio) propyl ether chloride groups, wherein R is $CH_2$—CH(OH)—$CH_2$—$N^+(CH_3)_3Cl^-$; anionic cyclodextrins such as carboxymethyl cyclodextrins, cyclodextrin sulfates, and cyclodextrin succinylates; amphoteric cyclodextrins such as carboxymethyl/quaternary ammonium cyclodextrins; cyclodextrins wherein at least one glucopyranose unit has a 3–6-anhydro-cyclomalto structure, e.g., the mono-3-6-anhydrocyclodextrins, as disclosed in "Optimal Performances with Minimal Chemical Modification of Cyclodextrins", F. Diedaini-Pilard and B. Perly, The 7th International Cyclodextrin Symposium Abstracts, April 1994, p. 49, said references being incorporated herein by reference; and mixtures thereof. Other cyclodextrin derivatives are disclosed in U.S. Pat. No. : 3,426,011, Parmerter et al., issued Feb. 4, 1969; U.S. Pat. No. 3,453,257; U.S. Pat. No. 3,453,258; U.S. Pat. No. 3,453,259; and U.S. Pat. No. 3,453,260, all in the names of Parmerter et al., and all issued July 1, 1969; U.S. Pat. No. 3,459,731, Gramera et al., issued Aug. 5, 1969; U.S. Pat. No. 3,553,191, Parmnerter et al., issued Jan. 5, 1971; U.S. Pat. No. 3,565,887, Parmerter et al., issued Feb. 23, 1971; U.S. Pat. No. 4,535,152, Szejtli et al., issued Aug. 13, 1985; U.S. Pat. No. 4,616,008, Hirai et al., issued Oct. 7, 1986; U.S. Pat. No. 4,678,598, Ogino et al., issued Jul. 7, 1987; U.S. Pat. No. 4,638,058, Brandt et al., issued Jan. 20, 1987; and U.S. Pat. No. 4,746,734, Tsuchiyama et al., issued May 24, 1988; all of said patents being incorporated herein by reference.

Highly water-soluble cyclodextrins are those having water solubility of at least about 10 g in 100 ml of water at room temperature, preferably at least about 20 g in 100 ml of water, more preferably at least about 25 g in 100 ml of water at room temperature. The availability of solubilized, uncomplexed cyclodextrins is essential for effective and efficient odor control performance. Solubilized, water-soluble cyclodextrin can exhibit more efficient odor control performance than non-water-soluble cyclodextrin when deposited onto surfaces, especially fabric.

Examples of preferred water-soluble cyclodextrin derivatives suitable for use herein are hydroxypropyl alpha-cyclodextrin, methylated alpha-cyclodextrin, methylated beta-cyclodextrin, hydroxyethyl beta-cyclodextrin, and hydroxypropyl beta-cyclodextrin. Hydroxyalkyl cyclodextrin derivatives preferably have a degree of substitution of from about 1 to about 14, more preferably from about 1.5 to about 7, wherein the total number of OR groups per cyclodextrin is defined as the degree of substitution. Methylated cyclodextrin derivatives typically have a degree of substitution of from about 1 to about 18, preferably from about 3 to about 16. A known methylated beta-cyclodextrin is heptakis-2,6-di-O-methyl-kcyclodextrin, commonly known as DIMEB, in which each glucose unit has about 2 methyl groups with a degree of substitution of about 14. A preferred, more commercially available, methylated beta-cyclodextrin is a randomly methylated beta-cyclodextrin, commonly known as RAMEB, having different degrees of substitution, normally of about 12.6. RAMEB is more preferred than DIMEB, since DIMEB affects the surface activity of the preferred surfactants more than RAMEB. The preferred cyclodextrins are available, e.g., from Cerestar USA, Inc. and Wacker Chemicals (USA), Inc.

It is also preferable to use a mixture of cyclodextrins. Such mixtures absorb odors more broadly by complexing with a wider range of odoriferous molecules having a wider range of molecular sizes. Preferably at least a portion of the cyclodextrins is alpha-cyclodextrin and its derivatives thereof, gamma-cyclodextrin and its derivatives thereof, and/or derivatised beta-cyclodextrin, more preferably a mixture of alpha-cyclodextrin, or an alpha-cyclodextrin derivative, and derivatised beta-cyclodextrin, even more preferably a mixture of derivatised alpha-cyclodextrin and derivatised beta-cyclodextrin, most preferably a mixture of hydroxypropyl alpha-cyclodextrin and hydroxypropyl beta-cyclodextrin, and/or a mixture of methylated alpha-cyclodextrin and methylated beta-cyclodextrin.

Preferably, the solution used to treat the surface under usage conditions is virtually not discernible when dry. Typical levels of cyclodextrin in usage compositions for usage conditions are from about 0.01% to about 5%, preferably from about 0.1% to about 4%, more preferably from about 0.5% to about 2% by weight of the composition. Compositions with higher concentrations can leave unacceptable visible stains on fabrics as the solution evaporates off of the fabric. This is especially a problem on thin, colored, synthetic fabrics. In order to avoid or minimize the occurrence of fabric staining, it is preferable that the fabric be treated at a level of less than about 5 mg of cyclodextrin per gram of fabric, more preferably less than about 2 mg of cyclodextrin per gram of fabric. The presence of the surfactant can improve appearance by minimizing localized spotting.

When it is desired to incorporate cyclodextrin into a concentrated product, the cyclodextrin level is typically from about 3% to about 20%, more preferably from about 5% to about 10%, by weight of the concentrated composition, it is preferable to dilute the concentrated composition before treating fabrics in order to avoid staining. The resulting diluted compostion have usage concentrations of cyclodextrin as discussed hereinbefore, e.g., of from about 0.1% to about 5%, by weight of the diluted composition.

Cyclodextrin Preservative

Optionally, but desirably if cyclodextrin is present, preferably solubilized, water-soluble, antimicrobial preservative can be added to the composition of the present invention if the antimicrobial material is not sufficient to protect the cyclodextrin, or is not present, because cyclodextrin molecules are made up of varying numbers of glucose units which can make them a prime breeding ground for certain microorganisms, especially when in aqueous compositions. This drawback can lead to the problem of storage stability of cyclodextrin solutions for any significant length of time. Contamination by certain microorganisms with subsequent microbial growth can result in an unsightly and/or malodorous solution. Because microbial growth in cyclodextrin solutions is highly objectionable when it occurs, it is highly preferable to include a solubilized, water-soluble, antimicrobial preservative, which is effective for inhibiting and/or regulating microbial growth in order to increase storage stability of the preferably clear, aqueous odor-absorbing solution containing water-soluble cyclodextrin.

It is preferable to use a broad spectrum preservative, e.g., one that is effective on both bacteria (both gram positive and gram negative) and fungi. A limited spectrum preservative, e.g., one that is only effective on a single group of microorganisms, e.g., fungi, can be used in combination with a broad spectrum preservative or other limited spectrum preservatives with complimentary and/or supplementary activity. A mixture of broad spectrum preservatives can also be used. In some cases where a specific group of microbial contaminants is problematic (such as Gram negatives), aminocarboxylate chelators may be used alone or as potentiators in conjunction with other preservatives. These chelators which include, e.g., ethylenediaminetetraacetic acid (EDTA), hydroxyethylenediaminetriacetic acid, diethylenetriaminepentaacetic acid, and other aminocarboxylate chelators, and mixtures thereof, and their salts, and mixtures thereof, can increase preservative effectiveness against Gram-negative bacteria, especially Pseudomonas species.

Antimicrobial preservatives useful in the present invention include biocidal compounds, i.e., substances that kill microorganisms, or biostatic compounds, i.e., substances that inhibit and/or regulate the growth of microorganisms. Suitable preservatives are disclosed in U.S. Pat. Nos. 5,534,165; 5,578,563; 5,663,134; 5,668,097; 5,670,475; and 5,714,137, Trinh et al. issued Jul. 9, 1996; Nov. 26, 1996; Sep. 2, 1997; Sep. 16, 1997; Sep. 23, 1997; and Feb. 3, 1998 respectively, all of said patents being incorporated hereinbefore by reference. Preferred antimicrobial preservatives are those that are water-soluble and are effective at low levels because the organic preservatives can form inclusion complexes with the cyclodextrin molecules and compete with the malodorous molecules for the cyclodextrin cavities, thus rendering the cyclodextrins ineffective as odor controlling actives. Water-soluble preservatives useful in the present invention are those that have a solubility in water of at least about 0.3 g per 100 ml of water, i.e., greater than about 0.3% at room temperature, preferably greater than about 0.5% at room temperature. These types of preservatives have a lower affinity to the cyclodextrin cavity, at least in the aqueous phase, and are therefore more available to provide antimicrobial activity. Preservatives with a water-solubility of less than about 0.3% and a molecular structure that readily fits into the cyclodextrin cavity, have a greater tendency to form inclusion complexes with the cyclodextrin molecules, thus rendering the preservative less effective to control microbes in the cyclodextrin solution.

The water-soluble antimicrobial preservative in the present invention is included at an effective amount. The term "effective amount" as herein defined means a level sufficient to prevent spoilage, or prevent growth of inadvertently added microorganisms, for a specific period of time. In other words, the preservative is not being used to kill microorganisms on the surface onto which the composition is deposited in order to eliminate odors produced by microorganisms. Instead, it is preferably being used to prevent spoilage of the cyclodextrin solution in order to increase the shelf-life of the composition. Preferred levels of preservative are from about 0.0001% to about 0.5%, more preferably from about 0.0002% to about 0.2%, most preferably from about 0.0003% to about 0.1%, by weight of the usage composition.

In order to reserve most of the cyclodextrins for odor control, the cyclodextrin to preservative molar ratio should be greater than about 5:1, preferably greater than about 10:1, more preferably greater than about 50:1, even more preferably greater than about 100:1.

The preservative can be any organic preservative material which will not cause damage to fabric appearance, e.g., discoloration, coloration, bleaching. Preferred water-soluble preservatives include organic sulfur compounds, halogenated compounds, cyclic organic nitrogen compounds, low molecular weight aldehydes, quaternary ammonium compounds, dehydroacetic acid, phenyl and phenolic compounds, and mixtures thereof.

The preservatives of the present invention can be used in mixtures in order to control a broad range of microorganisms.

(b) Metal Salts

Optionally, but highly preferred, the present invention can include metallic salts for added odor absorption and/or antimicrobial benefit for the cyclodextrin solution when cyclodextrin is present. The metallic salts are selected from the group consisting of copper salts, zinc salts, and mixtures thereof.

Copper salts have some antimicrobial benefits. Specifically, cupric abietate acts as a fungicide, copper acetate acts as a mildew inhibitor, cupric chloride acts as a fungicide, copper lactate acts as a fungicide, and copper sulfate acts as a germicide. Copper salts also possess some malodor control abilities. See U.S. Pat. No. 3,172,817, Leupold, et al., which discloses deodorizing compositions for treating disposable articles, comprising at least slightly water-soluble salts of acylacetone, including copper salts and zinc salts, all of said patents are incorporated herein by reference.

The preferred zinc salts possess malodor control abilities. Zinc has been used most often for its ability to ameliorate malodor, e.g., in mouth wash products, as disclosed in U.S. Pat. No. 4,325,939, issued Apr. 20, 1982 and U.S. Pat. No. 4,469,674, issued Sep. 4, 1983, to N. B. Shah, et al., all of which are incorporated herein by reference. Highly-ionized and soluble zinc salts such as zinc chloride, provide the best source of zinc ions. Zinc borate functions as a fungistat and a mildew inhibitor, zinc caprylate functions as a fungicide, zinc chloride provides antiseptic and deodorant benefits, zinc ricinoleate functions as a fungicide, zinc sulfate heptahydrate functions as a fungicide and zinc undecylenate functions as a fungistat.

Preferably the metallic salts are water-soluble zinc salts, copper salts or mixtures thereof, and more preferably zinc salts, especially $ZnCl_2$. These salts are preferably present in the present invention primarily to absorb amine and sulfur-containing compounds that have molecular sizes too small to be effectively complexed with the cyclodextrin molecules. Low molecular weight sulfur-containing materials, e.g., sulfide and mercaptans, are components of many types of malodors, e.g., food odors (garlic, onion), bodylperspiration odor, breath odor, etc.

Low molecular weight amines are also components of many malodors, e.g., food odors, body odors, urine, etc.

When metallic salts are added to the composition of the present invention they are typically present at a level of from about 0.1% to about 10%, preferably from about 0.2% to about 8%, more preferably from about 0.3% to about 5% by weight of the usage composition.

(c) Soluble Carbonate or Bicarbonate Salts

Water-soluble alkali metal carbonate and/or bicarbonate salts, such as sodium bicarbonate, potassium bicarbonate, potassium carbonate, cesium carbonate, sodium carbonate, and mixtures thereof can be added to the composition of the present invention in order to help to control certain acid-type odors. Preferred salts are sodium carbonate monohydrate, potassium carbonate, sodium bicarbonate, potassium bicarbonate, and mixtures thereof. When these salts are added to the composition of the present invention, they are typically present at a level of from about 0.1% to about 5%, preferably from about 0.2% to about 3%, more preferably from about 0.3% to about 2%, by weight of the composition. When these salts are added to the composition of the present invention it is preferably that incompatible metal salts not be present in the invention. Preferably, when these salts are used the composition should be essentially free of zinc and other incompatible metal ions, e.g., Ca, Fe, Ba, etc. which form water-insoluble salts.

(d) Enzymes

Enzymes can be used to control certain types of malodor, especially malodor from urine and other types of excretions, including regurgitated materials. Proteases are especially desirable. The activity of commercial enzymes depends very much on the type and purity of the enzyme being considered. Enzymes that are water soluble proteases like pepsin, tripsin, ficin, bromelin, papain, rennin, and mixtures thereof are particularly useful.

Enzymes are normally incorporated at levels sufficient to provide up to about 5 mg by weight, preferably from about 0.001 mg to about 3 mg, more preferably from about 0.002 mg to about 1 mg, of active enzyme per gram of the aqueous compositions. Stated otherwise, the aqueous compositions herein can comprise from about 0.0001% to about 0.5%, preferably from about 0.001% to about 0.3%, more preferably from about 0.005% to about 0.2% by weight of a commercial enzyme preparation. Protease enzymes are usually present in such commercial preparations at levels sufficient to provide from 0.0005 to 0.1 Anson units (AU) of activity per gram of aqueous composition.

Nonlimiting examples of suitable, commercially available, water soluble proteases are pepsin, tripsin, ficin, bromelin, papain, rennin, and mixtures thereof. Papain can be isolated, e.g., from papaya latex, and is available commercially in the purified form of up to, e.g., about 80% protein, or cruder, technical grade of much lower activity. Other suitable examples of proteases are the subtilisins which are obtained from particular strains of *B. subtilis* and *B. licheniforms*. Another suitable protease is obtained from a strain of Bacillus, having maximum activity throughout the pH range of 8–12, developed and sold by Novo Industries A/S under the registered trade name ESPERASE®. The preparation of this enzyme and analogous enzymes is described in British Patent Specification No. 1,243,784 of Novo. Proteolytic enzymes suitable for removing protein-based stains that are commercially available include those sold under the trade names ALCALASE® and SAVINASE® by Novo Industries A/S (Denmark) and MAXATASE® by International Bio-Synthetics, Inc. (The Netherlands). Other proteases include Protease A (see European Patent Application 130,756, published Jan. 9, 1985); Protease B (see European Patent Application Serial No. 87303761.8, filed April 28, 1987, and European Patent Application 130,756, Bott et al, published Jan. 9, 1985); and proteases made by Genencor International, Inc., according to one or more of the following patents: Caldwell et al, U.S. Pat. Nos. 5,185,258, 5,204,015 and 5,244,791.

A wide range of enzyme materials and means for their incorporation into liquid compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985. Other enzyme materials useful for liquid formulations, and their incorporation into such formulations, are disclosed in U.S. Pat. No. 4,261,868, Hora et al, issued Apr. 14, 1981. Enzymes can be stabilized by various techniques, e.g., those disclosed and exemplified in U.S. Pat. No. 3,600,319, issued Aug. 17, 1971 to Gedge, et al., European Patent Application Publication No. 0 199 405, Application No. 86200586.5, published Oct. 29, 1986, Venegas, and in U.S. Pat. No. 3,519,570. All of the above patents and applications are incorporated herein, at least in pertinent part.

Enzyme-polyethylene glycol conjugates are also preferred. Such polyethylene glycol (PEG) derivatives of enzymes, wherein the PEG or alkoxy-PEG moieties are coupled to the protein molecule through, e.g., secondary amine linkages. Suitable derivatization decreases immunogenicity, thus minimizes allergic reactions, while still maintaining some enzymatic activity. An example of protease-PEG's is PEG-subtilisin Carlsberg from *B. lichenniformis* coupled to methoxy-PEGs through secondary amine linkage, and is available from Sigma-Aldrich Corp., St. Louis, Miss.

(e) Zeolites

When the clarity of the solution is not needed, and the solution is not sprayed on fabrics, other optional odor absorbing materials, e.g., zeolites and/or activated carbon, can also be used. A preferred class of zeolites is characterized as "intermediate" silicate/aluminate zeolites. The intermediate zeolites are characterized by $SiO_2/AlO_2$ molar ratios of less than about 10. Preferably the molar ratio of $SiO_2/AlO_2$ ranges from about 2 to about 10. The intermediate zeolites have an advantage over the "high" zeolites. The intermediate zeolites have a higher affinity for amine-type odors, they are more weight efficient for odor absorption because they have a larger surface area, and they are more moisture tolerant and retain more of their odor absorbing capacity in water than the high zeolites. A wide variety of intermediate zeolites suitable for use herein are commercially available as Valfor® CP301-68, Valfor® 300-63, Valfor® CP300-35, and Valfor® CP300–56, available from PQ Corporation, and the CBV100® series of zeolites from Conteka.

Zeolite materials marketed under the trade name Abscent® and Smellrite®, available from The Union Carbide Corporation and UOP are also preferred. These materials are typically available as a white powder in the 3–5 micron particle size range. Such materials are preferred over the intermediate zeolites for control of sulfur-containing odors, e.g., thiols, mercaptans.

(f) Activated Carbon

The carbon material suitable for use in the present invention is the material well known in commercial practice as an absorbent for organic molecules and/or for air purification purposes. Often, such carbon material is referred to as "activated" carbon or "activated" charcoal. Such carbon is available from commercial sources under such trade names as; Calgon-Type CPG®; Type PCB®; Type SGL®; Type CAL®; and Type OL®. Activated carbon fibers and cloth may also be used in combination with the compositions and/or articles of manufacture disclosed herein to provide malodor removal and/or freshness benefits. Such activated carbon fibers and fabrics can be acquired from Calgon.

(g) Mixtures Thereof

Mixtures of the optional odor control agents described above are desirable, especially when the mixture provides control over a broader range of odors.

(6) Optional Perfume

The wrinkle control composition of the present invention can also optionally provide a "scent signal" in the form of a pleasant odor which provides a freshness impression to the treated fabrics. The scent signal can be designed to provide a fleeting perfume scent. When perfume is added as a scent signal, it is added only at very low levels, e.g., from about 0% to about 0.5%, preferably from about 0.003% to about 0.3%, more preferably from about 0.005% to about 0.2%, by weight of the usage composition.

Perfume can also be added as a more intense odor in product and on fabrics. When stronger levels of perfume are preferred, relatively higher levels of perfume can be added.

Any type of perfume can be incorporated into the composition of the present invention. The preferred perfume ingredients are those suitable for use to apply on fabrics and garments.

Typical examples of such preferred ingredients are given in U.S. Pat. No. 5,445,747, issued Aug. 29, 1995 to Kvietok et al., incorporated herein by reference.

When long lasting fragrance odor on fabrics is desired, it is preferred to use at least an effective amount of perfume ingredients which have a boiling point of about 30° C. or higher. Nonlimiting examples of such preferred ingredients are given in U.S. Pat. No. 5,500,138, issued Mar. 19, 1996 to Bacon et al., incorporated herein by reference. It is also preferred to use materials that can slowly release perfume ingredients after the fabric is treated by the wrinkle control composition of this invention. Examples of materials of this type are given in U.S. Pat. No. 5,531,910, Severns et al., issued Jul. 2, 1996, said patent being incorporated herein by reference.

When cyclodextrin is present, it is essential that the perfume be added at a level wherein even if all of the perfume in the composition were to complex with the cyclodextrin molecules when cyclodextrin is present, there will still be an effective level of uncomplexed cyclodextrin molecules present in the solution to provide adequate odor control. In order to reserve an effective amount of cyclodextrin molecules for odor control when cyclodextrin is present, perfume is typically present at a level wherein less than about 90% of the cyclodextrin complexes with the perfume, preferably less than about 50% of the cyclodextrin complexes with the perfume, more preferably, less than about 30% of the cyclodextrin complexes with the perfume, and most preferably, less than about 10% of the cyclodextrin complexes with the perfume. The cyclodextrin to perfume weight ratio should be greater than about 5:1 preferably greater than about 8:1, more preferably greater than about 10:1, even more preferably greater than about 20:1, still more preferably greater than 40:1 and most preferably greater than about 70:1.

Preferably the perfume is hydrophilic and is composed predominantly of ingredients selected from two groups of ingredients, namely, (a) hydrophilic ingredients having a ClogP of less than about 3.5, more preferably less than about 3.0, and (b) ingredients having significant low detection threshold, and mixtures thereof. Typically, at least about 50%, preferably at least about 60%, more preferably at least about 70%, and most preferably at least about 80% by weight of the perfume is composed of perfume ingredients of the above groups (a) and (b). For these preferred perfumes, the cyclodextrin to perfume weight ratio is typically of from about 2:1 to about 200:1; preferably from about 4:1 to about 100:1, more preferably from about 6:1 to about 50:1, and even more preferably from about 8:1 to about 30:1.

(a) Hydrophilic Perfume Ingredients

The hydrophilic perfume ingredients are more soluble in water, have less of a tendency to complex with the cyclodextrins, and are more available in the odor absorbing composition than the ingredients of conventional perfumes. The degree of hydrophobicity of a perfume ingredient can be correlated with its octanol/water partition coefficient P. The octanol/water partition coefficient of a perfume ingredient is the ratio between its equilibrium concentration in octanol and in water. A perfume ingredient with a greater partition coefficient P is considered to be more hydrophobic. Conversely, a perfume ingredient with a smaller partition coefficient P is considered to be more hydrophilic. Since the partition coefficients of the perfume ingredients normally have high values, they are more conveniently given in the form of their logarithm to the base 10, logP. Thus the preferred perfume hydrophilic perfume ingredients of this invention have logP of about 3.5 or smaller, preferably of about 3.0 or smaller.

The logP of many perfume ingredients have been reported; for example, the Pomona92 database, available from Daylight Chemical Information Systems, Inc. (Daylight CIS), Irvine, Cali., contains many, along with citations to the original literature. However, the logP values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each perfume ingredient, and takes into account the numbers and types of atoms, the atom connectivity, and chemical bonding. The ClogP values, which are the most reliable and widely used estimates for this physicochemical property, are used instead of the experimental logP values in the selection of perfume ingredients which are useful in the present invention.

Non-limiting examples of the more preferred hydrophilic perfume ingredients are allyl amyl glycolate, allyl caproate, amyl acetate, amyl propionate, anisic aldehyde, anisyl acetate, anisole, benzaldehyde, benzyl acetate, benzyl acetone, benzyl alcohol, benzyl formate, benzyl iso valerate, benzyl propionate, beta gamma hexenol, calone, camphor gum, laevo-carveol, d-carvone, laevo-carvone, cinnamic alcohol, cinnamyl acetate, cinnamic alcohol, cinnamyl formate, cinnamyl propionate, cis-jasmone, cis-3-hexenyl acetate, coumarin, cuminic alcohol, cuminic aldehyde, Cyclal C, cyclogalbanate, dihydroeuginol, dihydro isojasmonate, dimethyl benzyl carbinol, dimethyl benzyl carbinyl acetate, ethyl acetate, ethyl aceto acetate, ethyl amyl ketone, ethyl anthranilate, ethyl benzoate, ethyl butyrate, ethyl cinnamate, ethyl hexyl ketone, ethyl maltol, ethyl-2-methyl butyrate, ethyl methylphenyl glycidate, ethyl phenyl acetate, ethyl salicylate, ethyl vanillin, eucalyptol, .eugenol, eugenyl acetate, eugenyl formate, eugenyl methyl ether, fenchyl alcohol, flor acetate (tricyclo decenyl acetate), fructone, frutene (tricyclo decenyl propionate), geraniol, geranyl oxyacetaldehyde, heliotropin, hexenol, hexenyl acetate, hexyl acetate, hexyl formate, hinokitiol, hydrotropic alcohol, hydroxycitronellal, hydroxycitronellal diethyl acetal, hydroxycitronellol, indole, isoamyl alcohol, iso cyclo citral, isoeugenol, isoeugenyl acetate, isomenthone, isopulegyl acetate, isoquinoline, keone, ligustral, linalool, linalool oxide, linalyl formate, lyral, menthone, methyl acetophenone, methyl amyl ketone, methyl anthranilate, methyl benzoate, methyl benzyl acetate, methyl cinnamate, methyl dihydrojasmonate, methyl eugenol, methyl heptenone, methyl heptine carbonate, methyl heptyl ketone, methyl hexyl ketone, methyl isobutenyl tetrahydropyran, methyl-N-methyl anthranilate, methyl beta naphthyl ketone, methyl phenyl carbinyl acetate, methyl salicylate, nerol, nonalactone, octalactone, octyl alcohol (octanol-2), para-anisic aldehyde, para-cresol, para-cresyl methyl ether, para hydroxy phenyl butanone, para-methoxy acetophenone, para-methyl acetophenone, phenoxy ethanol, phenoxyethyl propionate, phenyl acetaldehyde, phenylacetaldehyde diethyl ether, phenylethyl oxyacetaldehyde, phenyl ethyl acetate, phenyl ethyl alcohol, phenyl ethyl dimethyl carbinol, prenyl acetate, propyl butyrate, pulegone, rose oxide, safrole, terpineol, vanillin, viridine, and mixtures thereof.

Nonlimiting examples of other preferred hydrophilic perfume ingredients which can be used in perfume compositions of this invention are allyl heptoate, amyl benzoate, anethole, benzophenone, carvacrol, citral, citronellol, citronellyl nitrile, cyclohexyl ethyl acetate, cymal, 4-decenal, dihydro isojasmonate, dihydro myrcenol, ethyl methyl phenyl glycidate, fenchyl acetate, florhydral, gamma-nonalactone, geranyl formate, geranyl nitrile, hexenyl isobutyrate, alpha-ionone, isobornyl acetate, isobutyl benzoate, isononyl alcohol, isomenthol, para-isopropyl phenylacetaldehyde, isopulegol, linalyl acetate, 2-methoxy naphthalene, menthyl acetate, methyl chavicol, musk ketone, beta naphthol methyl ether, neral, nonyl aldehyde, phenyl heptanol, phenyl hexanol, terpinyl acetate, Veratrol, yara-yara, and mixtures thereof.

The preferred perfume compositions used in the present invention contain at least 4 different hydrophilic perfume ingredients, preferably at least 5 different hydrophilic perfume ingredients, more preferably at least 6 different hydrophilic perfume ingredients, and even more preferably at least 7 different hydrophilic perfume ingredients. Most common perfume ingredients which are derived from natural sources are composed of a multitude of components. When each such material is used in the formulation of the preferred perfume compositions of the present invention, it is counted as one single ingredient, for the purpose of defining the invention.

(b) Low Odor Detectionn Thereshold Perfume Ingedients

The odor detection threshold of an odorous material is the lowest vapor concentration of that material which can be olfactorily detected. The odor detection threshold and some odor detection threshold values are discussed in, e.g., "Standardized Human Olfactory Thresholds", M. Devos et al, IRL Press at Oxford University Press, 1990, and "Compilation of Odor and Taste Threshold Values Data", F. A. Fazzalari, editor, ASTM Data Series DS 48A, American Society for Testing and Materials, 1978, both of said publications being incorporated by reference. The use of small amounts of perfume ingredients that have low odor detection threshold values can improve perfume odor character, even though they are not as hydrophilic as perfume ingredients of group (a) which are given hereinabove. Perfume ingredients that do not belong to group (a) above, but have a significantly low detection threshold, useful in the composition of the present invention, are selected from the group consisting of ambrox, bacdanol, benzyl salicylate, butyl anthranilate, cetalox, damascenone, alpha-damascone, gamma-dodecalactone, ebanol, herbavert, cis-3-hexenyl salicylate, alpha-ionone, beta-ionone, alpha-isomethylionone, lilial, methyl nonyl ketone, gamma-undecalactone, undecylenic aldehyde, and mixtures thereof. These materials are preferably present at low levels in addition to the hydrophilic ingredients of group (a), typically less than about 20%, preferably less than about 15%, more preferably less than about 10%, by weight of the total perfume compositions of the present invention. However, only low levels are required to provide an effect.

There are also hydrophilic ingredients of group (a) that have a significantly low detection threshold, and are especially useful in the composition of the present invention. Examples of these ingredients are allyl amyl glycolate, anethole, benzyl acetone, calone, cinnamic alcohol, coumarin, cyclogalbanate, Cyclal C, cymal, 4-decenal, dihydro isojasmonate, ethyl anthranilate, ethyl-2-methyl butyrate, ethyl methylphenyl glycidate, ethyl vanillin, eugenol, flor acetate, florhydral, fructone, frutene, heliotropin, keone, indole, iso cyclo citral, isoeugenol, lyral, methyl heptine carbonate, linalool, methyl anthranilate, methyl dihydrojasmonate, methyl isobutenyl tetrahydropyran, methyl beta naphthyl ketone, beta naphthol methyl ether, nerol, para-anisic aldehyde, para hydroxy phenyl butanone, phenyl acetaldehyde, vanillin, and mixtures thereof. Use of low odor detection threshold perfume ingredients minimizes the level of organic material that is released into the atmosphere.

(7) Optional Antimicrobial Active

Optionally, but preferably, solubilized, water-soluble, antimicrobial preservative can be added to the composition of the present invention because these aqueous products may be prime breeding grounds for certain microorganisms, especially when in aqueous compositions. This drawback can lead to the problem of storage stability of these solutions for any significant length of time. Contamination by certain microorganisms with subsequent microbial growth can result in an unsightly and/or malodorous solution. Because microbial growth in aqueous solutions is highly objectionable when it occurs, it is highly preferable to include a solubilized, water-soluble, antimicrobial preservative, which is effective for inhibiting and/or regulating microbial growth in order to increase storage stability of the preferably clear, aqueous consumer products such as the subject product of this patent.

Typical microorganisms that can be found in raw materials for these products and whose growth can be found in the resulting aqueous solutions include bacteria, both Gram (−) and (+). Gram (−) contaminants may include species such as *Escherichia coli* and *Pseudomonas aerukinosa* which may be found in some water sources, and can be introduced during the preparation of these solutions. Other Pseudomonas species, such as *P. cepacia*, are typical microbial contaminants in surfactant manufacturing facilities and may readily contaminate packed finished products. Typical other Gram (−) bacterial contaminants may include Burkholderia, Enterobacter and Gluconobacter species,. Gram (+) species may include Bacillus species e.g. *B. cereus* and *B. sphaericus*; and may also include other Gram (+) such as Staphylococcus species, e.g. *S. aureus.*

Fungal contaminants may include *Aspergillus species.*

Therefore, it is preferable to use a broad spectrum preservative, e.g., one that is effective on both bacteria (both gram positive and gram negative) and fungi. A limited spectrum preservative, e.g., one that is only effective on a single group of microorganisms, e.g., fungi, can be used in combination with a broad spectrum preservative or other limited spectrum preservatives with complimentary and/or supplementary activity. A mixture of broad spectrum preservatives can also be used. In some cases where a specific group of microbial contaminants is problematic (such as Gram negatives), aminocarboxylate chelators, such as those described hereinbefore, can be used alone or as potentiators in conjunction with other preservatives. These chelators which include, e.g., ethylenediaminetetraacetic acid (EDTA), hydroxyethylenediaminetriacetic acid, diethylenetriaminepentaacetic acid (DTPA), and other aminocarboxylate chelators, and mixtures thereof, and their salts including phosphonates, and mixtures thereof, can increase preservative effectiveness against Gram-negative bacteria, especially Pseudomonas species.

Antimicrobial preservatives useful in the present invention include biocidal compounds, i.e., substances that kill microorganisms, or biostatic compounds, i.e., substances that inhibit and/or regulate the growth of microorganisms. Preferred antimicrobial preservatives are those that are water-soluble and are effective at low levels. Water-soluble preservatives useful in the present invention are those that have a solubility in water of at least about 0.3 g per 100 ml of water, i.e., greater than about 0.3% at room temperature, preferably greater than about 0.5% at room temperature.

The water-soluble antimicrobial preservative in the present invention is included at an effective amount. The term "effective amount" as herein defined means a level sufficient to prevent spoilage, or prevent growth of inadvertently added microorganisms in the packaged product, for a specific period of time. In other words, the preservative is not being used to kill microorganisms on the surface onto which the composition is deposited. Instead, it is preferably being used to prevent spoilage of the product solution in order to increase the shelf-life of the composition. Preferred levels of preservative are from about 0.0001% to about 0.5%, more preferably from about 0.0002% to about 0.2%, most preferably from about 0.0003% to about 0.1%, by weight of the usage composition.

The preservative can be any organic preservative material which will not cause damage to fabric appearance, e.g., discoloration, coloration, bleaching. Preferred water-soluble preservatives include organic sulfur compounds, halogenated compounds, cyclic organic nitrogen compounds, low molecular weight aldehydes, quaternary ammonium compounds, dehydroacetic acid, phenyl and phenolic compounds, alcoholic solvents and mixtures thereof.

The following are non-limiting examples of preferred water-soluble preservatives for use in the present invention. A more complete list is found in U.S. Pat. No. 5,714,137, incorporated hereinbefore by reference.

(a) Organic Sulfur Compounds

Preferred water-soluble preservatives for use in the present invention are organic sulfur compounds. Some non-limiting examples of organic sulfur compounds suitable for use in the present invention are:

(i) 3-Isothiazolone Compounds

A preferred preservative is an antimicrobial, organic preservative containing 3-isothiazolone groups.

This class of compounds is disclosed in U.S. Pat. No. 4,265,899, Lewis et al., issued May 5, 1981, and incorporated herein by reference. A preferred preservative is a water-soluble mixture of 5-chloro-2-methyl-4-isothiazolin-3-one and 2-methyl-4-isothiazolin-3-one, more preferably a mixture of about 77% 5-chloro-2-methyl-4-isothiazolin-3-one and about 23% 2-methyl-4-isothiazolin-3-one, a broad spectrum preservative available as a 1.5% aqueous solution under the trade name Kathon® CG by Rohm and Haas Company.

When Kathon® is used as the preservative in the present invention it is present at a level of from about 0.0001% to about 0.01%, preferably from about 0.0002% to about 0.005%, more preferably from about 0.0003% to about 0.003%, most preferably from about 0.0004% to about 0.002%, by weight of the composition.

Other isothiazolins include 1,2-benzisothiazolin-3-one, available under the trade name Proxel® products; and 2-methyl-4,5-trimethylene-4-isothiazolin-3-one, available under the trade name Promexal®. Both Proxel and Promexal are available from Zeneca. They have stability over a wide pH range (i.e., 4–12). Neither contain active halogen and are not formaldehyde as releasing preservatives. Both Proxel and Promexal are effective against typical Gram negative and positive bacteria, fungi and yeasts when used at a level from about 0.001% to about 0.5%, preferably from about 0.005% to about 0.05%, and most preferably from about 0.01% to about 0.02% by weight of the usage composition.

(ii) Sodium Pyritione

Another preferred organic sulfur preservative is sodium pyrithione, with water solubility of about 50%. When sodium pyrithione is used as the preservative in the present invention it is typically present at a level of from about 0.0001% to about 0.01%, preferably from about 0.0002% to about 0.005%, more preferably from about 0.0003% to about 0.003%, by weight of the usage composition.

Mixtures of the preferred organic sulfur compounds can also be used as the preservative in the present invention.

(b) Halogenated Compounds

Preferred preservatives for use in the present invention are halogenated compounds. Some non-limiting examples of halogenated compounds suitable for use in the present invention are:

5-bromo-5-nitro-1,3-dioxane, available under the trade name Bronidox L® from Henkel. Bronidox L® has a solubility of about 0.46% in water. When Bronidox is used as the preservative in the present invention it is typically present at a level of from about 0.0005% to about 0.02%, preferably from about 0.001% to about 0.01%, by weight of the usage composition;

2-bromo-2-nitropropane-1,3-diol, available under the trade name Bronopo® from Inolex can be used as the preservative in the present invention. Bronopol has a solubility of about 25% in water. When Bronopol is used as the preservative in the present invention it is typically present at a level of from about 0.002% to about 0.1%, preferably from about 0.005% to about 0.05%, by weight of the usage composition;

1,1'-hexamethylene bis(5-(p-chlorophenyl)biguanide), commonly known as chlorhexidine, and its salts, e.g., with acetic and gluconic acids can be used as a preservative in the present invention. The digluconate salt is highly water-soluble, about 70% in water, and the diacetate salt has a solubility of about 1.8% in water. When chlorhexidine is used as the preservative in the present invention it is typically present at a level of from about 0.0001% to about 0.04%, preferably from about 0.0005% to about 0.01%, by weight of the usage composition.

1,1,1-Trichloro-2-methylpropan-2-ol, commonly known as chlorobutanol, with water solubility of about 0.8%; a typical effective level of chlorobutanol is from about 0.1% to about 0.5%, by weight of the usage composition.

4,4'-(Trimethylenedioxy)bis-(3-bromobenzamidine) diisethionate, or dibromopropamidine, with water solubility of about 50%; when dibromopropamidine is used as the preservative in the present invention it is typically present at a level of from about 0.0001% to about 0.05%, preferably from about 0.0005% to about 0.01% by weight of the usage composition.

Mixtures of the preferred halogenated compounds can also be used as the preservative in the present invention.

(c) Cyclic Organic Nitrogen Compounds

Preferred water-soluble preservatives for use in the present invention are cyclic organic nitrogen compounds. Some non-limiting examples of cyclic organic nitrogen compounds suitable for use in the present invention are:

(i) Imidazolidindione Compounds

Preferred preservatives for use in the present invention are imidazolidione compounds.

Some non-limiting examples of imidazolidinedione compounds suitable for use in the present invention are:

1,3-bis(hydroxymethyl)-5,5-dimethyl-2,4-imidazolidinedione, commonly known as dimethyloldimethylhydantoin, or DMDM hydantoin, available as, e.g., Glydant® from Lonza. DMDM hydantoin has a water solubility of more than 50% in water, and is mainly effective on bacteria. When DMDM hydantoin is used, it is preferable that it be used in combination with a broad spectrum preservative such as Kathon CG , or formaldehyde. A preferred mixture is about a 95:5 DMDM hydantoin to 3-butyl-2-iodopropynylcarbamate mixture, available under the trade name Glydant Plus® from Lonza. When Glydant Plus® is used as the preservative in the present invention, it is typically present at a level of from about 0.005% to about 0.2% by weight of the usage composition;

N-[1,3-bis(hydroxymethyl)2,5-dioxo-4-imidazolidinyl]-N,N'-bis(hydroxymethyl) urea, commonly known as diazolidinyl urea, available under the trade name Germall II® from Sutton Laboratories, Inc. (Sutton) can be used as the preservative in the present invention. When Germall II® is used as the preservative in the present invention, it is typically present at a level of from about 0.01% to about 0.1% by weight of the usage composition;

N,N"-methylenebis{N'-[1-(hydroxymethyl)-2,5-dioxo-4-imidazolidinyl]urea}, commonly known as imidazolidinyl urea, available, e.g., under the trade name Abiol® from 3V-Sigma, Unicide U-13® from Induchem, Germall 115® from (Sutton) can be used as the preservative in the present invention. When imidazolidinyl urea is used as the preservative, it is typically present at a level of from about 0.05% to about 0.2%, by weight of the usage composition.

Mixtures of the preferred. imidazolidinedione compounds can also be used as the preservative in the present invention.

(ii) Polymethoxy Bicyclic Oxazolidine

Another preferred water-soluble cyclic organic nitrogen preservative is polymethoxy bicyclic oxazolidine, available under the trade name Nuosept® C from Hüls America. When Nuosept® C is used as the preservative, it is typically present at a level of from about 0.005% to about 0.1%, by weight of the usage composition.

Mixtures of the preferred cyclic organic nitrogen compounds can also be used as the preservative in the present invention.

(d) Low Molecular Weight Aldehydes (i) Formaldehyde

A preferred preservative for use in the present invention is formaldehyde. Formaldehyde is a broad spectrum preservative which is normally available as formalin which is a 37% aqueous solution of formaldehyde. When formaldehyde is used as the preservative in the present invention, typical levels are from about 0.003% to about 0.2%, preferably from about 0.008% to about 0.1%. more preferably from about 0.01% to about 0.05%, by weight of the usage composition.

(ii) Glutaraldehyde

A preferred preservative for use in the present invention is glutaraldehyde. Glutaraldehyde is a water-soluble, broad spectrum preservative commonly available as a 25% or a 50% solution in water. When glutaraldehyde is used as the preservative in the present invention it is typically present at a level of from about 0.005% to about 0.1%, preferably from about 0.01% to about 0.05%, by weight of the usage composition.

(e) Quaternary Compounds

Preferred preservatives for use in the present invention are cationic and/or quaternary compounds. Such compounds include polyaminopropyl biguanide, also known as polyhexamethylene biguanide having the general formula:

$$HCl.NH_2—(CH_2)_3—[—(CH_2)_3—NH—C(=NH)—NH—C(=NH.HCl)—NH—(CH_2)_3—]_x—(CH_2)_3—NH—C(=NH)—NH.CN$$

Polyaminopropyl biguanide is a water-soluble, broad spectrum preservative which is available as a 20% aqueous solution available under the trade name Cosmocil CQ® a from ICI Americas, Inc., or under the trade name Mikrokill® from Brooks, Inc.

1-(3-Chlorallyl)-3,5,7-triaza-1-azoniaadamantane chloride, available, e.g., under the trade name Dowicil 200 from Dow Chemical, is an effective quaternary ammonium preservative; it is freely soluble in water; however, it has the tendency to discolor (yellow), therefore it is not highly preferred.

Mixtures of the preferred quaternary ammonium compounds can also be used as the preservative in the present invention.

When quaternary ammonium compounds are used as the preservative in the present invention, they are typically present at a level of from about 0.005% to about 0.2%, preferably from about 0.01% to about 0. 1%, by weight of the usage composition.

(f) Dehydroacetic Acid

A preferred preservative for use in the present invention is dehydroacetic acid. Dehydroacetic acid is a broad spectrum preservative preferably in the form of a sodium or a potassium salt so that it is water-soluble. This preservative acts more as a biostatic preservative than a biocidal preservative. When dehydroacetic acid is used as the preservative it is typically used at a level of from about 0.005% to about 0.2%, preferably from about 0.008% to about 0.1%, more preferably from about 0.01% to about 0.05%, by weight of the usage composition.

(e) Phenyl and Phenolic Compounds

Some non-limiting examples of phenyl and phenolic compounds suitable for use in the present invention are:

4,4'-diamidino-α,ω-diphenoxypropane diisethionate, commonly known as propamidine isethionate, with water solubility of about 16%; and 4,4'-diamidino-α,ω-diphenoxyhexane diisethionate, commonly known as hexamidine isethionate. Typical effective level of these salts is about 0.0002% to about 0.05% by weight of the usage composition.

Other examples are benzyl alcohol, with a water solubility of about 4%; 2-phenylethanol, with a water solubility of about 2%; and 2-phenoxyethanol, with a water solubility of about 2.67%; typical effective level of these phenyl and phenoxy alcohol is from about 0.1% to about 0.5%, by weight of the usage composition.

(h) Mixtures Thereof

The preservatives of the present invention can be used in mixtures in order to control a broad range of microorganisms.

Bacteriostatic effects can sometimes be obtained for aqueous compositions by adjusting the composition pH to an acid pH, e.g., less than about pH 4, preferably less than about pH 3, or a basic pH, e.g., greater than about 10, preferably greater than about 11. Low pH is a suitable approach in the present invention because the low pH may minimize the potential of bacterial contamination. High pH for microbial above about pH about 6 is not suitable due to the need to maintain a low pH to minimize viscosity. iTherefore, aqueous compositions of the present invention should have a pH of from about 3 to about 6, preferably from about 4 to about 6, more preferably from about 4.5 to about 6. The pH is typically adjusted with inorganic molecules such as (HCl) or NaOH.

(8) Optional Aminocarboxylate Chelators

Chelators, e.g., ethylenediaminetetraacetic acid (EDTA), hydroxyethylene-diaminetriacetic acid, diethylenetriamine-pentaacetic acid (DTPA also known commercially as Dequest 2060), aminotri(methylenphosphonic aicd) penta sodium salt (known commerically as Dequest 2006), and other aminocarboxylate chelators, and mixtures thereof, and their salts and phosphonates, and mixtures thereof, can optionally be used to increase antimicrobial and preservative effectiveness against Gram-negative bacteria, especially Pseudomonas species. Although sensitivity to EDTA/DTPA and other aminocarboxylate chelators is mainly a characteristic of Pseudomonas species, other bacterial species highly susceptible to chelators include Achromobacter, Alcalijenes, Azotobacter, Escherichia, Salmonella, Spirillum, and Vibrio. Other groups of organisms also show increased sensitivities to these chelators, including fungi and yeasts. Furthermore, aminocarboxylate chelators can help, e.g., maintaining product clarity, protecting fragrance and perfume components, and preventing rancidity and off odors.

Although these aminocarboxylate chelators may not be potent biocides in their own right, they function as potentiators for improving the performance of other antimicrobials/preservatives in the compositions of the present invention. Aminocarboxylate chelators can potentiate the performance of many of the cationic, anionic, and nonionic antimicrobials/preservatives, phenolic compounds, and isothiazolinones, that are used as antimicrobials/preservatives in the composition of the present invention. Nonlimiting examples of cationic antimicrobials/preservatives potentiated by aminocarboxylate chelators in solutions are chlorhexidine salts (including digluconate, diacetate, and dihydrochloride salts), and Quaternium-15, also known as Dowicil 200, Dowicide Q, Preventol D1, benzalkonium chloride, cetrimonium, myristalkonium chloride, cetylpyridinium chloride, lauryl pyridinium chloride, and the like. Nonlimiting examples of useful anionic antimicrobials/preservatives which are enhanced by aminocarboxylate chelators are sorbic acid and potassium sorbate.

Nonlimiting examples of useful nonionic antimicrobials/preservatives which are potentiated by aminocarboxylate chelators are DMDM hydantoin, phenethyl alcohol, monolaurin, imidazolidinyl urea, and Bronopol (2-bromo-2-nitropropane-1,3-diol).

Examples of useful phenolic antimicrobials/preservatives potentiated by these chelators are chloroxylenol, phenol, tert-butyl hydroxyanisole, salicylic acid, resorcinol, and sodium o-phenyl phenate. Nonlimiting examples of isothiazolinone antimicrobials/preservatives which are enhanced by aminocarboxylate chelators are Kathon, Proxel and Promexal.

The optional chelators are present in the compositions of this invention at levels of, typically, from about 0.01% to about 0.3%, more preferably from about 0.02% to about 0.1%, most preferably from about 0.02% to about 0.05% by weight of the usage compositions to provide antimicrobial efficacy in this invention.

Free, uncomplexed aminocarboxylate chelators are required to potentiate the efficacy of the antimicrobials. Thus, when excess alkaline earth (especially calcium and magnesium) and transitional metals (iron, manganese, copper, and others) are present, free chelators are not available and antimicrobial potentiation is not observed. In the case where significant water hardness or transitional metals are available or where product esthetics require a specified chelator level, higher levels may be required to allow for the availability of free, uncomplexed aminocarboxylate chelators to function as antimicrobial/preservative potentiators.

(9) Optional Buffer System

Buffer is preferred when compositions contain materials that tend to hydrolyze and cause pH drift. Polyalkylene oxide polysiloxanes are materials that tend to hydrolyze with the trisiloxane materials being particularly susceptible to this behavior. The polyalkylene oxide polysiloxanes are most stable to hydrolysis between pH at least about 5.5. and below about pH 7. Therefore, when the composition contains optional polyalkylene oxide polysiloxane it is preferably for the formulation to be buffered such that the pH is at least about 5.5 and less than pH about 7. Suprisingly, it is not as simple as adjusting such solutions to the appropriate pH, because some level of hydrolysis can still occur resulting in a pH drop that will further accelerate hydrolysis and degradation. To prevent this degradation it is essential to buffer the solution and to provide enough buffering capacity to compensate for any acid or base produced by any small amount of hydrolysis.

Buffering capacity is related to having a sufficient level or concentration of a buffering system in the composition to prevent large changes in pH as acids or bases are added to a buffered system. Buffering capacity is typically expressed as dB/dpH which is a unitless, positive number representing the gram equivalents per liter of strong acid or base which must be added to a system to effect a change in the pH of the system by one unit. The buffering capacity is related to the initial pH of the system as well as the disassociation constant and the concentration of the buffer.

Buffering capacity of a system, in this case the present compositions, can be calculated from the following equation:

$$dB/dpH=2.3K_aC[H^+]/(K_a+[H^+])^2$$

wherein $K_a$=the ionization constant of the buffer, C=the concentration of the buffer and $[H^+]$=the initial concentration of the hydrogen ion in the composition. As an example, simply adjusting the pH using a weak base, like triethanolamine, is not sufficient to provide necessary buffering capacity to this system, and the above calculation is performed for the amount of triethanolamine necessary to raise the pH of the a composition from pH=6.8 (a typical pH for the deionized water used to formulate the said composition) to pH=9, a preferred pH level for the said composition. For triethanolamine the $Ka=1.2\times10^{-8}$ and the initial$=1\times10^{-9}$. The amount of triethanolamine necessary to raise the pH from 6.8 to 9 is 0.1 g per liter or $6.7\times10^{-4}$. The buffering capacity of the above system is equal to:

$$2.3(1.2\times10^{-8})(6.7\times10^{-4})(1\times10^{-9})/(1.2\times10^{-8}+1\times10^{-9})^2=0.00011$$

This result indicates that a composition where pH is simply raised to a high pH by a base, even a buffering base such as triethanolamine, has very little buffering capacity. The buffering capacity indicates that it takes only 0.00011 gram equivalents per liter of a strong acid to change the pH by one unit. Such a system is not robust to pH drift over time and tends to hydrolyze at an increasingly rapid rate. The buffering capacity introduces an important concept—the concentration (or level) of the buffer in the composition is important because the concentration of buffer present is directly related to how much hydrogen ion the system can absorb without significant changes in pH. A thorough discussion of buffering capacity and the theory associated with it is given in the treatise "On the Measurement of Buffer Values and on the Relationship of Buffer Value to the Dissociation Constant of the Buffer and the Concentration and Reaction of the Buffer Solution" by Donald D. Van Slyke, *J. Biol. Chem.*, volume 52, pp 525–570, 1922, which is hereby incorporated herein by reference.

Many commonly used buffers are listed and discussed in the book *Buffers for pH and Metal Ion Control* by D. D. Perrin and B. Dempsey (John Wiley & Sons, 1974) and in references therein, which are hereby incorporated by reference. Buffering agents preferred for use in the compositions discussed herein are selected from the group consisting of buffering systems, acid-base conjugate pairs, and salts together with an acid or a base, and are incorporated in the present compositions at a level that maintains the pH of the composition at least about 5.5, preferably at least about 6, and preferably less than about 7 for a period of at least about 3 months, preferably at least about 6 months, more preferably at least about 12 months, even more preferably at least about 18 months, and still more preferably at least about 24 months.

Some nonlimiting examples of preferred buffer systems include D(+)-Tartaric acid (Fleurchem, Inc., Middletown, N.Y.) and sodium hydroxide, citric acid (A. E. Staley Mfg. Co. Decatur, Ill.) and sodium hydroxide, glycine (Hampshire Chemicals, Lexington, Mass.) and hydrogen chloride, citric acid and sodium citrate (Archer Daniels Midland, Decatur, Ill.), phenylacetic acid (Fleurchem, Inc., Middletown, N.Y.) and sodium phenyl acetate (CU Chemie Uetikon GmbH, Lahr, Germany), sodium acetate (Callaway Chemical Co., Smyrna, Ga.) and acetic acid (Callaway Chemical Co., Smyrna, Ga.), succinic acid (Schweitzerhall Inc., Piscataway, N.J.) and sodium hydroxide, potassium hydrogen pthalate (GFS Chemicals Inc. Powell, Ohio) and sodium hydroxide, maleic acid (Schweitzerhall Inc., Piscataway, N.J., Tris (Tris=Tris (hydroxymethyl) aminomethane available from the Angus® Sigma Chemical Co. St. Louis, Mo.), and sodium hydroxide, potassium dihydrogen phosphate (FMC Corporation Chemical Products Group, Philadephia, Pa.) and sodium hydroxide, 2,4,6-trimethylpyridine (Chemosyntha, Ingelmunster, Belgium) and sodium hydroxide. Sodium hydroxide is available from FMC Corporation, Philadelphia, Pa. and hydrogen chloride is available from Air Products and Chemicals, Inc., Allentown, Pa.

An effective amount of a buffering system wherein the concentration of all components of the buffering system including the acid-base conjugate pair as well as any salt used to boost the buffering capacity typically constitute from about 0.05% to about 10%, preferably from about 0.02% to about 8%, more preferably from about 0.1% to about 5%, and most preferably from about 0.2% to about 2.5% of the composition by weight. Preferred buffering systems are chosen from the group consisting of, but not limited to, buffering systems, acid-base conjugate pairs, and salts paired with an acid or a base, or self-buffering compounds and together with any salt intended to improve the buffering capacity of the system and utilized at a level that maintains the pH of the composition to be at least about 5.5., preferably at least about 6, preferably less than about 7 for a period of at least about 3 months, preferably at least about 6 months, more preferably at least about 12 months, even more preferably at least about 18 months, and still more preferably at least about 24 months. The preferred buffering capacity of the system is at least about 0.01, and more preferably at least about 0.02.

(9) Other Optional Ingredients

The composition of the present invention can optionally contain other adjunct odor-controlling materials, chelating agents, additional antistatic agents if more static control is desired, insect and moth repelling agents, colorants, especially bluing agents, antioxidants, and mixtures thereof in addition to the antiwrinkle ingredients, e.g., polymers. The total level of optional ingredients is low, preferably less than about 5%, more preferably less than about 3%, and even more preferably less than about 2%, by weight of the usage composition. These optional ingredients exclude the other ingredients specifically mentioned hereinbefore. Incorporating adjunct odor-controlling materials can enhance the capacity of the cyclodextrin to control odors as well as broaden the range of odor types and molecule sizes which can be controlled. Such materials include, for example, the metallic salts described hereinbefore, water-soluble cationic and anionic polymers in addition to those already disclosed, zeolites as discussed hereinbefore, water-soluble bicarbonate salts, and mixtures thereof.

(a) Optional Water-soluble Polyionic Polymers

Some water-soluble polyionic polymers, e.g., water-soluble cationic polymer and water-soluble anionic polymers in addition to those discussed hereinbefore, can be used in the composition of the present invention to provide additional odor control benefits.

(i) Cationic Polymers, e.g., Polyamines

Water-soluble cationic polymers, e.g., those containing amino functionalities, amido functionalities, and mixtures thereof, are useful in the present invention to control certain acid-type odors.

(ii) Anionic Polymers, e.g. Polyacrylic Acid

Water-soluble anionic polymers in addition to those described hereinbefore, e.g., polyacrylic acids and their water-soluble salts are useful in the present invention to control certain amine-type odors. Preferred polyacrylic acids and their alkali metal salts have an average molecular weight of less than about 20,000, more preferably less than 10,000, even more preferably from about 500 to about 5,000. Polymers containing sulfonic acid groups, phosphoric acid groups, phosphonic acid groups, and their water-soluble salts, and mixtures thereof, and mixtures with carboxylic acid and carboxylate groups, are also suitable.

Water-soluble polymers containing both cationic and anionic functionalities are also suitable. Examples of these polymers are given in U.S. Pat. No. 4,909,986, issued Mar. 20, 1990 to N. Kobayashi and A. Kawazoe, incorporated herein by reference. Another example of water-soluble polymers containing both cationic and anionic functionalities is a copolymer of dimethyldiallyl ammonium chloride and acrylic acid, commercially available under the trade name Merquat 280® from Calgon.

When a water-soluble polymer is used it is typically present at a level of from about 0.001% to about 3%, preferably from about 0.005% to about 2%, more preferably from about 0.01% to about 1%, and even more preferably from about 0.05% to about 0.5%, by weight of the usage composition.

(b) Optional Antistatic Agents

The composition of the present invention can optionally contain additional effective amounts of other antistatic agent to provide the treated clothes with in-wear static. Preferred antistatic agents are those that are water soluble in at least an effective amount, such that the composition remains a clear solution. Examples of these antistatic agents are monoalkyl cationic quaternary ammonium compounds, e.g., mono ($C_{10}$–$C_{14}$ alkyl)trimethyl ammonium halide, such as monolauryl trimethyl ammonium chloride, hydroxycetyl hydroxyethyl dimethyl ammonium chloride, available under the trade name Dehyquart E® from Henkel, and ethyl bis(polyethoxy ethanol) alkylammonium ethylsulfate, available under the trade name Variquat 66® from Witco Corp., polyethylene glycols, polymeric quaternary ammonium salts, such as polymers conforming to the general formula:

$$—N(CH_3)_2—(CH_2)_3—NH—CO—NH—(CH_2)_3—N(CH_3)_2{}^{+}—CH_2CH_2OCH_2CH_2—_x{}^{2+}2x[Cl^-]$$

available under the trade name Mirapol A-15® from Rhône-Poulenc, and $$—[N(CH_3)_2—(CH_2)_3—NH—CO—(CH_2)_4—CO—NH—(CH_2)_3—N(CH_3)_2—(CH_2CH_2OCH_2CH_2]—_x{}^{+}x[Cl^-],$$

available under the trade name Mirapol AD-1® from Rh ōne-Poulenc, quaternized polyethyleneimines, vinylpyrrolidone/methacrylamidopropyltrimethylammonium chloride copolymer, available under the trade name Gafquat HS-100® from GAF; triethonium hydrolyzed collagen ethosulfate, available under the trade name Quat-Pro E® from Maybrook; neutralized sulfonated polystyrene, available, e.g., under the trade name Versa TL-130® from Alco Chemical, neutralized sulfonated styrene/maleic anhydride copolymers, available, e.g., under the trade name Versa TL-48® from Alco Chemical; and mixtures thereof.

It is preferred that a no foaming, or low foaming, agent is used, to avoid foam formation during fabric treatment. It is also preferred that polyethoxylated agents such as polyethylene glycol or Variquat 66® are not used when alpha-cyclodextrin is used. The polyethoxylate groups have a strong affinity to, and readily complex with, alpha-cyclodextrin which in turn depletes the uncomplexed cyclodextrin available for odor control.

When an antistatic agent is used it is typically present at a level of from about 0.05% to about 10%, preferably from about 0.1% to about 5%, more preferably from about 0.3% to about 3%, by weight of the usage composition.

(c) Optional Insect and/or Moth Repelling Agent

The composition of the present invention can optionally contain an effective amount of insect and/or moth repelling agents. Typical insect and moth repelling agents are pheromones, such as anti-aggregation pheromones, and other natural and/or synthetic ingredients. Preferred insect and moth repellent agents useful in the composition of the present invention are perfume ingredients, such as citronellol, citronellal, citral, linalool, cedar extract, geranium oil, sandalwood oil, 2-(diethylphenoxy)ethanol, 1-dodecene, etc. Other examples of insect and/or moth repellents useful in the composition of the present invention are disclosed in U.S. Pat. Nos. 4,449,987; 4,693,890; 4,696,676; 4,933,371; 5,030,660; 5,196,200; and in "Semio Activity of Flavor and Fragrance Molecules on.Various Insect Species", B. D. Mookherjee et al., published in *Bioactive Volatile Compounds from Plants*, ASC Symposium Series 525, R. Teranishi, R. G. Buttery, and H. Sugisawa, 1993, pp. 35–48, all of said patents and publications being incorporated herein by reference. When an insect and/or moth repellent is used it is typically present at a level of from about 0.005% to about 3%, by weight of the usage composition.

(d) Optional Colorant

Colorants and dyes, especially bluing agents, can be optionally added to the wrinkle control compositions for visual appeal and performance impression. When colorants are used, they are used at extremely low levels to avoid fabric staining. Preferred colorants for use in the present compositions are highly water-soluble dyes, e.g., Liquitint® dyes available from Milliken Chemical Co. Non-limiting examples of suitable dyes are, Liquitint Blue HP, Liquitint Blue 65®, Liquitint Patent Blue®, Liquitint Royal Blue®, Liquitint Experimental Yellow 8949–43®, Liquitint Green HMC®, Liquitint Yellow II®, and mixtures thereof, preferably Liquitint Blue HP®, Liquitint Blue 65®, Liquitint Patent Blue®, Liquitint Royal Blue®, Liquitint Experimental Yellow 8949-43®, and mixtures thereof.

(e) Optional Anti-clogging Agent

Optional anti-clogging agent which enhances the wetting and anti-clogging properties of the composition, especially when starch is present, is chosen from the group of polymeric glycols of alkanes and olefins having from 2 to about 6, preferably 2 carbon atoms. The anti-clogging agent inhibits the formation of "plugs" in the spray nozzle. An example of the preferred anti-clogging agent is polyethylene glycol having an average molecular weight of from about 800 to about 12,000, more preferably from about 1,400 to about 8,000. When used, the anti-clogging agent is present at a level of from about 0.01% to about 1%, preferably from about 0.05% to about 0.5%, more preferably, from about 0.1% to about 0.3% by weight of the usage composition.

(f) Whiteness Preservaties

When it is desireable to have lubrication under conditions where oxidation or polymerization are a risk, a whiteness preservative selected from the group of chelants, fabric substantive chelants, optical brightening agents, bluing agents, UV absorbers, and oxidative stabilizers such as anti-oxidants and/or reductive agents as well as mixtures of whiteness preservatives can be used. When whiteness preservatives are used, they should be added at levels of at least about 0.001, preferably at least about 0.005%, more preferably at least about 0.01%, even more preferably at least about 0.05%, still more preferably at least about 0.2%, but typically below about 10%, preferably below about 5%, more preferably below about 3%, and still more preferably below about 1.5%.

Suprisingly, it was found that over time and especially in cases where clothes are exposed to excessive heat (e.g. as in extensive drying or drying in commercial dryers) and/or confined to an enclosed space after treating, an undesirable yellowish cast begins to be apparent on white items. This yellowing will be perceived as a negative by consumers. Not to be bound by theory, but the yellowing is believed to be caused by the auto-oxidation of unsaturated materials in the composition, particularly polyunsaturated materials which are know to catalyze auto-oxidation. At times it is desireable to incorporate optional fiber-fabric lubricants or other materials (e.g. surfactants) which contain unsaturates and especially polyunsaturates which can lead to fabric yellowing. It is surprisingly found that the yellowing can be significantly even when unsaturates and polyunsates are included in the formulation by introducing materials that control the auto-oxidation reaction and/or, optionally, optically mask the yellow cast.

(i) Metal Chelating Agent

Metals present in fabrics, products, water supply or arriving from other sources, especially transition metals and particularly copper and iron, can act to catalyze auto-oxidation of unsaturated materials, which can produce colored compounds. Therefore, metal chelating agents, which can be fabric substantive are added to the composition to control and reduce, or eliminate, catalysis of auto-oxidation reactions by metals. Metal chelating agents contain amine and especially tertiary amine moieties since these tend to be fabric substantive and very effectively chelate copper and iron as well as other metals. Aldehydes are produced by the auto-oxidation reactions, these are easily oxidized, and are believed to propagate the auto-oxidation reactions. Therefore amine-based metal chelating agents, and especially tertiary amine moieties, are also preferred since these react with aldehydes to terminate the auto-oxidation reactions.

The product contains at least about 0.01%, preferably at least about 0.05%, more preferably at least about 0.10% even more preferably about 0.5%, and most preferably at least about 0.75% and less than about 10%, preferably less than about 5.0% and more preferably less than about 1.0% by weight of a metal chelating agent. Levels below 1.0% are especially preferred in this formulation, since higher levels of metal chelating agents lead to instability in the formulation.

The structural description of a amine-based metal chelating compound for use in this composition is given below:

$$(R_1)(R_2)N(CX_2)_nN(R_3)(R_4)$$

wherein X is selected from the group consisting of hydrogen, linear or branched, substituted or unsubstituted alkyl having from 1 to 10 carbons atoms and substituted or unsubstituted aryl having at least 6 carbon atoms; n is an integer from 0 to 6; $R_1$, $R_2$, $R_3$, and $R_4$ are independently selected from the group consisting of alkyl; aryl; alkaryl; arylalkyl; hydroxyalkyl; polyhydroxyalkyl; polyalkylether having the formula $—((CH_2)_yO)_zR_7$ where $R_7$ is hydrogen or a linear, branched, substituted or unsubstituted alkyl chain having from 1 to 10 carbon atoms and where y is an integer from 2 to 10 and z is an integer from 1 to 30; alkoxy; polyalkoxy having the formula: $—(O(CH_2)_y)_zR_7$; the group $—C(O)R_8$ where $R_8$ is alkyl; alkaryl; arylalkyl; hydroxyalkyl; polyhydroxyalkyl and polyalkyether as defined in $R^1$, $R_2$, $R_3$, and $R_4$; $(CX_2)_nN(R_5)(R_6)$ with no more than one of $R_1$, $R_2$, $R_3$, and $R_4$ being $(CX_2)_nN(R_5)(R_6)$ and wherein $R_5$ and $R_6$ are alkyl; alkaryl; arylalkyl; hydroxyalkyl; polyhydroxyalkyl; polyalkylether; alkoxy and polyalkoxy as defined in $R_1$, $R_2$, $R_3$, and $R_4$; and either of $R_1$+$R_3$ or $R_4$ or $R_2$+$R_3$ or $R_4$ can combine to form a cyclic substituent.

Preferred agents include those where $R^1$, $R_2$, $R_3$, and $R_4$ are independently selected from the group consisting of alkyl groups having from 1 to 10 carbon atoms and hydroxyalkyl groups having from 1 to 5 carbon atoms, preferably ethyl, methyl, hydroxyethyl, hydroxypropyl and isohydroxypropyl. The color care agent has more than about 1% nitrogen by weight of the compound, and preferably more than 7%. A preferred agent is tetrakis-(2-hydroxylpropyl) ethylenediamine (TPED).

Other suitable water-soluble chelating agents can be selected from the group consisting of amino carboxylates, amino phosphonates, polyfunctionally-substituted aromatic chelating agents and mixtures thereof, all as hereinafter defined. The chelating agents disclosed in said U.S. Pat. No. 5,759,990 at column 26, line 29 through column 27, line 38 are suitable.

A suitable amine-based metal chelator, EDDS, that can be used herein (also known as ethylenediamine-N,N'-disuccinate) is the material described in U.S. Pat. No. 4,704,233, cited hereinabove, and has the formula (shown in free acid form):

$$HN(L)C_2H_4N(L)H$$

wherein L is a $CH_2(COOH)CH_2(COOH)$ group.

A wide variety of chelators can be used herein. Indeed, simple polycarboxylates such as citrate, oxydisuccinate, and the like, can also be used, although such chelators are not as effective as the amino carboxylates and phosphonates, on a weight basis. Accordingly, usage levels may be adjusted to take into account differing degrees of chelating effectiveness. The chelators herein will preferably have a stability constant (of the fully ionized chelator) for copper ions of at least about 5, preferably at least about 7. Typically, the chelators will comprise from about 0.05% to about 10%, more preferably from about 0.75% to about 5%, by weight of the compositions herein, in addition to those that are stabilizers. Preferred chelators include DETMP, DETPA, NTA, EDDS, and EDTA.

Mixtures of metal chelating agents are acceptable for use herein.

(ii) Brighteners

Optical brighteners also known as fluorescent whitening agents (FWAs) or fluorescent brighteners preserve whiteness by compensating for the yellow appearance by adding a complementary color to the fabric and thus the undesired yellowing is rendered invisible. Not to be bound by theory, but auto-oxidation of the polyunsaturated generates compounds that appear yellow on white fabrics because these compounds absorb short-wavelength light, light in the range of violet to blue or wavelengths between about 370 nm to 550 nm. Optical brighteners replace this missing part of the spectrum and so a white appearance is retained. Optical brighteners absorb light shorter wavelength ultraviolet light and emit light via fluorescence in the blue to blue violet range of the spectrum.

The product contains from at least about 0.005%, preferably at least about 0.01%, more preferably at least about 0.05%, even more preferably at least about 0.1%, still more preferably at least about 0.17% and less than about 5%, preferably less than about 3%, more preferably less than about 2% and most preferably less than about 1% of an agent know as an optical brightening agent (brightener). Lower levels of brightener are used in the presence of the metal chelating compound. In the absence of the metal chelating compound, higher levels of brightener are preferred.

Preferred optical brighteners are colorless on the substrate and do not absorb in the visible part of the spectrum. Preferred optical brighteners are also lightfast, meaning that these do not degrade substantially in sunlight. Optical brighteners suitable for use in this invention absorb light in the ultraviolet portion of the spectrum between 275 nm and about 400 nm and emit light in the violet to violet-blue range of the spectrum from about 400 nm to about 550 nm. Preferably, the optical brightener will contain an uninterrupted chain of conjugated double bounds. Optical brighteners are typically, but not limited to, derivatives of stilbene or 4,4'-diaminostilbene, biphenyl, five-membered heterocycles such as triazoles, oxazoles, imidiazoles, etc., or six-membered heterocycles (coumarins, naphthalamide, s-triazine, etc.). Many specific brightener structures are described in *The Kirk-Othmer Encyclopedia of Chemistry* 3rd Ed., pp 214–226 and in references therein U.S. Pat. No. 5,759,990 at column 21, lines 15–60; said references being incorporated herein by reference as suitable for use in this invention. Ionic brighteners with a positive or negative charge are preferred as this improves solubility in the compositions disclosed herein and thus are easier to formulate and are more stable.

Some preferred, but nonlimiting brighteners are Optiblanc® GL and Optiblanc® LSN from 3V Inc., Weehawken, N.J., Tinopals® CBS SP Slurry 33, PLC, UNPA-GX, 4BM, 4BMS, 5BM, 5BMS, 5BM-GX, AMS-GX, DMS-X, DCS Liquid, K, ERN, LCS, LFW, and TAS, Univex®, SK, ERN, and AT, from Ciba, High Point, North Carolina, Blankophor® FBW, FB, LPG, and HRS, from Mobay. In addition to preventing auto-oxidation, some brighteners also prevent dye transfer.

(iii) Bluing Agents

Bluing agents also act to preserve whiteness by compensating for the yellow appearance by again adding a complementary color to the fabric and thus the undesired yellowing is no longer noticeable. Like optical brighteners, bluing agents replace this missing part of the spectrum and so a white appearance is retained. Typically the bluing agents are included at levels of at least about 0.005%, more preferably at 0.001% even more preferably at 0.005% and most preferably at least about 0.01% and less than about 10%, preferably less than about 5%, and more preferably less than about 1% by weight of the composition. Examples are Polar Brilliant Blue (Acid Blue 127:1), Liquitint Patent Blue, and Liquitint Blue 65, all from Milliken & Company and Acid Blue 80 from the Hilton-Davis Co., Cincinnati, Ohio. Oil soluble blue dyes and pigments can also be used.

(iv) UV Absorbers

Not to be bound by theory, but UV absorbers can operate by protecting the fabric and any unsaturated or polyunsaturated compound deposited on the fabric from UV exposure. UV light is know to initiate auto-oxidation processes and suprisingly, UV absorbers can be deposited on fabric in such a way that UV light is blocked from the fabric and fabric plus composition thus preventing the initiation of auto-oxidation.

Preferably the UV absorber compound absorbs light at a wavelength of from about 315 nm to about 400 nm and is a preferably solid having a melting point of from about 25° C. to about 75° C., more preferably from about 25° C. to about 50° C. UV absorbers are included at levels of at least about 0.005% preferably at least about 0.05% and less than about 10%, preferably less than about 5% by weight of the composition.

Preferably these UV absorber compounds contain at least one chromophore selected from the group consisting of:

(I)

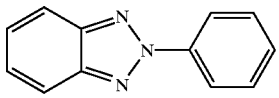

Phenylbenzotriazole (II)

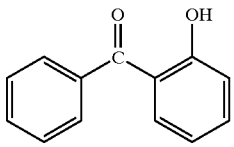

2-Hydroxybenzophenone

-continued (III)

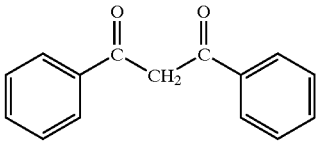

Dibenzoylmethane (IV)

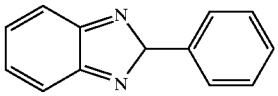

Phenylbenzimidazole (V)

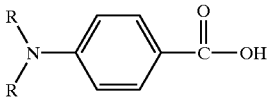

Esters of P-Aminobenzoic Acid (PABA)

(VI)

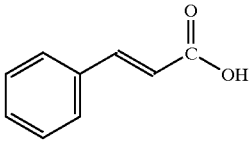

Esters of Cinnamic Acid (VII)

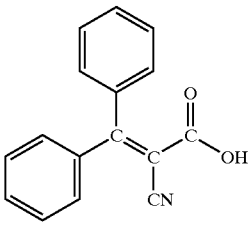

Esters of 2-Cyano-3, 3-diphenyl-2-Propenoic Acid (VIII)

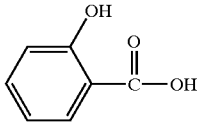

Esters of Salicylic Acid and (IX)

mixtures thereof;

wherein each R is a hydrogen, methyl, ethyl, $C_1$ to $C_{22}$ branched or straight chain alkyl group and mixtures thereof, preferably a methyl group; and wherein the compound containing the chromophore is a non-fabric staining, light stable compound containing preferably at least one $C_8$–$C_{22}$ hydrocarbon fatty organic moiety; wherein the chromophore absorbs light at a wavelength of from about 290 nm to about 450 nm; wherein the compound is a solid having a melting point of from about 25° C. to about 90° C. or, optionally, a viscous liquid at a temperature of less than about 40° C.

Preferably the UV absorber compound is a compound containing at least one chromophore selected from the group consisting of (I), (II), (III), (IV), (V), (VII), (VIII), and mixtures thereof; more preferably the UV absorber compound is a compound containing at least one chromophore selected from the group consisting of (I), (II), (III), (IV), and mixtures thereof; and even more preferably (I), (II), and mixtures thereof. Furthermore, compounds containing at least one formula (I) chromophore are especially preferred.

More preferably these UV absorber compounds are selected from the group consisting of:

(I)

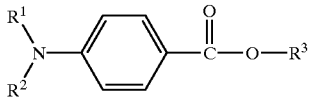

(II)

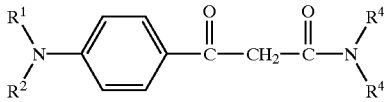

(III)

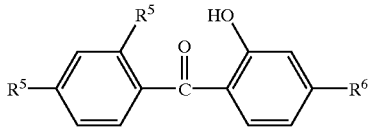

(IV)

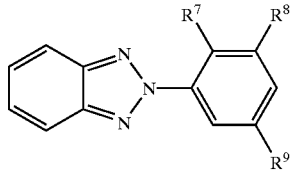

(V)

mixtures thereof;

wherein $R_1$ is a hydrogen or a $C_1$ to $C_{22}$ alkyl group; preferably a hydrogen or a methyl group;

$R^2$ is a hydrogen or a $C_1$ to $C_{22}$ alkyl group; preferably a hydrogen or methyl group;

$R^3$ is a $C_1$ to $C_{22}$ alkyl group; preferably a $C_8$ to $C_{18}$ alkyl group; more preferably a $C_{12}$ to $C_{18}$ alkyl group;

each $R^4$ is a hydrogen, a $C_1$ to $C_{22}$ alkyl group, and mixtures thereof; preferably a methyl group, a $C_8$ to $C_{22}$ alkyl group, and mixtures thereof, more preferably one $R^4$ is a $C_{10}$ to $C_{20}$ alkyl group, preferably a $C_{12}$ to $C_{18}$ alkyl group, and the other $R^4$ group is a methyl group;

each $R^5$ is a hydrogen, hydroxy group, a $C_1$ to $C_{22}$ alkyl group, (which can be an ester, amide, or ether interrupted group), and mixtures thereof, preferably a hydrogen, hydroxy group, and mixtures thereof, more preferably hydrogen;

$R^6$ is a hydrogen, hydroxy group, methoxy group, a $C_1$ to $C_{22}$ alkyl group, (which can be an ester, amide, or ether interrupted group), and mixtures thereof, preferably a $C_1$ to $C_{22}$ alkyl group with an ether or ester interrupted group, and mixtures thereof, more preferably a methoxy group, a $C_8$ to $C_{22}$ alkyl group with an ester interrupted group, and mixtures thereof;

$R^7$ is a hydrogen, hydroxy group, or a $C_1$ to $C_{20}$ alkyl group, preferably a hydrogen or a hydroxy group, more preferably a hydroxy group;

$R^8$ is a hydrogen, hydroxy group, or a $C_1$ to $C_{22}$ alkyl group, (which can be an ester, amide, or ether interrupted group); preferably a $C_1$ to $C_{22}$ alkyl group; more preferably a $C_1$ to $C_8$ alkyl group, and even more preferably a methyl group, a "tert"-amyl group, or a dodecyl group; and $R^9$ is a hydrogen, hydroxy group, or a $C_1$ to $C_{22}$ alkyl group, (which can be an ester, amide, or ether interrupted group); preferably a "tert"-amyl, methyl phenyl group, or a coco dimethyl butanoate group.

These UV absorber compounds absorb light at a wavelength of from about 290 nm to about 450 nm, preferably from about 31 Snm to about 400 nm.

$R_5$, $R_6$, $R_7$, $R_8$, and $R_9$ can be interrupted by the corresponding ester linkage interrupted group with a short alkylene ($C_1$–$C_4$) group.

Preferred UV absorber agents of the present invention are selected from the group consisting of fatty derivatives of PABA, benzophenones, cinnamic acid, and phenyl benzotriazoles, specifically, octyl dimethyl PABA, dimethyl PABA lauryl ester, dimethyl PABA oleoyl ester, benzophenone-3 coco acetate ether, benzophenone-3 available under the tradename Spectra-Sorb® UV-9 from Cyanamid, 2-(2'-Hydroxy-3', 5'-di-tert-amylphenyl benzotriazole which is available under the tradename Tinuving 328 from Ciba-Geigy, Tinuving coco ester 2-(2'-Hydroxy,3'-(coco dimethyl butanoate)-5'-methylphenyl) benzotriazole, and mixtures thereof. Preferred UV absorbers agents of the present invention are benzotriazole derivatives since these materials absorb broadly throughout the UV region. Preferred benzotriazole derivatives are selected from the group consisting of 2-(2'-Hydroxy, 3'-dodecyl, 5'-methylphenyl) benzotriazole available under the tradename Tinuvin® 571 (Ciba) available from Ciba-Geigy, and Coco 3-[3'-2H-benzotriazol-2'-yl)-5-tert-butyl-4'-hydroxyphenyl] propionate.

Other conventional UV absorbers can be used but are generally less suitable because they less effectively deposit on surfaces, sometimes discolor fabrics, are not always stable or compatible with other components in the composition, and are often expensive.

(y) Oxidative Stabilizers

Oxidative stabilizers can be present in the compositions of the present invention to prevent yellowing by acting as a scavenger for oxidative processes, thus preventing and/or terminating auto-oxidation or by reversing oxidation and thus reversing yellowing. The term "oxidative stabilizer," as used herein, includes antioxidants and reductive agents. These agents are present at a level of from 0% to about 2%, preferably from about 0.01% to about 0.2%, more preferably from about 0.03 5% to about 0.1% for antioxidants, and, preferably, from about 0.01% to about 0.2% for reductive agents.

Examples of antioxidants that can be added to the compositions and in the processing of this invention include a mixture of ascorbic acid, ascorbic palmitate, propyl gallate, available from Eastman Chemical Products, Inc., under the trade names Tenox® PG and Tenox® S-1; a mixture of BHtT (butylated hydroxytoluene), BRIA (butylated hydroxyanisole), propyl gallate, and citric acid, available from Eastman Chemical Products, Inc., under the trade name Tenoxe®-6; butylated hydroxytoluene, available from UOP Process Division under the trade name Sustane® BHtT; tertiary butylhydroquinone, Eastman Chemical Products, Inc., as Tenox® TBHQ; natural tocopherols, Eastman Chemical Products, Inc., as Tenox® GT-1/GT-2; and butylated hydroxyani sole, Eastman Chemical Products, Inc., as BHIA; long chain esters ($C_8$–$C_{22}$) of gallic acid, e.g., dodecyl gallate; Irganox® 1010; Irganox' 1035; Irganox® B 1171; Irganoxe 1425; Irganox® 3114; Irganox® 3125; and mixtures thereof; preferably Irganox® 3125, Irganox® 1425, Irganox® 3114, and mixtures thereof, more preferably Irganox® 3125 alone or mixed with citric acid and/or other chelators such as isopropyl citrate, Dequest® 2010, available from Monsanto with a chemical name of 1-hydroxyethylidene-1,1-diphosphonic acid (etidronic acid), and Tiron®, available from Kodak with a chemical name of 4,5-dihydroxy-m-benzene-sulfonic acid/sodium salt, and DTPA®, available from Aldrich with a chemical name of diethylenetriaminepentaacetic acid.

(vi) Combinations whiteness preservatives

Combinations of whiteness preservatives are also useful for the present invention.

(11) Mixtures Thereof

A variety of mixtures and combinations of optional supplemental wrinkle control agent, optional odor control agent, optional perfume, optional antimicrobial active, optional aminocarboxylate chelator, optional water-soluble polyionic polymer, optional antistatic agent, optional insect repellant, optional colorant, optional anti-clogging agent, can be used in the present polymer compositions.

II. Spray Pattern

Providing an optimal spray pattern is important to producing optimal performance in a wrinkle controlling spray composition that will be used to treat fabrics. The key parameter effective in minimizing staining and reducing dry time is to achieve uniform distribution of a liquid product over the surface area of the fabric. Uniform distribution in a spray pattern is measured as: the volume of product dispensed per unit of surface area and the standard deviation in the volume deposited per unit of surface area. To achieve uniform distribution, the dispenser chosen must be capable of producing an acceptable spray pattern that falls within the limits on volume of product dispensed per unit area and on the standard deviation in volume per unit surface area disclosed herein.

The composition must also meet certain requirements to achieve a good distribution pattern. Not to be bound by theory, but as the extensional viscosity of the product increases, it becomes more difficult for particles to separate on spraying and the cone angle of the spray collapses resulting in the liquid dispensing over a smaller area on the surface of the fabric, forcing the formation of 'hot spots' even when acceptable sprayers are used. Therefore, the product composition must meet certain requirements for extensional viscosity. The extensional viscosity is typically expressed as the Trouton ratio, that is the ratio of extensional viscosity to shear viscosity.

There are many techniques that can be used to measure the extensional rheology of fluids, and they usually fall into two categories. The first category contains "flow through" devices, and the second one contains "stagnation point" devices. Note that it is more accurate to call the measuring equipment "indexers" rather than "rheometers", since in the extensional measurement equipment the stress response is not usually free of extraneous stress contributions.

Most of the first devices rely on the fluid being spinnable, like the tubeless siphon, and spinning techniques. These techniques are usually limited to low rates of strain and to generally highly viscous or elastic fluids. Therefore, their applicability to spraying might be limited. Examples of the spinning techniques are fiber spinning, "falling droplet" or "filament stretching". Alternatively, orifice flow techniques, which measure the pressure drop across a contraction, can be used for fluids that cannot be spinned. However, the interpretation of the data is not straightforward even for Newtonian fluids. For non-Newtonian fluids, the difficulty is even more pronounced as recirculating vortices and viscoelastic instabilities are present. Other variations of the flow technique are those of flow through "packed beds" or "screen packs". Increased flow resistance through beds or packs indicates the presence of extensional viscosity. However, rather than measuring an absolute value, the flow through screen packs yields a relative index of extensional viscosity.

On the other hand, the stagnation point devices, such as the roll mill, lubricated-die converging flow rheometer, cross-slot cell, and the opposing jet device can be used to study the extensional behavior of low-viscosity fluids. The Rheometrics RFX rheometer (Rheometric Scientific Inc., Piscataway, N.J.) is an opposing-jet device that is commercially available. Finally, comparison of the extensional viscosity data from the various devices that were referred above is difficult due to the different strain history that each device subjects the sample to, it is expected that the viscosity results will be scattered considerably.

Sprayers that provide an acceptable spray pattern dispense a volume per unit surface area of less than about 0.07 ml/inch$^2$ (0.011 ml/cm$^2$); preferably less than about 0.05 ml/inch$^2$(0.0078 ml/cm$^2$); more preferably less than about 0.035 ml/inch$^2$ (0.0054 ml/cm$^2$); even more preferably less than about 0.025 ml/inch$^2$ (0.0039 ml/cm$^2$); and most preferably less than about 0.02 ml/inch$^2$ (0.0031 ml/cm$^2$); with a standard deviation in the volume per unit surface area of less than about 0.056 ml/inch$^2$ (0.0087 ml/cm$^2$); preferably less than about 0.05 ml/inch$^2$ (0.0078 ml/cm$^2$); more preferably less than about 0.03 ml/inch$^2$ (0.0047 ml/cm$^2$); even more preferably less than about 0.022 ml/inch$^2$ (0.0034 ml/cm$^2$); still more preferably less than about 0.02 ml/inch$^2$ (0.0031 ml/cm$^2$); most preferably less than about 0.018 ml/inch$^2$ (0.0028 ml/cm$^2$).

The Trouton ratio, at the extension and shear rates of less than about 20,000 s$^-$, should be less than about 10,000, preferably less than about 5,000, more preferably less than about 1,000, even more preferably less than about 500, and most preferably less than about 100.

Suitable spray dispensers used to provide the desired spray pattern herein include, but are not limited to, the Indesco T-8500 available from Continental Sprayers Inc.; the TS-800-2 and the TS-800-2E available from Calmar, Inc.

III. Article of Manufacture

The present invention also encompasses articles of manufacture comprising (1) a container, (2) composition, and (3) optionally, but preferably, instructions. A variety of containers, compositions, and instructions can be utilized in the present articles of manufacture as described hereinafter.

The articles of manufacture of the present invention further encompass articles of manufacture comprising (1) substrate, (2) composition, and (3) a set of instructions. In this embodiment, a variety of substrates, compositions, and instructions can be utilized as described hereinafter.

The present articles of manufacture preferably comprise a set of instructions that are typically in association with the container or substrate. The set of instructions typically communicates to the consumer of the present articles to dispense the composition in an amount effective to provide a solution to problems involving, and/or provision of a benefit related to, those selected from the group consisting of: killing or reducing the level of, microorganisms; reducing odors; and/or reducing static in addition to the reduction of wrinkles. It is important that the consumer of the present article be aware of these benefits, since otherwise the consumer would not know that the composition would solve these problems or combination of problems and/or provide these benefits or combination of benefits.

As used herein, the phrase "in association with" means the set of instructions are either directly printed on the container or substrate itself or presented in a separate manner including, but not limited to, a brochure, print advertisement, electronic advertisement, and/or broadcast communication, so as to communicate the set of instructions to a consumer of the article of manufacture. The set of instructions preferably comprises the instruction to apply an effective amount of the composition, preferably by spraying, to provide the indicated benefit, e.g., wrinkle reduction, and, optionally, antimicrobial action, and/or anti-static effect, etc. and, also optionally, the provision of odor control and/or reduction.

A more complete disclosure of the instructions is presented hereinafter.

(a) Container

The article of manufacture herein comprises a container, such as a spray dispenser. The fabric wrinkle control composition is placed into a spray dispenser in order to be distributed onto the fabric. Said spray dispenser for producing a spray of liquid droplets can be any of the manually activated means as is known in the art, e.g. trigger-type, pump-type, non-aerosol self-pressurized, and aerosol-type spray means, for treating the wrinkle control composition to small fabric surface areas and/or a small number of garments, as well as non-manually operated, powered sprayers for conveniently treating the wrinkle control composition to large fabric surface areas and/or a large number of garments. The spray dispenser herein does not normally include those that will substantially foam the clear, aqueous wrinkle control composition. It has been found that the performance is increased by providing smaller particle droplets. Desirably, the Sauter mean particle diameter is from about 10 $\mu$m to about 250 $\mu$m, more preferably, from about 20 $\mu$m to about 120 $\mu$m. Dewrinkling benefits are improved by providing small particles (droplets), as discussed hereinbefore, especially when the surfactant is present.

The spray dispenser can be an aerosol dispenser. Said aerosol dispenser comprises a container which can be constructed of any of the conventional materials employed in fabricating aerosol containers. The dispenser must be capable of withstanding internal pressure in the range of from about 20 to about 110 p.s.i.g., more preferably from about 20 to about 70 p.s.i.g. The one important requirement concerning the dispenser is that it be provided with a valve member which will permit the clear, aqueous dewrinkle composition contained in the dispenser to be dispensed in the form of a spray of very fine, or finely divided, particles or droplets. The aerosol dispenser utilizes a pressurized sealed container from which, e.g., the clear, aqueous wrinkle control composition is dispensed through a special actuator/valve assembly under pressure. The aerosol dispenser is pressurized by incorporating therein a gaseous component generally known as a propellant. Common aerosol propellants, e.g., gaseous hydrocarbons such as isobutane, and mixed halogenated hydrocarbons, can be used. Halogenated hydrocarbon propellants such as chlorofluoro hydrocarbons have been alleged to contribute to environmental problems, and are not preferred. When cyclodextrin is present hydrocarbon propellants are not preferred, because they can form complexes with the cyclodextrin molecules thereby reducing the availability of uncomplexed cyclodextrin molecules for odor absorption. Preferred propellants are compressed air, nitrogen, inert gases, carbon dioxide, etc. A more complete description of commercially available aerosol-spray dispensers appears in U.S. Pat. No. : 3,436,772, Stebbins, issued April 8, 1969; and U.S. Pat. No. 3,600,325, Kaufman et al., issued Aug. 17, 1971; both of said references are incorporated herein by reference.

Preferably the spray dispenser can be a self-pressurized non-aerosol container having a convoluted liner and an elastomeric sleeve. Said self-pressurized dispenser comprises a liner/sleeve assembly containing a thin, flexible radially expandable convoluted plastic liner of from about 0.010 to about 0.020 inch thick, inside an essentially cylindrical elastomeric sleeve. The liner/sleeve is capable of holding a substantial quantity of wrinkle control composition product and of causing said product to be dispensed. A more complete description of self-pressurized spray dispensers can be found in U.S. Pat. No. 5,111,971, Winer, issued May 12, 1992, and U.S. Pat. No. 5,232,126, Winer, issued Aug. 3, 1993; both of said references are herein incorporated by reference. Another type of aerosol spray dispenser is one wherein a barrier separates the wrinkle control composition from the propellant (preferably compressed air or nitrogen), as disclosed in U.S. Pat. No. 4,260,110, issued Apr. 7, 1981, and incorporated herein by reference. Such a dispenser is available from EP Spray Systems, East Hanover, N.J.

More preferably, the spray dispenser is a non-aerosol, manually or non-manually activated, pump-spray dispenser. Said pump-spray dispenser comprises a container and a pump mechanism which securely screws or snaps onto the container. The container comprises a vessel for containing the aqueous wrinkle control composition to be dispensed.

The pump mechanism comprises a pump chamber of substantially fixed volume, having an opening at the inner end thereof. Within the pump chamber is located a pump stem having a piston on the end thereof disposed for reciprocal motion in the pump chamber. The pump stem has a passageway there through with a dispensing outlet at the outer end of the passageway and an axial inlet port located inwardly thereof.

The container and the pump mechanism can be constructed of any conventional material employed in fabricating pump-spray dispensers, including, but not limited to: polyethylene; polypropylene; polyethyleneterephthalate; blends of polyethylene, vinyl acetate, and rubber elastomer. A preferred container is made of clear, e.g., polyethylene terephthalate. Other materials can include stainless steel. A more complete disclosure of commercially available dispensing devices appears in: U.S. Pat. No. : 4,895,279, Schultz, issued Jan. 23, 1990; U.S. Pat. No. 4,735,347, Schultz et al., issued Apr. 5, 1988; and U.S. Pat. No. 4,274,560, Carter, issued Jun. 23, 1981; all of said references are herein incorporated by reference.

Most preferably, the spray dispenser is a manually activated trigger-spray dispenser. Said trigger-spray dispenser comprises a container and a trigger both of which can be constructed of any of the conventional material employed in fabricating trigger-spray dispensers, including, but not limited to: polyethylene; polypropylene; polyacetal; polycarbonate; polyethyleneterephthalate; polyvinyl chloride; polystyrene; blends of polyethylene, vinyl acetate, and rubber elastomer. Other materials can include stainless steel and glass. A preferred container is made of clear, e.g. polyethylene terephthalate. The trigger-spray dispenser does not incorporate a propellant gas into the odor-absorbing composition, and preferably it does not include those that will foam the wrinkle control composition. The trigger-spray dispenser herein is typically one which acts upon a discrete amount of the wrinkle control composition itself, typically by means of a piston or a collapsing bellows that displaces the composition through a nozzle to create a spray of thin liquid. Said trigger-spray dispenser typically comprises a pump chamber having either a piston or bellows which is movable through a limited stroke response to the trigger for varying the volume of said pump chamber. This pump chamber or bellows chamber collects and holds the product for dispensing. The trigger spray dispenser typically has an outlet check valve for blocking communication and flow of fluid through the nozzle and is responsive to the pressure inside the chamber. For the piston type trigger sprayers, as the trigger is compressed, it acts on the fluid in the chamber and the spring, increasing the pressure on the fluid. For the bellows spray dispenser, as the bellows is compressed, the pressure increases on the fluid. The increase in fluid pressure in either trigger spray dispenser acts to open the top outlet check valve. The top valve allows the product to be forced through the swirl chamber and out the nozzle to form a discharge pattern. An adjustable nozzle cap can be used to vary the pattern of the fluid dispensed.

For the piston spray dispenser, as the trigger is released, the spring acts on the piston to return it to its original position. For the bellows spray dispenser, the bellows acts as the spring to return to its original position. This action causes a vacuum in the chamber. The responding fluid acts to close the outlet valve while opening the inlet valve drawing product up to the chamber from the reservoir.

A more complete disclosure of commercially available dispensing devices appears in U.S. Pat. No. 4,082,223, Nozawa, issued Apr. 4, 1978; U.S. Pat. No. 4,161, 288, McKinney, issued Jul. 17, 1985; U.S. Pat. No. 4,434,917, Saito et al., issued Mar. 6, 1984; and 4,819,835, Tasaki, issued Apr. 11, 1989; U.S. Pat. No. 5,303,867, Peterson, issued Apr. 19, 1994; all of said references are incorporated herein by reference.

A broad array of trigger sprayers or finger pump sprayers are suitable for use with the compositions of this invention. These are readily available from suppliers such as Calmar, Inc., City of Industry, California; CSI (Continental Sprayers, Inc.), St. Peters, Missouri; Berry Plastics Corp., Evansville, Indiana, a distributor of Guala® sprayers; or Seaquest Dispensing, Cary, Ill.

The preferred trigger sprayers include, but are not limited to, the Indesco T-8500 available from Continental Sprayers Inc.; the TS-800-2 and the TS-800-2E available from Calmar, Inc., because of the fine uniform spray characteristics, spray volume, and pattern size. More preferred are sprayers with precompression features and finer spray characteristics and even distribution, such as Yoshino sprayers from Japan. Any suitable bottle or container can be used with the trigger sprayer. It can be made of any materials such as high density polyethylene, polypropylene, polyvinyl chloride, polystyrene, polyethylene terephthalate, glass, or any other material that forms bottles. Preferably, it is made of high density polyethylene or clear polyethylene terephthalate.

For smaller fluid ounce sizes (such as 1 to 8 ounces), a finger pump can be used with canister or cylindrical bottle. The preferred pump for this application is the cylindrical Euromist II® from Seaquest Dispensing. More preferred are those with precompression features.

The article of manufacture herein can also comprise a non-manually operated spray dispenser. By "non-manually operated" it is meant that the spray dispenser can be manually activated, but the force required to dispense the wrinkle control composition is provided by another, non-manual means. Non-manually operated sprayers include, but are not limited to, powered sprayers, air aspirated sprayers, liquid aspirated sprayers, electrostatic sprayers, and nebulizer sprayers. The wrinkle control composition is placed into a spray dispenser in order to be distributed onto the fabric.

Powered sprayers include self contained powered pumps that pressurize the aqueous dewrinkle composition and dispense it through a nozzle to produce a spray of liquid droplets. Powered sprayers are attached directly or remotely through the use of piping/tubing to a reservoir (such as a bottle) to hold the aqueous wrinkle control composition.

Powered sprayers can include, but are not limited to, centrifugal or positive displacement designs. It is preferred that the powered sprayer be powered by a portable DC electrical current from either disposable batteries (such as commercially available alkaline batteries) or rechargeable battery units (such as commercially available nickel cadmium battery units). Powered sprayers can also be powered by standard AC power supply available in most buildings. The discharge nozzle design can be varied to create specific spray characteristics (such as spray diameter and particle size). It is also possible to have multiple spray nozzles for different spray characteristics. The nozzle may or may not contain an adjustable nozzle shroud that would allow the spray characteristics to be altered.

Nonlimiting examples of commercially available powered sprayers are disclosed in U.S. Pat. No. 4,865,255, Luvisotto, issued Sep. 12, 1989 which is incorporated herein by reference. Preferred powered sprayers are readily available from suppliers such as Solo, Newport News, Virginia (e.g., Solo Spraystar™ rechargeable sprayer, listed as manual part #: US 460 395) and Multi-sprayer Systems, Minneapolis, Minn. (e.g., model: Spray 1).

Air aspirated sprayers include the classification of sprayers generically known as "air brushes". A stream of pressurized air draws up the aqueous wrinkle control composition and dispenses it through a nozzle to create a spray of liquid. The wrinkle control composition can be supplied via separate piping/tubing or more commonly is contained in a jar to which the aspirating sprayer is attached.

Nonlimiting examples of commercially available air aspirated sprayers appears in U.S. Pat. No. 1,536,352, Murray, issued Apr. 22, 1924 and U.S. Pat. No. 4,221,339, Yoshikawa, issues Sep. 9, 1980; all of said references are incorporated herein by reference. Air aspirated sprayers are readily available from suppliers such as The Badger Air-Brush Co., Franklin Park, Ill. (e.g., model #: 155) and Wilton Air Brush Equipment, Woodridge, Ill. (e.g., stock #: 415-4000, 415-4001, 415-4100).

Liquid aspirated sprayers are typical of the variety in widespread use to spray garden chemicals. The aqueous dewrinkling composition is drawn into a fluid stream by means of suction created by a Venturi effect. The high turbulence serves to mix the aqueous wrinkle control composition with the fluid stream (typically water) in order to provide a uniform mixture/concentration. It is possible with this method of delivery to dispense the aqueous concentrated wrinkle control composition of the present invention and then dilute it to a selected concentration with the delivery stream.

Liquid aspirated sprayers are readily available from suppliers such as Chapin Manufacturing Works, Batavia, New York (e.g., model #: 6006).

Electrostatic sprayers impart energy to the aqueous dewrinkling composition via a high electrical potential. This energy serves to atomize and charge the aqueous wrinkle control composition, creating a spray of fine, charged particles. As the charged particles are carried away from the sprayer, their common charge causes them to repel one another. This has two effects before the spray reaches the target. First, it expands the total spray mist. This is especially important when spraying to fairly distant, large areas. The second effect is maintenance of original particle size. Because the particles repel one another, they resist collecting together into large, heavier particles like uncharged particles do. This lessens gravity's influence, and increases the charged particle reaching the target. As the mass of negatively charged particles approach the target, they push electrons inside the target inwardly, leaving all the exposed surfaces of the target with a temporary positive charge. The resulting attraction between the particles and the target overrides the influences of gravity and inertia. As each particle deposits on the target, that spot on the target becomes neutralized and no longer attractive. Therefore, the next free particle is attracted to the spot immediately adjacent and the sequence continues until the entire surface of the target is covered. Hence, charged particles improve distribution and reduce drippage.

Nonlimiting examples of commercially available electrostatic sprayers appears in U.S. Pat. No. 5,222,664, Noakes, issued Jun. 29, 1993; U.S. Pat. No. 4,962,885, Coffee, issued Oct. 16, 1990; U.S. Pat. No. 2,695,002, Miller, issued Nov. 1954; U.S. Pat. No. 5,405,090, Greene, issued Apr. 11, 1995; U.S. Pat. No. 4,752,034, Kuhn, issued Jun. 21, 1988; U.S. Pat. No. 2,989,241, Badger, issued Jun. 1961; all of said patents are incorporated herein by reference. Electrostatic sprayers are readily available from suppliers such as Tae In Tech Co, South Korea and Spectrum, Houston, Tex.

Nebulizer sprayers impart energy to the aqueous dewrinkling composition via ultrasonic energy supplied via a transducer. This energy results in the aqueous wrinkle control composition to be atomized. Various types of nebulizers include, but are not limited to, heated, ultrasonic, gas, venturi, and refillable nebulizers.

Nonlimiting examples of commercially available nebulizer sprayers appears in U.S. Pat. No. 3,901,443, Mitsui, issued Aug. 26, 1975; U.S. Pat. No. 2,847,248, Schmitt, issued Aug. 1958; U.S. Pat. No. 5,511,726, Greenspan, issued Apr. 30, 1996; all of said patents are incorporated herein by reference. Nebulizer sprayers are readily available from suppliers such as A&D Engineering, Inc., Milpitas, Calif. (e.g., model A&D Un-23 1 ultrasonic handy nebulizer) and Amici, Inc., Spring City, Pa. (model: swirler nebulizer).

The preferred article of manufacture herein comprises a non-manually operated sprayer, such as a battery-powered sprayer, containing the aqueous wrinkle control composition. More preferably the article of manufacture comprises a combination of a non-manually operated sprayer and a separate container of the aqueous wrinkle control composition, to be added to the sprayer before use and/or to be separated for filling/refilling. The separate container can contain an usage composition, or a concentrated composition to be diluted before use, and/or to be used with a diluting sprayer, such as with a liquid aspirated sprayer, as described herein above.

Also, as described hereinbefore, the separate container should have structure that mates with the rest of the sprayer to ensure a solid fit without leakage, even after motion, impact, etc. and when handled by inexperienced consumers. The sprayer desirably can also have an attachment system that is safe and preferably designed to allow for the liquid container to be replaced by another container that is filled. E.g., the fluid reservoir can be replaced by a filled container. This can minimize problems with filling, including minimizing leakage, if the proper mating and sealing means are present on both the sprayer and the container. Desirably, the sprayer can contain a shroud to ensure proper alignment and/or to permit the use of thinner walls on the replacement container. This minimizes the amount of material to be recycled and/or discarded. The package sealing or mating system can be a threaded closure (sprayer) which replaces the existing closure on the filled and threaded container. A gasket is desirably added to provide additional seal security and minimize leakage. The gasket can be broken by action of the sprayer closure. These threaded sealing systems can be based on industry standards. However, it is highly desirable to use a threaded sealing system that has non-standard dimensions to ensure that the proper sprayer/bottle combination is always used. This helps prevent the use of fluids that are toxic, which could then be dispensed when the sprayer is used for its intended purpose.

An alternative sealing system can be based on one or more interlocking lugs and channels. Such systems are commonly referred to as "bayonet" systems. Such systems can be made in a variety of configurations, thus better ensuring that the proper replacement fluid is used. For convenience, the locking system can also be one that enables the provision of a "child-proof" cap on the refill bottle. This "lock-and-key" type of system thus provides highly desirable safety features. There are a variety of ways to design such lock and key sealing systems.

Care must be taken, however, to prevent the system from making the filling and sealing operation too difficult. If desired, the lock and key can be integral to the sealing mechanism. However, for the purpose of ensuring that the correct recharge or refill is used, the interlocking pieces can be separate from the sealing system. E.g., the shroud and the container could be designed for compatibility. In this way, the unique design of the container alone could provide the requisite assurance that the proper recharge/refill is used.

Examples of threaded closures and bayonet systems can be found in U.S. Pat. No. 4,781,311, Nov. 1, 1988 (Angular Positioned Trigger Sprayer with Selective Snap-Screw Container Connection, Clorox), U.S. Pat. No. 5,560,505, Oct. 1, 1996 (Container and Stopper Assembly Locked Together by Relative Rotation and Use Thereof, Cebal SA), and U.S. Pat. No. 5,725,132, Mar. 10, 1998 (Dispenser with Snap-Fit Container Connection, Centico International). All of said patents are incorporated herein by reference.

(b) Substrate

Wrinkle controlling compositions can be placed onto or into a substrate that will contain it until time of use. At the time of use, the article of manufacture (composition plus substrate) is placed into a machine or instrument used to change the physical nature and/or appearance of clothes, fabrics, or fibers. Nonlimiting examples of such machines or instruments include commercial clothes dryers, home clothes dryers, or baths used to finish fabrics in commercial fabric mills. The substrate can be any type of container constructed of any materials that adequately encloses the composition and contains it in a stable form until time of use.

The substrate is also required to release the compostion during use in the machine or instrument. A preferred substrate will release the said composition in a uniform manner over all clothes, fabrics, or fibers in the machine or instrument. A preferred substrate will release the composition in such a way so as to prevent perceptible staining on clothes, fabrics, or fibers after the composition dries.

Substrates can have many geometries, including, but not limited to, essentially three-dimensional objects (e.g. spherical, cylindrical, rectangular, square, polygonal, irregular, etc.), essentially two dimensional objects (planar, circular, plus-shaped, etc.). The preferred dimensionalities and shapes promote good distribution of composition on fabric in the mechanical device used to modify the physical properties of the clothes, fabric, or fiber. As a nonlimiting example, the dimensionality and shape of the substrate used in a clothes dryer should promote even movement between and around all clothes in the dryer to attain uniform distribution of the said composition.

Substrates can be made of many materials or combinations of materials, including, but not limited to, plastics, natural or synthetic woven or nonwoven fibers. Nonlimiting examples of substrates include those described in the following, which are hereby incorporated by reference: U.S. Pat. No. 3,956,556 issued May 11, 1976 to McQueary; U.S. Pat. No. 5,376,287 issued Dec. 27, 1994 to Borcher et al.; U.S. Pat. No. 5,470,492 issued Nov. 28, 1995 to Childs et al.; U.S. Pat. No. 5,630,848 issued May 20, 1997 to Young et al; U.S. Pat. No. 5,376,287 issued May 27, 1997 to Siklosi; U.S. Pat. No. 5,804,548 issued Sep. 8, 1998 to Davis; U.S. Pat. No. 5,840,675 issued Nov. 24, 1998 to Yeazell; U.S. Pat. No. 5,883,069 issued March 16, 1999 to Childs et al.

(c) Composition

The present article of manufacture can comprise a wrinkle controlling composition according to the compositions described hereinbefore in Section I. The present compositions are preferably held in a container such as spray dispenser to easily dispense the compositions onto fabrics to be treated. The present compositions can also be incorporated into substrates, preferably used for treating fabrics in a laundry dryer, as described herein.

(d) Set of Instructions

As discussed hereinbefore, the article of manufacture can also comprise the composition of the present invention in a container in association with a set of instructions to use the composition in an amount effective to provide a solution to problems involving and/or provision of a benefit related to those selected from the group consisting of: killing or reducing microbes; reducing odor; reducing time and/or effort involved in ironing fabrics, and/or reducing static in addition to the reduction in wrinkles. It is important that the consumer be aware of these additional benefits, since otherwise the consumer would not know that the composition would solve these problems and/or provide these benefits.

As used herein, the phrase "in association with" means the set of instructions are either directly printed on the container itself or presented in a separate manner including, but not limited to, a brochure, print advertisement, electronic advertisement, and/or verbal communication, so as to communicate the set of instructions to a consumer of the article of manufacture. The set of instructions preferably comprises the instruction to apply an effective amount of the composition, preferably by spraying, to provide the indicated benefit, e.g. wrinkle reduction, antimicrobial action, static effect, and/or reduction in time and/or effort of ironing and, optionally, the provision of the main effect of odor control and/or reduction.

The set of instructions of the present articles can comprise the instruction or instructions to achieve the benefits discussed herein by carrying out any of the methods of using wrinkle controlling compositions, including the present silicone oil emulsion compositions, as described herein.

IV. Method of Use

A wrinkle controlling composition as described hereinbefore, which comprises carboxylic acid polymer and optional components, e.g., antimicrobial compound, etc., can be used by distributing, e.g., by placing, an effective amount of the aqueous solution onto the surface or article to be treated. Distribution can be achieved by using a spray device, a substrate, a roller, a pad, etc., substrates (as disclosed herein) and spray dispensers are preferred for distributing wrinkle composition. For wrinkle control, an effective amount means an amount sufficient to remove or noticeably reduce the appearance of wrinkles on fabric. For odor control, an effective amount, as defined herein, means an amount sufficient to absorb odor to effect a noticeable reduction in the perceived odor, preferably to the point that it is not discernible, by the human sense of smell. For static control an effective amount, as defined herein, means and amount sufficient to noticeably reduce voltage on fabrics and cling between fabrics. Preferably, the amount of solution is not so much as to saturate or create a pool of liquid on said article or surface and so that when dry there is no visual deposit readily discernible. Preferably, the present invention does not encompass distributing the composition onto non-fabric surfaces. However when optional cyclodextrin in the composition it can be used on other surfaces for odor control. However, care should be taken when treating such composition on shiny surfaces including, e.g., chrome, glass, smooth vinyl, leather, shiny plastic, shiny wood, etc., because spotting and filming can occur on such surfaces. However, when appearance is not important, the composition of the present invention containing optional cyclodextrin can be sprayed onto shiny surfaces to obtain odor control benefit. Although the cyclodextrin solution can be used on human skin, care should be taken, especially when an antimicrobial active is present in the composition.

The compositions and articles of the present invention which contain a fabric wrinkle control agent can be used to treat fabrics, garments, household fabrics, e.g. curtains, bed spreads, pillowcases, table clothes, napkins, and the like to remove or reduce, undesirable wrinkles, in addition to the optional removal or reduction of undesirable odor on said objects.

An effective amount of the liquid composition of the present invention is preferably sprayed onto fabrics, particularly clothing. When the composition is sprayed onto fabric, an effective amount should be deposited onto the fabric, with the fabric becoming damp or totally saturated with the composition, at least where the wrinkle exists, typically from about 5% to about 150%, preferably from about 10% to about 100%, more preferably from about 20% to about 75%, by weight of the fabric. The amount of polymer active typically sprayed onto the fabric is from about 0.001% to about 2%, preferably from about 0.01% to about 0.5%, more preferably from about 0.02% to about 0.2%, by weight of the fabric. Once an effective amount of the composition is sprayed onto the fabric the fabric is optionally, but preferably stretched while still damp. The fabric is typically stretched perpendicular to the wrinkle, where the wrinkle has a clearly defined line. The fabric can also be smoothed by hand after it has been sprayed and is still damp. In some cases, it is acceptable to simply hang the fabric, while still damp on a hanger or clothes line without further manipulation by hand after spraying. The smoothing movement works particularly well on areas of fabrics that have an interface sewn into them, or on the hems of fabric. Once the fabric has been sprayed and optionally, but preferably, stretched or smoothed, it is hung until dry or maintained under stress to reduce the reappearance of the wrinkle.

The compositions of the present invention can also be used as ironing aids. An effective amount of the composition can be sprayed onto fabric and the fabric is ironed at the normal temperature at which it should be ironed. The fabric can either be sprayed with an effective amount of the composition, allowed to dry and then ironed, or sprayed and ironed immediately. In another aspect of the invention, the composition can be poured directly into an iron or other hand-held device for dewrinkling and delivered to the fabric from that device. In a still further aspect of the invention, the composition can be sprayed onto fabrics in an in-home de-wrinkling chamber containing the fabric to be dewrinkled and/or optionally deodorized, thereby providing ease of operation. Conventional personal as well as industrial deodorizing and/or de-wrinkling apparatuses are suitable for use herein. Traditionally, these apparatuses act by a steaming process which effects a relaxation of the fibers. Examples of home dewrinkling chambers include shower stalls. The spraying of the composition or compounds onto the fabrics can then occur within the chamber of the apparatus or before placing the fabrics into the chamber. Again, the spraying means should preferably be capable of providing droplets with a weight average diameter of greater than about 8 $\mu$ and preferably greater than about 10 $\mu$m and typically less than about 200 Jim more preferably less than about 150 $\mu$m even more preferably less than about 100 $\mu$m, and most preferably less to about 50 $\mu$m. Preferably, the loading of moisture on fabrics made of natural and synthetic fibers is typically greater than about 2% more preferably greater than about 5% and typically below about 40%, preferably below about 30% and more preferably below about 25%, and most preferably below about 10% by weight of the dried fabric. Other conventional steps that can be carried out in the dewrinkling apparatus can be applied such as heating and drying. Preferably, for optimum dewrinkling benefit, the temperature profile inside the chamber ranges from about 40° C. to about 80° C., more preferably from about 50° C. to about 70° C. The preferred length of the drying cycle is from about 15 to about 60 minutes, more preferably from about 20 to about 45 minutes.

Distribution from a substrate is achieved by placing the substrate in a machine or instrument intended to modify the physical properties of clothes, fabrics, or fibers. A nonlimiting example of such a machine is a home or commercial clothes dryer. Distribution from the substrate in a clothes dryer is achieved via direct contact with clothes therefore, it is important that the substrate migrate evenly around the drum of the dryer and uniformly contact all the clothes, fabric, or fiber surfaces. To enhance uniform distribution from the substrate in a clothes dryer, it is preferably to run the clothes dryer for at least about 10 minutes.

Distribution in the dryer can be accomplished by spraying or misting clothes using a variety of spraying or misting equipment, including, but not limited to, all types of sprayers disclosed hereinbefore, as well as other mechanical devices, e.g. paint sprayers, or any dispensing device that may be mounted in a dryer by a user or incorporated by the manufacturer of the dryer.

The steaming step in the dewrinkling apparatus can also be eliminated while obtaining the benefits, if the composition is maintained within a temperature range from about 22° C. (about 72° F.) to about 76° C. (about 170° F.) before spraying.

The compositions herein are especially useful, when used to treat garments for extending the time before another wash cycle is needed. Such garments include uniforms and other garments which are normally treated in an industrial process, which can be dewrinkled and/or refreshed and the time between treatments extended.

The presence of the highly preferred surfactant promotes spreading of the solution and the highly preferred antimicrobial active provides improved odor control as well as antimicrobial action, by minimizing the formation of odors. Both the surfactant and the antimicrobial active provide improved performance and the mixture is especially good. When the compositions are applied in the form of the very small particles (droplets), as disclosed hereinbefore, additional benefits are found, since the distribution is even further improved and overall performance is improved.

Fabrics can be treated with wrinkle controlling compositions in either the dry state or a wet state. For some situations it is preferable to treat garments or fabrics while those garments or fabrics are dry. For instance, if the fabric is already dry and/or in place where removal would be difficult, e.g., if the wrinkle controlling composition will be used to smooth window curtains or shower curtains that are already hanging or bed clothes that are already on the bed, or dry clothes with minor wrinkles that will be worn soon, it is preferable to treat these items in the already dry state. A particularly preferred situation involves dry clothing or fabrics that have wrinkles caused by compression, e.g. stored in tight containers (suitcases, trunks), compressed in tight spaces (closets, cabinets), left for some period of time after the end of the drying cycle in an automatic clothes dryer, and/or wrinkled after in-wear conditions. For some situations it may be preferable to treat the fabrics while they are in the wet state before they are dry to simplify smoothing. For instance a consumer will normally find it convenient to treat fabrics as these fabrics are being hung to dry on a line or a hanger, e.g., when hand washing garments it is often more convenient to treat the garment just after the rinse and before drying. In general, for wrinkle controlling compositions treating in the wet state is preferable because the active from the wrinkle controlling compositions spreads better on wet fabrics vs. dry fabrics, since the dry fabrics will absorb some of the water and/or solvent, thus decreasing the mobility of the actives.

If the wrinkle controlling compositions show any separation, it will be desirable to shake well before using to guarantee good distribution and consistent dosing. The sprayer tip is then moved to the position marked "on" or to the position that is marked indicating the sprayer stream will be released when the triggering mechanism is activated. There can be more than one position marked to indicate different rates of delivery, or spray patterns. The stream with the desired characteristics is chosen. When treating the garments with the wrinkle controlling compositions herein it is recommended to hold the distribution means, e.g., a spray bottle, with the nozzle pointed towards the garment with the nozzle typically at distances where the lower distance from the fabric is at least about 2 inches from the fabric, preferably at least about 3 inches from the fabric, more preferably at least about 4 inches from the fabric, still more preferably at least about 5 inches from the fabric and most preferably at least about 6 inches from the fabric, while the upper distance from fabric is less than about 15 inches, preferably less than about 12 inches, more preferably less than about 10 inches, still more preferably less than about 9 inches and most preferably less than about 8 inches. Typically, wrinkle controlling compositions should be applied in a manner that achieves even coverage over the entire fabric surface. While it is acceptable to treat the overall garment using a discrete spraying action e.g. spray a spot on a fabric and then move to another spot on the fabric and spray, it is preferably to spray fabrics using a sweeping motion over the fabric to aid maximum spreading and coverage of the wrinkle controlling composition. This even distribution is conveniently achieved by using a powered sprayer e.g. battery or electrical powered. In cases where more difficult wrinkles exist on the fabrics, it is usually desirable to concentrate a higher dose of wrinkle controlling composition on these wrinkled sites vs. the bulk of the fabric. For garments that have a few lighter wrinkles, it is normally preferable to apply wrinkle controlling compositions generally over these sites. However, it is acceptable to treat only the part of a fabric that will be visible, e.g., the front of a shirt where only the front will be visible since the back will be covered by a jacket.

When dry fabrics are treated with the wrinkle controlling compositions, the amount of wrinkle controlling composition that should be used is dependent on several factors including, but not limited to, the weight of the fabric, the type of fabric, and the type of wrinkle in the fabric. Fabrics can have several types of wrinkles. One type of is wrinkle is characterized by its relative depth and sharpness. Such wrinkles are difficult to remove and require more of wrinkle controlling compositions and more work by the user to remove. When fabrics have such tough to remove wrinkles or the fabric is heavy, wrinkle controlling compositions are typically applied at lower levels of at least about 0.01 times the weight of the fabric, preferably at least about 0.1 time the weight of the fabric, more preferably at least about 0.25 times the weight of the fabric and at higher levels of about 2 times the weight of the fabric, more preferably about 1.5 times the weight of the fabric, even more preferably about I times the weight of the fabric and most preferably about 0.75 times the weight of the fabric.

Another type of wrinkle is characterized by its broad nature and lack of depth; such wrinkles are often referred to as "bumpiness", "waviness", or "rumples". Such wrinkles are often less difficult to remove than the sharp type of wrinkle discussed above. When fabrics are lighter in weight or have wrinkles that are less difficult to remove wrinkle controlling compositions are typically applied at lower levels of about 0.001 times the weight of the fabric, preferably about 0.01 times the weight of the fabric, more preferably about 0.05 times the weight of the fabric, even more preferably about 0.1 times the weight of the fabric and most preferably about 0.25 times the weight of the fabric and at higher levels of about 1.5 times the weight of the fabric, preferably about 1 times the weight of the fabric, more preferably about 0.75 times the weight of the fabric and most preferably about 0.5 times the weight of the fabric.

After fabrics are treated with the wrinkle controlling composition , there are several manipulations that can be employed to aid in controlling the wrinkles. The garments can be stretched both perpendicular and parallel to the wrinkle (or at any angle around the wrinkle) which will help to ease the wrinkle out of the clothing. Stretching the fabrics in a direction perpendicular to the line of the wrinkle is especially helpful in removing the wrinkle from clothing. The fabrics can also be smoothed using the hands with pressing and gliding motions similar to those employed with an iron. The stretching and/or smoothing procedure can be performed with the garment hung vertically, e.g., on a clothes hanger or spread on a horizontal surface, such as, a bed, an ironing board, a table surface, and the like. Another method to loosen wrinkles after treating involves shaking out fabrics with enough energy to loosen wrinkles, in some cases it may be necessary to impart enough energy to cause the fabric to make a snapping noise or motion. The wrinkles could also be manipulated out of the fabric using an implement designed to help smooth the fabrics. Such an implement would be useful in preventing contacts between hands and wrinkle controlling composition, if desired. Many fabrics or garments also contain bends in the fabrics, often termed creases or pleats, that are desireable. Such creases or pleats are often found on the front of pant legs and the sides of sleeves. These can be reinforced while the garment is being shaped to preseve the crease. Creases are reinforced by applying pressure usually by pinching the fabric either with hands or an implement and pulling the crease through the pressure point or by hanging the garment so that it folds at the crease and reinforces it with the pressure of gravity. The fabric should then be laid out flat to dry or hung on a hanger or with some other apparatus such that the fabric will remain smooth while drying. Weights can be attached to critical points on fabrics and garments to aid in maintaining smooth appearance during drying. Depending on the amount of product used to treat the garment and the weight of the garment, the garment should be dried in air for an upper time of less than about 24 hours, preferably less than about 12 hours, more preferably less than about 6 hours, still more preferably less than about 3 hours, and most preferably equal to or less than about 2 hours and the lower limit of drying time is equal to or greater than about 5 minutes, preferably greater than about 10 minutes, more preferably equal to or greater than about 15 minutes, still more preferably greater than or equal to about 30 minutes and most preferably greater than or equal to about 60 minutes. It is preferable to let fabrics that were very wet prior to treating with the wrinkle controlling composition dry for longer periods. It is also preferable to let fabrics that are treated with higher amounts of the wrinkle controlling composition dry for longer periods of time.

It is preferable to assist the drying, either by heating, or blowing air across the fabric surface, or both. Thus, at times it is desirable to follow the use of wrinkle controlling composition by treating the fabric with an appliance that can help dry the clothes. Nonlimiting examples of such appliances are clothes dryers and hand-held hair dryers. The wrinkle controlling composition, in combination with an appliance, can be used on both dry or wet fabrics. For instance, when clothes are dried in a clothes dryer and then inadvertently left in the clothes dryer or in a laundry basket or piled on some surface or in some container with out folding, both wet and dry clothes can become badly wrinkled. To remedy this situation, the wrinkle controlling composition can be used in combination with a clothes dryer to remove wrinkles from single fabrics or garments as well as batches, or loads, of fabrics and garments. Drying with low-heat or cool air is preferred for fabrics that normally have a tendency to shrink, such as wool, silk, rayon, and the like.

The wrinkle controlling composition can be delivered to the clothes dryer by many means. The wrinkle controlling composition can be sprayed onto fabrics or garments prior to adding fabrics or garments to the dryer, sprayed on fabrics or garments while the fabrics or garments are in the dryer, poured directly on the batch of garments and fabrics, or poured on one of the fabrics or garments. A particularly preferred way to deliver the composition in the clothes dryer so as to achieve even distribution is to direct a spray onto the surface of the dryer drum so that as the drum moves through the bundle of fabrics the composition-coated drum surface distributes the composition is delivered in a very uniform manner to the fabrics. Uniform distribution is desirable as it enhances performance. The wrinkle controlling composition can also be sprayed onto the fabrics in the dryer by a device that is part of the dryer or attached to it. Available substrates can be used to deliver wrinkle controlling composition for instance, but not limited to, cloth diapers, rags, wash clothes, towels, flexible nonwoven sheet or towellete, or sponges. It should also be understood that an available substrate can be a manufactured item suitable for containing the wrinkle controlling composition before delivery to the dryer and suitable for releasing the wrinkle controlling composition after addition of the available substrate plus wrinkle controlling composition to the dryer. When used in combination with available substrates, the desired amount of the wrinkle controlling composition should be poured directly on the substrate (unless it is already contained within the substrate as an article of manufacture) and the substrate plus the wrinkle controlling composition is then placed in the clothes dryer and the dryer is activated. The dryer temperature should be set according to recommendations given by the fabric manufacturer. An available substrate can be chosen such that it has the capacity to contain the desired level of the said wrinkle controlling composition. Alternately, multiple available substrates can be used to deliver the desired amount of wrinkle controlling composition when the amount exceeds the capacity of one available substrate. Also, when the batch or load of fabrics is large either in number and/or weight, it is often desirable to use multiple implements or available substrates in combination with the wrinkle controlling composition to achieve a more uniform distribution of the wrinkle controlling composition during the tumbling of the fabrics in the dryer. When the wrinkle controlling composition is poured on a fabric, implement, or substrate for delivery into the clothes dryer, it is preferred that the item used to deliver the wrinkle controlling composition is clean.

When using the wrinkle controlling composition through the dryer, it is preferred, to use smaller bundle sizes with typical sizes below about 15 lbs (about 6.8 kg), preferably below about 10 lbs (about 4.5 kg), more preferably below about 8 lbs.(about 3.6 kg), even more preferably below about 6 lbs. (about 2.7 kg) and most preferably at or below about 4 lbs. (about 1.8 kg) It is also desirable to arrange the bundle composition such that fabrics in the bundle have similar weights or densities to promote even distribution. It is also desirable for each implement or substrate plus wrinkle controlling composition to have a weight or density similar to the fabrics in the bundle again to facilitate even distribution. Therefore, in cases where larger bundles are treated, it is preferable as stated above to use multiple implements or available substrates plus wrinkle controlling composition to deliver larger amounts of wrinkle controlling composition. In cases where fabrics that are dry are treated in the dryer vs. fabrics that are wet, while it is acceptable to have one available substrate plus wrinkle controlling composition, it is preferred to have multiple available substrates plus wrinkle controlling composition in order to reduce the weight and/or density of each available substrate plus wrinkle controlling composition in order to make these more similar in weight and/or density to the dry clothes and thereby facilitate good distribution.

When treating fabrics in the clothes dryer the amount of wrinkle controlling composition used is dependent on the size of the load of fabrics. For a preferred 4 lbs. bundle of fabrics, wrinkle controlling compositions should be used typically at lower levels of least about 10 g, preferably at least about 20 g, even more preferably at least about 30 g, still more preferably at least about 50 g, and most preferably about 66 g, and at higher levels of equal to or less than about 3000 g, preferably equal to or less than about 1500g, more preferably equal to or less than about 750g, still more preferably equal to or less than about 500 g and most preferably equal to or less than about 100 g. When the bundle size is greater than about 4 lbs., higher amounts of wrinkle controlling composition are appropriate and when the bundle size is smaller than about 4 lbs. (about 1.8 kg) lower amounts of wrinkle controlling composition are appropriate. When the wrinkle controlling composition is provided together with an available substrate as an article of manufacture it will be understood that increasing the amount of wrinkle controlling composition in the dryer can mean adding more than one article of manufacture. Total drying time is typically set at a lower limit of at least about 1 minute, preferably about 2 minutes, more preferably about 3 minutes, even more preferably about 5 minutes and most preferably about 7 minutes and with an upper limit set at about 60 minutes, preferably 45 minutes, more preferably 30 minutes even more preferably about 20 minutes and still more preferably about 15 minutes and most preferably about 10 minutes. Preferably fabrics are still at least slightly damp when removed from the dryer.

Garments and fabrics should be removed as soon as possible, preferably immediately, following the drying cycle and arranged to maintain the smooth appearance of the fabrics with for instance, but not limited to, arranging sleeves, collars, pant legs so these are smooth and not twisted in any way, hanging the fabric on a hanger, laying the fabric flat on a or putting the fabric to its natural use to maintain its appearance e.g. hang curtains, put bed linens on the bed, put table linens on the table. Preferably the fabric will not be folded and stored until it is completely dry.

A hand-held hair dryer can be used to increase the speed of drying of individual fabrics. It is preferably to use the hand-held hair dryer on fabrics that are not very wet since it can be time consuming to dry fabrics with such an appliance. Therefore, it is preferably to employ this method on fairly dry fabrics, e.g., those that started in the dry state.

When using a hand-held hair dryer, wrinkle controlling compositions are applied preferably evenly over fabrics and preferably using the minimal amount of wrinkle controlling composition necessary. Preferably, the fabric is manipulated as described above to remove wrinkles prior to drying with the hand-held hair dryer. The hand-held dryer is turned on either low, medium, or high heat, preferably medium or high heat and the air stream is applied evenly over the fabrics until the fabrics are dry. However, care should be taken to preferably use low-heat and/or cool air to dry fabrics that are prone to shrinkage, such as , wool, silk, rayon, and the like, especially when the fabrics are reaching the point of drying completely. After drying the fabric should be placed in a configuration that will maintain its smoothness until use as discussed above.

Wrinkle controlling compositions can be used as ironing aids with either wet or dry fabrics to help ease removal of wrinkles by the ironing process. Wrinkle controlling composition is preferably applied to fabrics prior to ironing. A preferred way to deliver the wrinkle controlling composition to the fabrics is by spraying. The wrinkle controlling composition can also be delivered employing many of the through-the-dryer methods articulated above. Finally, in some embodiments, it is acceptable to deliver the wrinkle controlling composition through the iron concurrent with the ironing process. The iron should be set to a temperature appropriate for ironing the fabric. The wrinkle controlling compositions aid in "plasticizing" the fibers and thus reduce the time and effort involved in ironing wrinkles out of fabrics. In general, wrinkle controlling compositions should be used in a way similar to starch or water when starch or water are used as ironing aids. After ironing, the fabric should be placed in a configuration that will maintain its smoothness as discussed above.

While it is acceptable to use compositions herein on many synthetic garments, the product is especially effective on fabrics that contain a majority of natural fibers, e.g. the product is more effective on fabrics containing 100% cotton or 65% cotton/35% polyester vs. fabrics containing 35% cotton/65% polyester.

Many household fabrics can be treated with the wrinkle controlling composition while these household fabrics are residing in their typical environment. For instance, shower curtains comprised of fabrics and window curtains can be treated while hanging on the rods, bed spreads, quilts, sheets, ruffles, and dusters can be treated while these are on the bed, table linens can be treated while on the table. Spraying is a preferred method for treating fabrics residing in their typical environment. In these cases, reasonable care should be taken to avoid staining the environment around the fabric. For instance, table linens should be sprayed very lightly to prevent water from soaking through to the table, if the table underneath comprises wood or any other material that will stain, warp, or otherwise become disfigured upon picking up water or components of the wrinkle controlling compositions. In many cases spraying household fabrics in their natural environment can replace time consuming, costly, inconvenient, or undesirable processes. For instance, shower curtains are often dewrinkled by using the bathroom plumbing to generate a large quantity of steam. Spraying wrinkle controlling composition on the shower curtains eliminates the need to waste a large quantity of water producing steam, the potentially undesirable effects of steam on other elements of the bathroom (e.g., wall covers may peel), and the inconvenience of having to close the bathroom to use for a certain period of time. Spraying wrinkle controlling composition on curtains and bed clothes eliminates the often awkward and time consuming job of trying to iron large, irregular items; a process (e.g. ironing) that often results in accidentally generating even deeper more obvious and harder-to-remove wrinkles, as the user struggles to control both the large, irregularly shaped fabric and the iron. Thus, treating household fabrics as they hang in place with wrinkle controlling composition often minimizes frustration and struggle. It is especially desirable to dispense wrinkle removal compositions from a powered sprayer as disclosed above to further improve the performance and convenience.

Wrinkle controlling compositions allow a consumer the freedom to purchase a wider array of garments and fabrics e.g. garments and fabrics which are desirable but typically avoided during purchase decisions due to their tendency to wrinkle. Wrinkle controlling compositions change the care situation of these items from an impractical, time consuming, and frustrating process into a practical task; thus maximizing the pleasure inherent in owning such items by minimizing the tedium associated with taking care of them.

It is preferably to hang the garments to be treated with the wrinkle removal compositions using a swivel clothes hanger. The swivel clothes hanger has a frame that can be rotated around the stem of the hook. A garment hung on said swivel hanger can be oriented in many directions. This facilitates an even and thorough treatment of the garment with the wrinkle composition when using the spray to treat the garments. Additionally, the swivel hanger facilitates inspection and manipulation of the garment and so is generally useful when used together with wrinkle controlling compositions.

V. Test Methods

(a) Patternator Test

The Patternator Test method is used to evaluate a spray pattern of a spray dispenser. The Pattemator Test generates data to quantify a spray pattern in terms of volume of liquid per unit of surface area covered by the spray. A standard deviation is also calculated from this test method.

An apparatus used to perform the Patternator Test method is shown in FIG. 1. The Patternator Test is carried out according to the following method.

A wrinkle control composition is placed in a plastic bottle 10 with a spray head 12 attached thereto to form a spray dispenser 18. The spray head 12 of the plastic bottle 10 is placed in a vise-like clamp 14 and attached to the patternator apparatus 16.

The spray dispenser 18 is aimed towards a two-dimensional 17×17 tube array 20 of graduated 14 mL conical tubes 22 (289 tubes total) with a 1.50 cm diameter at the top of each tube 22 and 1 mL graduation marks on each tube 22. There are 10 tubes 22 per 15.2 cm length in both the horizontal and vertical direction on the tube array 20. The nozzle 24 of the spray dispenser 18 is positioned 6 inches (2.36 cm) from the tube array 20 and aimed toward the center of the tube array 20, such that when the wrinkle control composition is sprayed towards the tube array 20, the tubes 22 will collect the composition. The spray dispenser 18 is aimed at the tube array 20 such that the spray stream is perpendicular to the tube array 20 and the tube array 20 is at a 45° angle to a horizontal surface 26. Each tube 22 corresponds to a surface area element of about 1.77 $cm^2$.

An actuator 28 is used to trigger the spray dispenser 18 at a controlled pressure. The actuation pressure is chosen based on measuring the sprayer piston cylinder pressure developed as consumers used typical examples of spray dispensers. The actuation pressure is from about 40 to about 50 pounds per square inch (psi). The piston 30 driving the actuator 28 is powered by compressed air fed through a flexible tube 32 connected to the piston 30.

The spray dispenser 18 is triggered by the actuator 28 100 times and the composition dispensed from the 100 sprays is collected by the tubes 22 of the 17×17 tube array 20. After the liquid from 100 sprays is collected, each tube 22 is removed from the tube array 20 and the amount of liquid in each tube 22 is recorded. This data is inputted into a spreadsheet computer program (Microsoft Excel 200™) which is used to calculate the volume of liquid per unit of surface area and the standard deviation thereof. The results of these data are plotted as a function of volume vs. surface area to create a three-dimensional graph.

(b) Staining Test

The Staining Test is carried out by spraying a composition onto a hanging fabric from a selected spray dispenser with a distance of 6 inches between the nozzle of the spray dispenser and the surface of the fabric. The fabric used to assess staining comprises a medium dark color, like green or blue polycotton (Springmaid TREMODE combed broadcloth, polycotton fabric 65% polyester and 35% cotton, any medium dark color, e.g. a nonlimiting example is color# 99555 called kelly green). Each time a dispenser is tested with a wrinkle control composition, ten swatches are sprayed. The number of swatches with a visible stain are tabulated and the number of stains per ten swatches sprayed is reported.

(c) Dry Time Test

The Dry Time Test is carried out under conditions where the relative humidity is 20–27 RH at a temperature of 71–73° F. as measured by an Omega CTH100 temperature/relative humidity chart recorder (from Omega Engineering). A composition is dispensed from a spray dispenser onto fabric (Springmaid TREMODE combed combed broadcloth, polycotton fabric 65% polyester and 35% cotton) at a distance of 6 inches between the nozzle of the sprayer and the fabric. The fabric is sprayed while it hangs on a suspending device designed to sit on a typical lab scale (e.g. Mettler PM4000; Mettler PM2000) as it suspends the drying fabric. The suspending device is a T-shaped metal stand that fabric can be clipped onto. The fabric is attached to the suspending device as it is sitting on the scale. After the fabric is attached to the suspending device on the scale, then sprayed as directed above. Immediately, the initial weight of the fabric is noted at time=0 minutes. The weight of the fabric is noted at time=2 minutes, 5 minute, and 10 minutes after spraying. The % change in weight from the initial value is plotted as a function of time. To generate the dry time, for each sprayer type, two sprayers are used and two replicates are done per sprayer. Therefore, for each sprayer, the dry time data is repeated four times. The data is averaged over the four runs for the plot.

(d) Spray Diameter Test

The Spray Diameter Test measures how wide of an area of fabric is covered by a wrinkle controlling composition dispensed from a spray dispenser. The Spray Diameter Test can be used to measure the differences between the area of fabric cover by wrinkle controlling compositions having different viscosities.

A dye (Milliken Liquitint Blue) is incorporated into a wrinkle controlling composition to be tested. Using a spray dispenser to spray the dyed wrinkle controlling composition, the composition is sprayed onto a sheet of white paper from a distance of 6 inches. A circle is formed on the white paper by the dyed wrinkle controlling composition sprayed onto the paper. The diameter of the widest portion of the circle is measured.

When the viscosity of the wrinkle controlling composition is too high, the product tends to stream when sprayed and the diameter of the circle tends to be relatively small. Concentration of the product in a smaller area on the fabric tends to lead to staining of the fabric and longer dry times and so is undesirable.

The following are non-limiting examples of the present invention. All percentages, ratios, and parts herein, in the Specification, Examples, and Claims are by weight and are the normal approximations unless otherwise stated and all references are incorporated by reference.

EXAMPLE I

The following are Examples of wrinkle controlling compositions of the present invention:

| Compound | 1 | 2 | 3 | 4 | 5 |
|---|---|---|---|---|---|
| Luviflex Soft[1] | 0.1 | 0.5 | 1.0 | 1.5 | 3.0 |
| Perfume | 0.01–0.04 | 0.01–0.04 | 0.01–0.04 | 0.01–0.04 | 0.01–0.04 |
| Prox-el ®GXL[2] | 0.015 | 0.015 | 0.015 | 0.015 | 0.015 |
| pH | 5–6 | 5–6 | 5–6 | 5–6 | 5–6 |
| Water | Bal. | Bal. | Bal. | Bal. | Bal. |

| Compound | 6 | 7 | 8 | 9 | 10 |
|---|---|---|---|---|---|
| Luviflex Soft | 0.1 | 0.5 | 1.0 | 1.5 | 3.0 |
| Perfume | 0.01–0.04 | 0.01–0.04 | 0.01–0.04 | 0.01–0.04 | 0.01–0.04 |
| Proxel ®GXL | 0.015 | 0.015 | 0.015 | 0.015 | 0.015 |
| EtOH | 3.0 | 3.0 | 4.0 | 5.0 | 6.0 |
| pH | 5–6 | 5–6 | 5–6 | 5–6 | 5–6 |
| Water | Bal. | Bal. | Bal. | Bal. | Bal. |

| Compound | 11 | 12 | 13 | 14 | 15 |
|---|---|---|---|---|---|
| Luviflex Soft | 0.3 | 0.5 | 0.7 | 1.5 | 3.0 |
| Silwet ® L7001[3] | 1.5 | 1.5 | 1.5 | 1.5 | 1.5 |
| LaraCare ™ A200[4] | 0.5 | 0.5 | 0.5 | 0.5 | 0.5 |
| Hydroxy-propyl-β-Cyclodextrin | 0.3 | 0.3 | 0.3 | 0.3 | 0.3 |
| Ethanol | 3.0 | 3.0 | 3.0 | 3.0 | 3.0 |
| Proxel ®GXL | 0.015 | 0.015 | 0.015 | 0.015 | 0.015 |

-continued

| | | | | | |
|---|---|---|---|---|---|
| Perfume | 0.01–0.04 | 0.01–0.04 | 0.01–0.04 | 0.01–0.04 | 0.01–0.04 |
| pH | 5–6 | 5–6 | 5–6 | 5–6 | 5–6 |
| Water | Bal. | Bal. | Bal. | Bal. | Bal. |
| Compound | 16 | 17 | 18 | 19 | 20 |
| Luviflex Soft | 0.3 | 0.5 | 0.7 | 1.5 | 3.0 |
| Silwet ® L7001 | 1.5 | 1.5 | 1.5 | 1.5 | 1.5 |
| LaraCare ™ A200 | 0.5 | 0.5 | 0.5 | 0.5 | 0.5 |
| Hydroxy-propyl-β-Cyclodextrin | 0.3 | 0.3 | 0.3 | 0.3 | 0.3 |
| Ethanol | 3.0 | 3.0 | 3.0 | 3.0 | 3.0 |
| Dequest ® 2006[5] | 0.02–0.12 | 0.02–0.12 | 0.02–0.12 | 0.02–0.12 | 0.02–0.12 |
| Perfume | 0.01–0.04 | 0.01–0.04 | 0.01–0.04 | 0.01–0.04 | 0.01–0.04 |
| pH | 5–6 | 5–6 | 5–6 | 5–6 | 5–6 |
| Water | Bal. | Bal. | Bal. | Bal. | Bal. |
| Compound | 21 | 22 | 23 | 24 | 25 |
| Luviflex Soft | 0.3 | 0.5 | 0.7 | 1.5 | 3.0 |
| Silwet ® L7001 | 1.5 | 1.5 | 1.5 | 1.5 | 1.5 |
| LaraCare ™ A200 | 0.5 | 0.5 | 0.5 | 0.5 | 0.5 |
| Hydroxy-propyl-β-Cyclodextrin | 0.3 | 0.3 | 0.3 | 0.3 | 0.3 |
| Ethanol | 3.0 | 3.0 | 3.0 | 3.0 | 3.0 |
| Dequest ® 2006 | 0.02–0.12 | 0.02–0.12 | 0.02–0.12 | 0.02–0.12 | 0.02–0.12 |
| Proxel ®$^{GXL}$ | 0.015 | 0.015 | 0.015 | 0.015 | 0.015 |
| Perfume | 0.01–0.04 | 0.01–0.04 | 0.01–0.04 | 0.01–0.04 | 0.01–0.04 |
| pH | 5–6 | 5–6 | 5–6 | 5–6 | 5–6 |
| Water | Bal. | Bal. | Bal. | Bal. | Bal. |
| Compound | 26 | 27 | 28 | 29 | 30 |
| Luviflex Soft | 0.3 | 0.5 | 0.7 | 1.5 | 3.0 |
| Silwet ® L7001 | 1.5 | 1.5 | 1.5 | 1.5 | 1.5 |
| LaraCare ™ A200 | 0.5 | 0.5 | 0.5 | 0.5 | 0.5 |
| methylated cyclodextrin | 0.3 | 0.3 | 0.3 | 0.3 | 0.3 |
| Ethanol | 3.0 | 3.0 | 3.0 | 3.0 | 3.0 |
| Proxel ®$^{GXL}$ | 0.015 | 0.015 | 0.015 | 0.015 | 0.015 |
| Perfume | 0.01–0.04 | 0.01–0.04 | 0.01–0.04 | 0.01–0.04 | 0.01–0.04 |
| pH | 5–6 | 5–6 | 5–6 | 5–6 | 5–6 |
| Water | Bal. | Bal. | Bal. | Bal. | Bal. |
| Compound | 31 | 32 | 33 | 34 | 35 |
| Luviflex Soft | 0.3 | 0.5 | 0.7 | 1.5 | 2.0 |
| Silwet ® L7200[6] | 1.5 | 1.5 | 1.5 | 1.5 | 1.5 |
| LaraCare ™ A200 | 0.5 | 0.5 | 0.5 | 0.5 | 0.5 |
| Hydroxy-propyl-β-Cyclodextrin | 0.3 | 0.3 | 0.3 | 0.3 | 0.3 |
| Ethanol | 3.0 | 3.0 | 3.0 | 3.0 | 3.0 |
| Proxel ®$^{GXL}$ | 0.015 | 0.015 | 0.015 | 0.015 | 0.015 |
| Perfume | 0.01–0.04 | 0.01–0.04 | 0.01–0.04 | 0.01–0.04 | 0.01–0.04 |
| pH | 5–6 | 5–6 | 5–6 | 5–6 | 5–6 |
| Water | Bal. | Bal. | Bal. | Bal. | Bal. |
| Compound | 36 | 37 | 38 | 39 | 40 |
| Luviflex Soft | 0.3 | 0.5 | 0.7 | 1.5 | 3.0 |

-continued

| | | | | | |
|---|---|---|---|---|---|
| Silwet ® L7200 | 1.5 | 1.5 | 1.5 | 1.5 | 1.5 |
| LaraCare ™ A200 | 0.5 | 0.5 | 0.5 | 0.5 | 0.5 |
| methylated cyclodextrin | 0.3 | 0.3 | 0.3 | 0.3 | 0.3 |
| Ethanol | 3.0 | 3.0 | 3.0 | 3.0 | 3.0 |
| Proxel ®$^{GXL}$ | 0.015 | 0.015 | 0.015 | 0.015 | 0.015 |
| Perfume | 0.01–0.04 | 0.01–0.04 | 0.01–0.04 | 0.01–0.04 | 0.01–0.04 |
| pH | 5–6 | 5–6 | 5–6 | 5–6 | 5–6 |
| Water | Bal. | Bal. | Bal. | Bal. | Bal. |
| Compounds | 41 | 42 | 43 | 44 | 45 |
| Diahold ME ®[7] | 0.1 | 0.5 | 1 | 1.5 | 3.0 |
| Perfume | 0.01–0.04 | 0.01–0.04 | 0.01–0.04 | 0.01–0.04 | 0.01–0.04 |
| Proxel ®$^{GXL}$ | 0.015 | 0.015 | 0.015 | 0.015 | 0.015 |
| pH | 5–6 | 5–6 | 5–6 | 5–6 | 5–6 |
| Water | Bal. | Bal. | Bal. | Bal. | Bal. |
| Compound | 46 | 47 | 48 | 49 | 50 |
| Diahold ME ® | 0.3 | 0.5 | 0.7 | 1.5 | 2 |
| Silwet ® L7001 | 1.5 | 1.5 | 1.5 | 1.5 | 1.5 |
| LaraCare ™ A200 | 0.5 | 0.5 | 0.5 | 0.5 | 0.5 |
| Hydroxy-propyl-β-Cyclodextrin | 0.3 | 0.3 | 0.3 | 0.3 | 0.3 |
| Ethanol | 3.0 | 3.0 | 3.0 | 3.0 | 3.0 |
| Proxel ®$^{GXL}$ | 0.015 | 0.015 | 0.015 | 0.015 | 0.015 |
| Perfume | 0.01–0.04 | 0.01–0.04 | 0.01–0.04 | 0.01–0.04 | 0.01–0.04 |
| pH | 5–6 | 5–6 | 5–6 | 5–6 | 5–6 |
| Water | Bal. | Bal. | Bal. | Bal. | Bal. |
| Compound | 51 | 52 | 53 | 54 | 55 |
| Diahold ME ® | 0.3 | 0.5 | 0.7 | 1.5 | 2 |
| Silwet ® L7001 | 1.5 | 1.5 | 1.5 | 1.5 | 1.5 |
| LaraCare ™ A200 | 0.5 | 0.5 | 0.5 | 0.5 | 0.5 |
| methylated cyclodextrin | 0.3 | 0.3 | 0.3 | 0.3 | 0.3 |
| Ethanol | 3.0 | 3.0 | 3.0 | 3.0 | 3.0 |
| Proxel ®$^{GXL}$ | 0.015 | 0.015 | 0.015 | 0.015 | 0.015 |
| Perfume | 0.01–0.04 | 0.01–0.04 | 0.01–0.04 | 0.01–0.04 | 0.01–0.04 |
| pH | 5–6 | 5–6 | 5–6 | 5–6 | 5–6 |
| Water | Bal. | Bal. | Bal. | Bal. | Bal. |
| Compound | 56 | 57 | 58 | 59 | 60 |
| Diahold ME ® | 0.3 | 0.5 | 0.7 | 1.5 | 2.0 |
| Silwet ® L7200 | 1.5 | 1.5 | 1.5 | 1.5 | 1.5 |
| LaraCare ™ A200 | 0.5 | 0.5 | 0.5 | 0.5 | 0.5 |
| Hydroxy-propyl-β-Cyclodextrin | 0.3 | 0.3 | 0.3 | 0.3 | 0.3 |
| Ethanol | 3.0 | 3.0 | 3.0 | 3.0 | 3.0 |
| Proxel ®$^{GXL}$ | 0.015 | 0.015 | 0.015 | 0.015 | 0.015 |
| Perfume | 0.01–0.04 | 0.01–0.04 | 0.01–0.04 | 0.01–0.04 | 0.01–0.04 |
| pH | 5–6 | 5–6 | 5–6 | 5–6 | 5–6 |
| Water | Bal. | Bal. | Bal. | Bal. | Bal. |
| Compound | 61 | 62 | 63 | 64 | 65 |
| Diahold ME ® | 0.3 | 0.5 | 0.7 | 1.5 | 2.0 |
| Silwet ® L7200 | 1.5 | 1.5 | 1.5 | 1.5 | 1.5 |
| LaraCare ™ A200 | 0.5 | 0.5 | 0.5 | 0.5 | 0.5 |

-continued

| | | | | | |
|---|---|---|---|---|---|
| methylated cyclodextrin | 0.3 | 0.3 | 0.3 | 0.3 | 0.3 |
| Ethanol | 3.0 | 3.0 | 3.0 | 3.0 | 3.0 |
| Proxel ®$^{GXL}$ | 0.015 | 0.015 | 0.015 | 0.015 | 0.015 |
| Perfume | 0.01–0.04 | 0.01–0.04 | 0.01–0.04 | 0.01–0.04 | 0.01–0.04 |
| pH | 5–6 | 5–6 | 5–6 | 5–6 | 5–6 |
| Water | Bal. | Bal. | Bal. | Bal. | Bal. |
| Compound | 66 | 67 | 68 | 69 | 70 |
| Luviflex Soft | 0.3 | 0.4 | 0.7 | 1.5 | 2.0 |
| Silwet ® L7001 | 1.5 | 1.5 | 1.5 | 1.5 | 1.5 |
| Hydroxy-propyl-β-Cyclodextrin | 0.3 | 0.3 | 0.3 | 0.3 | 0.3 |
| Ethanol | 3.0 | 3.0 | 3.0 | 3.0 | 3.0 |
| Proxel ®$^{GXL}$ | 0.015 | 0.015 | 0.015 | 0.015 | 0.015 |
| Perfume | 0.01–0.05 | 0.01–0.05 | 0.01–0.05 | 0.01–0.05 | 0.01–0.05 |
| pH | 6.2–6.8 | 6.2–6.8 | 6.2–6.8 | 6.2–6.8 | 6.2–6.8 |
| Water | Bal. | Bal. | Bal. | Bal. | Bal. |
| Compound | 71 | 72 | 73 | 74 | 75 |
| Diahold ME ® | 0.3 | 0.5 | 0.7 | 1.5 | 2.0 |
| Silwet ® L7001 | 1.5 | 1.5 | 1.5 | 1.5 | 1.5 |
| Hydroxy-propyl-β-Cyclodextrin | 0.3 | 0.3 | 0.3 | 0.3 | 0.3 |
| Ethanol | 3.0 | 3.0 | 3.0 | 3.0 | 3.0 |
| Proxel ®$^{GXL}$ | 0.015 | 0.015 | 0.015 | 0.015 | 0.015 |
| Perfume | 0.01–0.04 | 0.01–0.04 | 0.01–0.04 | 0.01–0.04 | 0.01–0.04 |
| pH | 5–6 | 5–6 | 5–6 | 5–6 | 5–6 |
| Water | Bal. | Bal. | Bal. | Bal. | Bal. |
| Compound | 76 | 77 | 78 | 79 | 80 |
| Luviflex Soft | 0.3 | 0.5 | 0.7 | 1.5 | 2 |
| 245 Fluid ®$^{8}$ | 2.5 | 2.5 | 2.5 | 2.5 | 2.5 |
| Silwet ® L77$^{9}$ | 2.0 | 2.0 | 2.0 | 2.0 | 2.0 |
| Neodol ® 23-3$^{10}$ | 0.5 | 0.5 | 0.5 | 0.5 | 0.5 |
| Proxel ®$^{GXL}$ | 0.015 | 0.015 | 0.015 | 0.015 | 0.015 |
| Perfume | 0.02–0.04 | 0.02–0.04 | 0.02–0.04 | 0.02–0.04 | 0.02–0.04 |
| pH | 5–6 | 5–6 | 5–6 | 5–6 | 5–6 |
| Water | Bal. | Bal. | Bal. | Bal. | Bal. |
| Compound | 81 | 82 | 83 | 84 | 85 |
| Luviflex Soft | 0.3 | 0.5 | 0.7 | 1.5 | 2 |
| Silwet ® L77 | 2.5 | — | — | 1.0 | — |
| Q2-5211$^{11}$ | — | 2.0 | — | — | — |
| DC 190$^{12}$ | — | — | 1.5 | — | — |
| TSF4440$^{13}$ | — | — | — | 1.0 | |
| KF 354$^{14}$ | — | — | — | — | 1.75 |
| Proxel ®$^{GXL}$ | 0.015 | 0.015 | 0.015 | 0.015 | 0.015 |
| Perfume | 0.02–0.04 | 0.02–0.04 | 0.02–0.04 | 0.02–0.04 | 0.02–0.04 |
| pH | 5–6 | 5–6 | 5–6 | 5–6 | 5–6 |
| Water | Bal. | Bal. | Bal. | Bal. | Bal. |
| Compound | 86 | 87 | 88 | 89 | 90 |
| Luviflex Soft | 0.1 | 0.5 | 1.0 | 1.5 | 3.0 |
| TEA Di-ester Quat$^{14}$ | 0.75 | 0.5 | 1.2 | 1.5 | 1.5 |

-continued

| | | | | | |
|---|---|---|---|---|---|
| Perfume | 0.01–0.04 | 0.01–0.04 | 0.01–0.04 | 0.01–0.04 | 0.01–0.04 |
| Proxel ®$^{GXL}$ | 0.015 | 0.015 | 0.015 | 0.015 | 0.015 |
| pH | 5–6 | 5–6 | 5–6 | 5–6 | 5–6 |
| Water | Bal. | Bal. | Bal. | Bal. | Bal. |
| Compound | 91 | 92 | 93 | 94 | 95 |
| Luviflex Soft | 5.0 | 0.5 | 6.0 | 1.5 | 3.0 |
| TEA Di-ester Quat | 1.8 | 1.0 | 2.0 | 1.75 | 2.0 |
| Perfume | 0.01–0.04 | 0.01–0.04 | 0.01–0.04 | 0.01–0.04 | 0.01–0.04 |
| Proxel ®$^{GXL}$ | 0.015 | 0.015 | 0.015 | 0.015 | 0.015 |
| pH | 5–6 | 5–6 | 5–6 | 5–6 | 5–6 |
| Water | Bal. | Bal. | Bal. | Bal. | Bal. |
| Compound | 96 | 97 | 98 | 99 | 100 |
| Luviflex Soft | 0.1 | 0.5 | 1.0 | 1.5 | 3.0 |
| DEED-MAC$^{16}$ | 0.75 | 0.5 | 1.2 | 1.5 | 1.5 |
| Perfume | 0.01–0.04 | 0.01–0.04 | 0.01–0.04 | 0.01–0.04 | 0.01–0.04 |
| Proxel ®$^{GXL}$ | 0.015 | 0.015 | 0.015 | 0.015 | 0.015 |
| pH | 5–6 | 5–6 | 5–6 | 5–6 | 5–6 |
| Water | Bal. | Bal. | Bal. | Bal. | Bal. |
| Compound | 101 | 102 | 103 | 104 | 105 |
| Luviflex Soft | 5.0 | 0.5 | 6.0 | 1.5 | 3.0 |
| DEEDMAC | 1.8 | 1.0 | 2.0 | 1.75 | 2.0 |
| Perfume | 0.01–0.04 | 0.01–0.04 | 0.01–0.04 | 0.01–0.04 | 0.01–0.04 |
| Proxel ®$^{GXL}$ | 0.015 | 0.015 | 0.015 | 0.015 | 0.015 |
| pH | 5–6 | 5–6 | 5–6 | 5–6 | 5–6 |
| Water | Bal. | Bal. | Bal. | Bal. | Bal. |
| Compound | 106 | 107 | 108 | 109 | 110 |
| Luviflex Soft | — | 0.7 | 0.5 | 0.5 | 0.7 |
| BC15-H | 0.7 | — | 0.5 | 0.5 | — |
| 2-1084 Emul-sion ®$^{17}$ | 1.0 | | 0.75 | 0.75 | 1.2 |
| SM2128$^{18}$ | — | 1.0 | 0.5 | — | 1.0 |
| Perfume | 0.01–0.04 | 0.01–0.04 | 0.01–0.04 | 0.01–0.04 | 0.01–0.04 |
| Proxel ®$^{GXL}$ | 0.015 | 0.015 | 0.015 | 0.015 | 0.015 |
| pH | 5–6 | 5–6 | 5–6 | 5–6 | 5–6 |
| Water | Bal. | Bal. | Bal. | Bal. | Bal. |
| Compound | 111 | 112 | 113 | 114 | 115 |
| Luviflex Soft | — | 0.7 | 0.5 | 0.5 | 0.7 |
| BC15-H | 0.7 | — | 0.5 | 0.5 | — |
| 2-1084 Emulsion ® | | 1.0 | 0.5 | | 1.2 |
| SM2128 | 1.0 | — | 0.6 | 0.75 | — |
| Perfume | 0.01–0.04 | 0.01–0.04 | 0.01–0.04 | 0.01–0.04 | 0.01–0.04 |
| Proxel ®$^{GXL}$ | 0.015 | 0.015 | 0.015 | 0.015 | 0.015 |
| pH | 5–6 | 5–6 | 5–6 | 5–6 | 5–6 |
| Water | Bal. | Bal. | Bal. | Bal. | Bal. |
| Compound | 116 | 117 | 118 | 119 | 120 |
| Luviflex Soft | 0.3 | 0.5 | 0.7 | 1.5 | 3.0 |
| DC 190 | 1.5 | 1.5 | 1.5 | 1.5 | 1.5 |
| LaraCare ™ A200 | 0.5 | 0.5 | 0.5 | 0.5 | 0.5 |
| Hydroxy-propyl-β-Cyclodextrin | 0.3 | 0.3 | 0.3 | 0.3 | 0.3 |

-continued

| | | | | | |
|---|---|---|---|---|---|
| Ethanol | 3.0 | 3.0 | 3.0 | 3.0 | 3.0 |
| Proxel ®$^{GXL}$ | 0.015 | 0.015 | 0.015 | 0.015 | 0.015 |
| Perfume | 0.01–0.04 | 0.01–0.04 | 0.01–0.04 | 0.01–0.04 | 0.01–0.04 |
| pH | 5.5–6.5 | 5.5–6.5 | 5.5–6.5 | 5.5–6.5 | 5.5–6.5 |
| Water | Bal. | Bal. | Bal. | Bal. | Bal. |

| Compound | 121 | 122 | 123 | 124 | 125 |
|---|---|---|---|---|---|
| Luviflex Soft | 0.3 | 0.5 | 0.7 | 1.5 | 3.0 |
| DC 190 | 1.5 | 1.5 | 1.5 | 1.5 | 1.5 |
| Hydroxy-propyl-β-Cyclodextrin | 0.3 | 0.3 | 0.3 | 0.3 | 0.3 |
| Ethanol | 3.0 | 3.0 | 3.0 | 3.0 | 3.0 |
| Proxel ®$^{GXL}$ | 0.015 | 0.015 | 0.015 | 0.015 | 0.015 |
| Perfume | 0.01–0.04 | 0.01–0.04 | 0.01–0.04 | 0.01–0.04 | 0.01–0.04 |
| pH | 5–6 | 5–6 | 5–6 | 5–6 | 5–6 |
| Water | Bal. | Bal. | Bal. | Bal. | Bal. |

| Compound | 126 | 127 | 128 | 129 | 130 |
|---|---|---|---|---|---|
| Luviflex Soft | 0.3 | 0.5 | 0.7 | 1.5 | 3.0 |
| Silwet ® L7001 | 1.5 | 1.5 | 1.5 | 1.5 | 1.5 |
| Hydroxy-propyl-β-Cyclodextrin | 0.3 | 0.3 | 0.3 | 0.3 | 0.3 |
| Ethanol | 3.0 | 3.0 | 3.0 | 3.0 | 3.0 |
| Proxel ®$^{GXL}$ | 0.015 | 0.015 | 0.015 | 0.015 | 0.015 |
| Perfume | 0.01–0.04 | 0.01–0.04 | 0.01–0.04 | 0.01–0.04 | 0.01–0.04 |
| pH | 5.5–6.5 | 5.5–6.5 | 5.5–6.5 | 5.5–6.5 | 5.5–6.5 |
| Water | Bal. | Bal. | Bal. | Ba1. | Bal. |

| Compound | 131 | 132 | 133 | 134 | 135 |
|---|---|---|---|---|---|
| Luviflex Soft | 0.3 | 0.4 | 0.7 | 1.5 | 3.0 |
| Silwet ® L7001 | 1.5 | 1.5 | 1.5 | 1.5 | 1.5 |
| LaraCare ™ A200 | 0.5 | 0.5 | 0.5 | 0.5 | 0.5 |
| Hydroxy-propyl-β-Cyclodextrin | 0.3 | 0.3 | 0.3 | 0.3 | 0.3 |
| Ethanol | 3.0 | 3.0 | 3.0 | 3.0 | 3.0 |
| Dequest ® 2006 | 0.02–0.12 | 0.02–0.12 | 0.02–0.12 | 0.02–0.12 | 0.02–0.12 |
| Perfume | 0.01–0.05 | 0.01–0.05 | 0.01–0.05 | 0.01–0.05 | 0.01–0.05 |
| pH | 6.2–6.8 | 6.2–6.8 | 6.2–6.8 | 6.2–6.8 | 6.2–6.8 |
| Water | Bal. | Bal. | Bal. | Bal. | Bal. |

| Compound | 136 | 137 | 138 | 139 | 140 |
|---|---|---|---|---|---|
| Luviflex Soft | 0.3 | 0.5 | 0.7 | 1.5 | 3.0 |
| DC 190 | 1.5 | 1.5 | 1.5 | 1.5 | 1.5 |
| Hydroxy-propyl-β-Cyclodextrin | 0.3 | 0.3 | 0.3 | 0.3 | 0.3 |
| Ethanol | 3.0 | 3.0 | 3.0 | 3.0 | 3.0 |
| Dequest ® 2006 | 0.02–0.12 | 0.02–0.12 | 0.02–0.12 | 0.02–0.12 | 0.02–0.12 |
| Perfume | 0.01–0.04 | 0.01–0.04 | 0.01–0.04 | 0.01–0.04 | 0.01–0.04 |
| pH | 5.5–6.5 | 5.5–6.5 | 5.5–6.5 | 5.5–6.5 | 5.5–6.5 |
| Water | Bal. | Bal. | Bal. | Bal. | Bal. |

| Compound | 141 | 142 | 143 | 144 | 145 |
|---|---|---|---|---|---|
| Luviflex Soft | 0.3 | 0.5 | 0.7 | 1.5 | 3.0 |
| DC 190 | 1.5 | 1.5 | 1.5 | 1.5 | 1.5 |
| Hydroxy-propyl-β-Cyclodextrin | 0.3 | 0.3 | 0.3 | 0.3 | 0.3 |
| Ethanol | 3.0 | 3.0 | 3.0 | 3.0 | 3.0 |
| Dequest ® 2006 | 0.02–0.12 | 0.02–0.12 | 0.02–0.12 | 0.02–0.12 | 0.02–0.12 |

-continued

| | | | | | |
|---|---|---|---|---|---|
| Perfume | 0.01–0.04 | 0.01–0.04 | 0.01–0.04 | 0.01–0.04 | 0.01–0.04 |
| pH | 5–6 | 5–6 | 5–6 | 5–6 | 5–6 |
| Water | Bal. | Bal. | Bal. | Bal. | Bal. |

| Compound | 146 | 147 | 148 | 149 | 150 |
|---|---|---|---|---|---|
| Luviflex Soft | 0.3 | 0.5 | 0.7 | 1.5 | 3.0 |
| DC 190 | 1.5 | 1.5 | 1.5 | 1.5 | 1.5 |
| LaraCare ™ A200 | 0.5 | 0.5 | 0.5 | 0.5 | 0.5 |
| Hydroxy-propyl-β-Cyclodextrin | 0.3 | 0.3 | 0.3 | 0.3 | 0.3 |
| Ethanol | 3.0 | 3.0 | 3.0 | 3.0 | 3.0 |
| Dequest ® 2006 | 0.02–0.12 | 0.02–0.12 | 0.02–0.12 | 0.02–0.12 | 0.02–0.12 |
| Proxel ®$^{GXL}$ | 0.015 | 0.015 | 0.015 | 0.015 | 0.015 |
| Perfume | 0.01–0.04 | 0.01–0.04 | 0.01–0.04 | 0.01–0.04 | 0.01–0.04 |
| pH | 5.5–6.5 | 5.5–6.5 | 5.5–6.5 | 5.5–6.5 | 5.5–6.5 |
| Water | Bal. | Bal. | Bal. | Bal. | Bal. |

| Compound | 151 | 152 | 153 | 154 | 155 |
|---|---|---|---|---|---|
| Luviflex Soft | 0.3 | 0.5 | 0.7 | 1.5 | 3.0 |
| DC 190 | 1.5 | 1.5 | 1.5 | 1.5 | 1.5 |
| Hydroxy-propyl-β-Cyclodextrin | 0.3 | 0.3 | 0.3 | 0.3 | 0.3 |
| Ethanol | 3.0 | 3.0 | 3.0 | 3.0 | 3.0 |
| Dequest ® 2006 | 0.02–0.12 | 0.02–0.12 | 0.02–0.12 | 0.02–0.12 | 0.02–0.12 |
| Proxel ®$^{GXL}$ | 0.015 | 0.015 | 0.015 | 0.015 | 0.015 |
| Perfume | 0.01–0.04 | 0.01–0.04 | 0.01–0.04 | 0.01–0.04 | 0.01–0.04 |
| pH | 5–6 | 5–6 | 5–6 | 5–6 | 5–6 |
| Water | Bal. | Bal. | Bal. | Bal. | Bal. |

| Compound | 156 | 157 | 158 | 159 | 160 |
|---|---|---|---|---|---|
| Luviflex Soft | 0.3 | 0.5 | 0.7 | 1.5 | 3.0 |
| DC 190 | 1.5 | 1.5 | 1.5 | 1.5 | 1.5 |
| Hydroxy-propyl-β-Cyclodextrin | 0.3 | 0.3 | 0.3 | 0.3 | 0.3 |
| Ethanol | 3.0 | 3.0 | 3.0 | 3.0 | 3.0 |
| Dequest ® 2006 | 0.02–0.12 | 0.02–0.12 | 0.02–0.12 | 0.02–0.12 | 0.02–0.12 |
| Proxel ®$^{GXL}$ | 0.015 | 0.015 | 0.015 | 0.015 | 0.015 |
| Perfume | 0.01–0.04 | 0.01–0.04 | 0.01–0.04 | 0.01–0.04 | 0.01–0.04 |
| pH | 5.5–6.5 | 5.5–6.5 | 5.5–6.5 | 5.5–6.5 | 5.5–6.5 |
| Water | Bal. | Bal. | Bal. | Bal. | Bal. |

| Compound | 161 | 162 | 163 | 164 | 165 |
|---|---|---|---|---|---|
| Luviflex Soft | 0.3 | 0.5 | 0.7 | 1.5 | 3.0 |
| DC 190 | 1.5 | 1.5 | 1.5 | 1.5 | 1.5 |
| LaraCare ™ A200 | 0.5 | 0.5 | 0.5 | 0.5 | 0.5 |
| methylated cyclodextrin | 0.6 | 0.3 | 0.3 | 0.4 | 0.8 |
| Ethanol | 3.0 | 3.0 | 3.0 | 3.0 | 3.0 |
| Proxel ®$^{GXL}$ | 0.015 | 0.015 | 0.015 | 0.015 | 0.015 |
| Perfume | 0.01–0.04 | 0.01–0.04 | 0.01–0.04 | 0.01–0.04 | 0.01–0.04 |
| pH | 5.5–6.5 | 5.5–6.5 | 5.5–6.5 | 5.5–6.5 | 5.5–6.5 |
| Water | Bal. | Bal. | Bal. | Bal. | Bal. |

| Compound | 166 | 167 | 168 | 169 | 170 |
|---|---|---|---|---|---|
| Luviflex Soft | 0.3 | 0.5 | 0.7 | 1.5 | 3.0 |
| DC 190 | 1.5 | 1.5 | 1.5 | 1.5 | 1.5 |
| methylated cyclodextrin | 0.6 | 0.3 | 0.3 | 0.4 | 0.8 |
| Ethanol | 3.0 | 3.0 | 3.0 | 3.0 | 3.0 |
| Proxel ®$^{GXL}$ | 0.015 | 0.015 | 0.015 | 0.015 | 0.015 |
| Perfume | 0.01–0.04 | 0.01–0.04 | 0.01–0.04 | 0.01–0.04 | 0.01–0.04 |

-continued

| | | | | | |
|---|---|---|---|---|---|
| pH | 5–6 | 5–6 | 5–6 | 5–6 | 5–6 |
| Water | Bal. | Bal. | Bal. | Bal. | Bal. |
| Compound | 171 | 172 | 173 | 174 | 175 |
| Luviflex Soft | 0.3 | 0.5 | 0.7 | 1.5 | 3.0 |
| DC 190 | 1.5 | 1.5 | 1.5 | 1.5 | 1.5 |
| methylated cyclodextrin | 0.6 | 0.3 | 0.3 | 0.4 | 0.8 |
| Ethanol | 3.0 | 3.0 | 3.0 | 3.0 | 3.0 |
| Proxel ®$^{GXL}$ | 0.015 | 0.015 | 0.015 | 0.015 | 0.015 |
| Perfume | 0.01–0.04 | 0.01–0.04 | 0.01–0.04 | 0.01–0.04 | 0.01–0.04 |
| pH | 5.5–6.5 | 5.5–6.5 | 5.5–6.5 | 5.5–6.5 | 5.5–6.5 |
| Water | Bal. | Bal. | Bal. | Bal. | Bal. |
| Compound | 176 | 177 | 178 | 179 | 180 |
| Luviflex Soft | 0.3 | 0.5 | 0.7 | 1.5 | 3.0 |
| Silwet ® L7001 | 1.5 | 1.5 | 1.5 | 1.5 | 1.5 |
| LaraCare ™ A200 | 0.5 | 0.5 | 0.5 | 0.5 | 0.5 |
| methylated cyclodextrin | 0.6 | 0.3 | 0.3 | 0.4 | 0.8 |
| Ethanol | 3.0 | 3.0 | 3.0 | 3.0 | 3.0 |
| Dequest ® 2006 | 0.02–0.12 | 0.02–0.12 | 0.02–0.12 | 0.02–0.12 | 0.02–0.12 |
| Proxel ®$^{GXL}$ | 0.015 | 0.015 | 0.015 | 0.015 | 0.015 |
| Perfume | 0.01–0.04 | 0.01–0.04 | 0.01–0.04 | 0.01–0.04 | 0.01–0.04 |
| pH | 5.5–6.5 | 5.5–6.5 | 5.5–6.5 | 5.5–6.5 | 5.5–6.5 |
| Water | Bal. | Bal. | Bal. | Bal. | Bal. |
| Compound | 181 | 182 | 183 | 184 | 185 |
| Luviflex Soft | 0.3 | 0.5 | 0.7 | 1.5 | 3.0 |
| Silwet ® L7001 | 1.5 | 1.5 | 1.5 | 1.5 | 1.5 |
| methylated cyclodextrin | 0.6 | 0.3 | 0.3 | 0.4 | 0.8 |
| Ethanol | 3.0 | 3.0 | 3.0 | 3.0 | 3.0 |
| Dequest ® 2006 | 0.02–0.12 | 0.02–0.12 | 0.02–0.12 | 0.02–0.12 | 0.02–0.12 |
| Proxel ®$^{GXL}$ | 0.015 | 0.015 | 0.015 | 0.015 | 0.015 |
| Perfume | 0.01–0.04 | 0.01–0.04 | 0.01–0.04 | 0.01–0.04 | 0.01–0.04 |
| pH | 5–6 | 5–6 | 5–6 | 5–6 | 5–6 |
| Water | Bal. | Bal. | Bal. | Bal. | Bal. |
| Compound | 186 | 187 | 188 | 189 | 190 |
| Luviflex Soft | 0.3 | 0.5 | 0.7 | 1.5 | 3.0 |
| DC 190 | 1.5 | 1.5 | 1.5 | 1.5 | 1.5 |
| methylated cyclodextrin | 0.6 | 0.3 | 0.3 | 0.4 | 0.8 |
| Ethanol | 3.0 | 3.0 | 3.0 | 3.0 | 3.0 |
| Dequest ® 2006 | 0.02–0.12 | 0.02–0.12 | 0.02–0.12 | 0.02–0.12 | 0.02–0.12 |
| Proxel ®$^{GXL}$ | 0.015 | 0.015 | 0.015 | 0.015 | 0.015 |
| Perfume | 0.01–0.04 | 0.01–0.04 | 0.01–0.04 | 0.01–0.04 | 0.01–0.04 |
| pH | 5.5–6.5 | 5.5–6.5 | 5.5–6.5 | 5.5–6.5 | 5.5–6.5 |
| Water | Bal. | Bal. | Bal. | Bal. | Bal. |
| Compound | 191 | 192 | 193 | 194 | 195 |
| Luviflex Soft | 0.3 | 0.5 | 0.7 | 1.5 | 3.0 |
| Silwet ® L7001 | 1.5 | 1.5 | 1.5 | 1.5 | 1.5 |
| LaraCare ™ A200 | 0.5 | 0.5 | 0.5 | 0.5 | 0.5 |
| methylated cyclodextrin | 0.6 | 0.3 | 0.3 | 0.4 | 0.8 |
| Ethanol | 3.0 | 3.0 | 3.0 | 3.0 | 3.0 |
| Dequest ® 2006 | 0.02–0.12 | 0.02–0.12 | 0.02–0.12 | 0.02–0.12 | 0.02–0.12 |
| Perfume | 0.01–0.04 | 0.01–0.04 | 0.01–0.04 | 0.01–0.04 | 0.01–0.04 |

-continued

| | | | | | |
|---|---|---|---|---|---|
| pH | 5.5–6.5 | 5.5–6.5 | 5.5–6.5 | 5.5–6.5 | 5.5–6.5 |
| Water | Bal. | Bal. | Bal. | Bal. | Bal. |
| Compound | 196 | 197 | 198 | 199 | 200 |
| Luviflex Soft | 0.3 | 0.5 | 0.7 | 1.5 | 3.0 |
| DC 190 | 1.5 | 1.5 | 1.5 | 1.5 | 1.5 |
| methylated cyclodextrin | 0.6 | 0.3 | 0.3 | 0.4 | 0.8 |
| Ethanol | 3.0 | 3.0 | 3.0 | 3.0 | 3.0 |
| Dequest ® 2006 | 0.02–0.12 | 0.02–0.12 | 0.02–0.12 | 0.02–0.12 | 0.02–0.12 |
| Perfume | 0.01–0.04 | 0.01–0.04 | 0.01–0.04 | 0.01–0.04 | 0.01–0.04 |
| pH | 5–6 | 5–6 | 5–6 | 5–6 | 5–6 |
| Water | Bal. | Bal. | Bal. | Bal. | Bal. |
| Compound | 201 | 202 | 203 | 204 | 205 |
| Luviflex Soft | 0.3 | 0.5 | 0.7 | 1.5 | 3.0 |
| Silwet ® L7001 | 1.5 | 1.5 | 1.5 | 1.5 | 1.5 |
| methylated cyclodextrin | 0.6 | 0.3 | 0.3 | 0.4 | 0.8 |
| Ethanol | 3.0 | 3.0 | 3.0 | 3.0 | 3.0 |
| Dequest ® 2006 | 0.02–0.12 | 0.02–0.12 | 0.02–0.12 | 0.02–0.12 | 0.02–0.12 |
| Perfume | 0.01–0.04 | 0.01–0.04 | 0.01–0.04 | 0.01–0.04 | 0.01–0.04 |
| pH | 5.5–6.5 | 5.5–6.5 | 5.5–6.5 | 5.5–6.5 | 5.5–6.5 |
| Water | Bal. | Bal. | Bal. | Bal. | Bal. |
| Cornpound | 206 | 207 | 208 | 209 | 210 |
| Luviflex Soft | 0.3 | 0.5 | 0.7 | 1.5 | 2.0 |
| Silwet ® L7200 | 1.5 | 1.5 | 1.5 | 1.5 | 1.5 |
| Hydroxy-propyl-β-Cyclodextrin | 0.3 | 0.3 | 0.3 | 0.3 | 0.3 |
| Ethanol | 3.0 | 3.0 | 3.0 | 3.0 | 3.0 |
| Proxel ®$^{GXL}$ | 0.015 | 0.015 | 0.015 | 0.015 | 0.015 |
| Perfume | 0.01–0.04 | 0.01–0.04 | 0.01–0.04 | 0.01–0.04 | 0.01–0.04 |
| pH | 5–6 | 5–6 | 5–6 | 5–6 | 5–6 |
| Water | Bal. | Bal. | Bal. | Bal. | Bal. |
| Compound | 211 | 212 | 213 | 214 | 215 |
| Luviflex Soft | 0.3 | 0.5 | 0.7 | 1.5 | 3.0 |
| Silwet ® L7200 | 1.5 | 1.5 | 1.5 | 1.5 | 1.5 |
| methylated cyclodextrin | 0.3 | 0.3 | 0.3 | 0.3 | 0.3 |
| Ethanol | 3.0 | 3.0 | 3.0 | 3.0 | 3.0 |
| Proxel ®$^{GXL}$ | 0.015 | 0.015 | 0.015 | 0.015 | 0.015 |
| Perfume | 0.01–0.04 | 0.01–0.04 | 0.01–0.04 | 0.01–0.04 | 0.01–0.04 |
| pH | 5–6 | 5–6 | 5–6 | 5–6 | 5–6 |
| Water | Bal. | Bal. | Bal. | Bal. | Bal. |
| Compound | 216 | 217 | 218 | 219 | 220 |
| Luviflex Soft | 0.5 | 0.5 | 0.5 | 1.5 | 2.0 |
| DEEDMAC | 0.7 | 1.0 | 2.0 | 1.75 | 2.0 |
| Perfume | 0.01–0.04 | 0.01–0.04 | 0.01–0.04 | 0.01–0.04 | 0.01–0.04 |
| EtOH | 20 | 3 | 15 | 15 | 20 |
| 3M Fluorad ®$^{19}$ | 0.005 | 0.01 | 0.01 | 0.015 | 0.02 |
| pH | 5–6 | 5–6 | 5–6 | 5–6 | 5–6 |
| Water | Bal. | Bal. | Bal. | Bal. | Bal. |
| Compound | 221 | 222 | 223 | 224 | 225 |
| Luviflex Soft | 0.5 | 0.5 | 0.1 | 0.2 | 3.0 |

-continued

| | | | | | |
|---|---|---|---|---|---|
| TEA Di-ester Quat | 1.8 | 1.0 | 2.0 | 1.75 | 2.0 |
| Perfume | 0.01–0.04 | 0.01–0.04 | 0.01–0.04 | 0.01–0.04 | 0.01–0.04 |
| 3M Fluorad ® | 0.005 | 0.015 | 0.01 | 0.005 | 0.02 |
| EtOH | 20 | 10 | 15 | 10 | 20 |
| pH | 5–6 | 5–6 | 5–6 | 5–6 | 5–6 |
| Water | Bal. | Bal. | Bal. | Bal. | Bal. |
| Compound | 226 | 227 | 228 | 229 | 230 |
| Luviflex Soft | 0.5 | 0.5 | 0.5 | 1.5 | 2.0 |
| DEEDMAC | 0.7 | 1.0 | 2.0 | 1.75 | 2.0 |
| Perfume | 0.01–0.04 | 0.01–0.04 | 0.01–0.04 | 0.01–0.04 | 0.01–0.04 |
| EtOH | 20 | 3 | 15 | 15 | 20 |
| Dow Corning ® 190 | 0.005 | 0.01 | 0.01 | 0.015 | 0.02 |
| pH | 5–6 | 5–6 | 5–6 | 5–6 | 5–6 |
| Water | Bal. | Bal. | Bal. | Bal. | Bal. |
| Compound | 231 | 232 | 233 | 234 | 235 |
| Luviflex Soft | 0.5 | 0.5 | 0.1 | 0.2 | 3.0 |
| TEA Di-ester Quat | 1.8 | 1.0 | 2.0 | 1.75 | 2.0 |
| Perfume | 0.01–0.04 | 0.01–0.04 | 0.01–0.04 | 0.01–0.04 | 0.01–0.04 |
| Dow Corning ® 190 | 0.005 | 0.015 | 0.01 | 0.005 | 0.02 |
| EtOH | 20 | 10 | 15 | 10 | 20 |
| pH | 5–6 | 5–6 | 5–6 | 5–6 | 5–6 |
| Water | Bal. | Bal. | Bal. | Bal. | Bal. |
| Compound | 236 | 237 | 238 | 239 | 240 |
| Luviflex Soft | 0.4 | 0.4 | 0.4 | 0.4 | 0.4 |
| DC 190 | 1.5 | — | 0.75 | 0.75 | |
| Silwet ® L7001 | — | 1.5 | — | — | 0.75 |
| Silwet ® L77 | — | — | 0.75 | — | 0.75 |
| DC Q2-5211 | — | — | — | 0.75 | — |
| methylated cyclodextrin | 0.3 | 0.3 | 0.3 | 0.3 | 0.3 |
| Ethanol | 3.0 | 3.0 | 3.0 | 3.0 | 3.0 |
| Proxel ®$^{GXL}$ | 0.015 | 0.015 | 0.015 | 0.015 | 0.015 |
| Perfume | 0.01–0.05 | 0.01–0.05 | 0.01–0.05 | 0.01–0.05 | 0.01–0.05 |
| pH | 6–7 | 6–7 | 6–7 | 6–7 | 6–7 |
| Water | Bal. | Bal. | Bal. | Bal. | Bal. |
| Compound | 241 | 242 | 243 | 244 | 245 |
| Luviflex Soft | 0.4 | 0.4 | 0.4 | 0.4 | 0.4 |
| DC 190 | — | 1.3 | — | — | 1.2 |
| Silwet ® L7001 | 0.75 | — | 1.5 | 1.0 | — |
| Silwet ® L77 | — | — | — | — | 0.6 |
| DC Q2-5211 | 0.75 | 0.2 | 0.2 | 0.7 | — |
| methylated cyclodextrin | 0.3 | 0.3 | 0.3 | 0.4 | 0.8 |
| Ethanol | 3.0 | 3.0 | 3.0 | 3.0 | 3.0 |
| Dequest ® 2006 | 0.015 | 0.015 | 0.015 | 0.015 | 0.015 |
| Perfume | 0.01–0.05 | 0.01–0.05 | 0.01–0.05 | 0.01–0.05 | 0.01–0.05 |
| pH | 6–7 | 6–7 | 6–7 | 6–7 | 6–7 |
| Water | Bal. | Bal. | Bal. | Bal. | Bal. |
| Compound | 246 | 247 | 248 | 249 | 250 |
| Luviflex Soft | 0.2 | 0.2 | 0.2 | 0.2 | 0.2 |

-continued

| | | | | | |
|---|---|---|---|---|---|
| DC 190 | 1.5 | — | 0.75 | 0.75 | — |
| Silwet ® L7001 | — | 1.5 | — | — | 0.75 |
| Silwet ® L77 | — | — | 0.75 | — | 0.75 |
| DC Q2-5211 | — | — | — | 0.75 | — |
| methylated cyclodextrin | 0.3 | 0.3 | 0.3 | 0.3 | 0.3 |
| Ethanol | 3.0 | 3.0 | 3.0 | 3.0 | 3.0 |
| Proxel ®$^{GXL}$ | 0.015 | 0.015 | 0.015 | 0.015 | 0.015 |
| Perfume | 0.01–0.05 | 0.01–0.05 | 0.01–0.05 | 0.01–0.05 | 0.01–0.05 |
| pH | 6–7 | 6–7 | 6–7 | 6–7 | 6–7 |
| Water | Bal. | Bal. | Bal. | Bal. | Bal. |
| Compound | 251 | 252 | 253 | 254 | 255 |
| Luviflex Soft | 0.2 | 0.2 | 0.2 | 0.2 | 0.2 |
| DC 190 | — | 1.3 | — | — | 1.2 |
| Silwet ® L7001 | 0.75 | — | 1.5 | 1.0 | — |
| Silwet ® L77 | — | — | — | — | 0.6 |
| DC Q2-5211 | 0.75 | 0.2 | 0.2 | 0.7 | — |
| methylated cyclodextrin | 0.3 | 0.3 | 0.3 | 0.4 | 0.8 |
| Ethanol | 3.0 | 3.0 | 3.0 | 3.0 | 3.0 |
| Dequest ® 2006 | 0.015 | 0.015 | 0.015 | 0.015 | 0.015 |
| Perfume | 0.01–0.05 | 0.01–0.05 | 0.01–0.05 | 0.01–0.05 | 0.01–0.05 |
| pH | 6–7 | 6–7 | 6–7 | 6–7 | 6–7 |
| Water | Bal. | Bal. | Bal. | Bal. | Bal. |
| Compound | 256 | 257 | 258 | 259 | 260 |
| Luviflex Soft | 0.4 | 0.4 | 0.4 | 0.4 | 0.4 |
| DC 190 | 1.5 | — | 0.75 | 0.75 | — |
| Silwet ® L7001 | — | 1.5 | — | — | 0.75 |
| Silwet ® L77 | — | — | 0.75 | — | 0.75 |
| DC Q2-5211 | — | — | — | 0.75 | — |
| Hydroxy-propyl-β-cyclodextrin | 0.3 | 0.3 | 0.3 | 0.3 | 0.3 |
| Ethanol | 3.0 | 3.0 | 3.0 | 3.0 | 3.0 |
| Proxel ® | 0.015 | 0.015 | 0.015 | 0.015 | 0.015 |
| Perfume | 0.01–0.05 | 0.01–0.05 | 0.01–0.05 | 0.01–0.05 | 0.01–0.05 |
| pH | 6–7 | 6–7 | 6–7 | 6–7 | 6–7 |
| Water | Bal. | Bal. | Bal. | Bal. | Bal. |
| Compound | 261 | 262 | 263 | 264 | 265 |
| Luviflex Soft | 0.4 | 0.4 | 0.4 | 0.4 | 0.4 |
| DC 190 | — | 1.3 | — | — | 1.2 |
| Silwet ® L7001 | 0.75 | — | 1.5 | 1.0 | — |
| Silwet ® L77 | — | — | — | — | 0.6 |
| DC Q2-5211 | 0.75 | 0.2 | 0.2 | 0.7 | — |
| Hydroxy-propyl-β-cyclodextrin | 0.3 | 0.3 | 0.3 | 0.4 | 0.8 |
| Ethanol | 3.0 | 3.0 | 3.0 | 3.0 | 3.0 |
| Dequest ® 2006 | 0.015 | 0.015 | 0.015 | 0.015 | 0.015 |
| Perfume | 0.01–0.05 | 0.01–0.05 | 0.01–0.05 | 0.01–0.05 | 0.01–0.05 |
| pH | 6–7 | 6–7 | 6–7 | 6–7 | 6–7 |
| Water | Bal. | Bal. | Bal. | Bal. | Bal. |
| Compound | 266 | 267 | 268 | 269 | 270 |
| Luviflex Soft | 0.2 | 0.2 | 0.2 | 0.2 | 0.2 |

-continued

| | | | | | |
|---|---|---|---|---|---|
| DC 190 | 1.5 | — | 0.75 | 0.75 | — |
| Silwet ® L7001 | — | 1.5 | — | — | 0.75 |
| Silwet ® L77 | — | — | 0.75 | — | 0.75 |
| DC Q2-5211 | — | — | — | 0.75 | — |
| Hydroxy-propyl-β-cyclodextrin | 0.3 | 0.3 | 0.3 | 0.3 | 0.3 |
| Ethanol | 3.0 | 3.0 | 3.0 | 3.0 | 3.0 |
| Proxel ®[GXL] | 0.015 | 0.015 | 0.015 | 0.015 | 0.015 |
| Perfume | 0.01–0.05 | 0.01–0.05 | 0.01–0.05 | 0.01–0.05 | 0.01–0.05 |
| pH | 6–7 | 6–7 | 6–7 | 6–7 | 6–7 |
| Water | Bal. | Bal. | Bal. | Bal. | Bal. |

| Compound | 271 | 272 | 273 | 274 | 275 |
|---|---|---|---|---|---|
| Luviflex Soft | 0.2 | 0.2 | 0.2 | 0.2 | 0.2 |
| DC 190 | — | 1.3 | — | — | 1.2 |
| Silwet ® L7001 | 0.75 | — | 1.5 | 1.0 | — |
| Silwet ® L77 | — | — | — | — | 0.6 |
| DC Q2-5211 | 0.75 | 0.2 | 0.2 | 0.7 | — |
| Hydroxy-propyl-β-cyclodextrin | 0.3 | 0.3 | 0.3 | 0.4 | 0.8 |
| Ethanol | 3.0 | 3.0 | 3.0 | 3.0 | 3.0 |
| Proxel ®[GXL] | 0.015 | 0.015 | 0.015 | 0.015 | 0.015 |
| Perfume | 0.01–0.05 | 0.01–0.05 | 0.01–0.05 | 0.01–0.05 | 0.01–0.05 |
| pH | 6–7 | 6–7 | 6–7 | 6–7 | 6–7 |
| Water | Bal. | Bal. | Bal. | Bal. | Bal. |

| Compound | 276 | 277 | 278 | 279 | 280 |
|---|---|---|---|---|---|
| Luviflex Soft | 0.2 | 0.2 | 0.2 | 0.2 | 0.2 |
| DC 190 | 1.5 | — | 0.75 | 0.75 | — |
| Silwet ® L7001 | — | 1.5 | — | — | 0.75 |
| Silwet ® L77 | — | — | 0.75 | — | 0.75 |
| DC Q2-5211 | — | — | — | 0.75 | — |
| Ethanol | 3.0 | 3.0 | 3.0 | 3.0 | 3.0 |
| Proxel ®[GXL] | 0.015 | 0.015 | 0.015 | 0.015 | 0.015 |
| Perfume | 0.01–0.05 | 0.01–0.05 | 0.01–0.05 | 0.01–0.05 | 0.01–0.05 |
| pH | 6–7 | 6–7 | 6–7 | 6–7 | 6–7 |
| Water | Bal. | Bal. | Bal. | Bal. | Bal. |

| Compound | 281 | 282 | 283 | 284 | 285 |
|---|---|---|---|---|---|
| Luviflex Soft | 0.2 | 0.2 | 0.2 | 0.2 | 0.2 |
| DC 190 | — | 1.3 | — | — | 1.2 |
| Silwet ® L7001 | 0.75 | — | 1.5 | 1.0 | — |
| Silwet ® L77 | — | — | — | — | 0.6 |
| DC Q2-5211 | 0.75 | 0.2 | 0.2 | 0.7 | — |
| Ethanol | 3.0 | 3.0 | 3.0 | 3.0 | 3.0 |
| Proxel ®[GXL] | 0.015 | 0.015 | 0.015 | 0.015 | 0.015 |
| Perfume | 0.01–0.05 | 0.01–0.05 | 0.01–0.05 | 0.01–0.05 | 0.01–0.05 |
| pH | 6–7 | 6–7 | 6–7 | 6–7 | 6–7 |
| Water | Bal. | Bal. | Bal. | Bal. | Bal. |

[1]Ethylacrylate methacrylate copolymer, average MW = 250,000 from BASF
[2]1,2-benzisothioazoline-3-one available from Zeneca.
[3]Pendant copolymer of polydimethylsiloxane and ethylene-oxide/propylene oxide with an average MW = 20,000 and an EO/PO ratio of 60/40 available from CK-Witco.
[4]Arabinoglactan polymer available from Larex ®, Inc.
[5]Aminotri(methylenphosphonic acid)penta sodium salt available from
[6]Pendant copolymer of polydimethylsiloxane and ethylene-oxide/propylene oxide with an average MW = 19,000 and an EO/PO ratio of 25/75 available from CK-Witco.
[7]This material is a t-butyl acrylate/acrylic acid/(polydimethylsiloxane macromer, 12,000 approximate molecular weight) (60/20/20), copolymer of average molecular weight of about 128,000 available from Mitsubishi.
[8]Decamethylcylcopentasiloxane available from Dow Corning.
[9]Pendant copolymer of polydimethyl siloxane and ethylenoxide with average molecular weight of 600, available from CK-Witco
[10]Alkyl ethoxylate surfactant with 12–13 carbons and an average of three ethoxylate groups available from Shell
[11]Copolymer of polydimethylsiloxane and alkylene oxide available from Dow Corning ®.
[12]Copolymer of polydimethylsiloxane and alkylene oxide available from Dow Corning ®.
[13]Copolymer of polydimethylsiloxane and alkylene oxide available from GE-Toshiba, Co., Ltd. ®
[14]Copolymer of polydimethyl siloxane and alkylene oxide available from Shin-Etsu Chemical Co, Ltd.
[14]Quaternary ammonium derived from the reaction of triethanol amine and fatty acid followed by quaternization with the primary component named N,N-di-(canolyl-oxy-ethyl)-N-methyl-N-(2-hydroxyethyl)ammonium methyl sulfate, available from Goldschmidt.
[16]Ditallowoyl Ethanol Ester Dimethyl Ammonium Chloride, available from Goldschmidt.
[17]Decamethyl cyclopentasiloxane emulsified with N-soyalkyl-2, 2"iminobiehtyanol and ethoxylated octadecanamine available from Dow Corning ®.
[18]Dimethyl siloxane emulsified with a nonionic emulsifier available from GE Silicones.
[19]Fluorad is a nonionic fluorinated alkyl ester available from 3M
Fluorad is a nonionic fluorinated alkyl ester available from 3M[001b]

EXAMPLE II

This Example illustrates a process for making a preferred composition of the present invention. About 27,450 grams of deionized water is placed in a first mixing vessel and agitated. The pH of the water solution is brought up to a pH of from about 5.5 to about 6.0 by adding an appropriate amount of 50% sodium hydroxide solution. The water is then mixed for about 2 minutes. About 700 grams of Luviflex Soft are placed in a second mixing vessel. About 450 grams of Silwet L-7001 are placed in a third mixing vessel. In the third mixing vessel, about 900 grams of Ethanol SDA 40B are added to Silwet L-7001 and then mixed. About 12 grams of perfume are then added to the third mixing vessel and the mixture is mixed for about 3 minutes. The contents of the second mixing vessel are then added to the contents of the first mixing vessel. The composition in the first mixing vessel is then adjusted to a pH of from about 5.5 to about 6.0 by adding an appropriate amount of either hydrochloric acid or sodium hydroxide. The composition in the first mixing vessel is then allowed to mix for about 2 minutes. The contents of the third mixing vessel are then added to the contents of the first mixing vessel and allowed to mix for about 2 minutes. About 250 grams of LaraCare A200 are then added to the first mixing vessel and mixed for about 1 minute. About 225 grams of hydroxypropyl cyclodextrin are then added to the first mixing vessel and mixed for about 2 minutes. About 23 grams of Proxel GXL are then added to the first mixing vessel and mixed for about 5 minutes.

The resulting composition has a pH of about 6.06 and a viscosity of about 5.0 cP. The composition has a somewhat translucent appearance.

EXAMPLE III

This Example illustrates how by lowering the pH of a wrinkle controlling composition, the viscosity of the composition is lowered, resulting in a larger, more desireable, spray diameter.

This Example is carried out according to the Spray Diameter Test described in Section V.D, supra. The wrinkle controlling compositions to be tested comprise about 2% Luviflex Soft (a polymer comprising carboxylic acid moieties as described supra) and about 98% water, with a first composition having a pH of about 8 and a second composition having a pH of about 5. The compositions are tested according to the Spray Diameter Test using a Calmar TS-800-2E spray dispenser and the results are as follows:

| Polymer | Conc | pH | Viscosity (cP) | Spray Diameter (cm) |
|---|---|---|---|---|
| Luviflex Soft | 2% | 8 | 17 | 15.0 |
| Luviflex Soft | 2% | 5 | 3 | 20.3 |

This Example shows that a composition comprising polymer containing carboxylic acid moieties having a lower pH also has a lower viscosity and is dispensed over a wider area of fabric, resulting in reduced risk of staining the fabric and reducing the dry time of the fabric.

EXAMPLE IV

This Example is similar to Example III, except that the wrinkle controlling compositions comprise about 0.7% Luviflex Soft (a polymer comprising carboxylic acid moieties as described supra) and about 99.3% water, with a first composition having a pH of about 5.0, a second composition having a pH of about 6.1, and a third composition having a pH of about 8.6. The compositions are tested according to the Spray Diameter Test using an Indesco T-8500 (from CSI) spray dispenser and the results are as follows:

| Polymer | Conc | pH | Viscosity (cP) | Spray Diameter (cm) |
|---|---|---|---|---|
| Luviflex Soft | 0.7% | 5.0 | 1.00 | 15.9 |
| Luviflex Soft | 0.7% | 6.1 | 2.50 | 16.9 |
| Luviflex Soft | 0.7% | 8.6 | 8.00 | 13.9 |

This Example shows that a composition comprising polymer containing carboxylic acid moieties having a lower pH also has a lower viscosity and is dispensed over a wider area of fabric, resulting in reduced risk of staining the fabric and reducing the dry time of the fabric.

EXAMPLE V

This Example demonstrates the differences among different spray dispensers in regard to spray pattern distribution. A variety of spray dispeners are evaluated according to the Patternator Test method described hereinbefore in Section V.A. supra.

The following wrinkle controlling composition is used to evaluate the spray pattern of the spray dispensers to be tested:

| Component | Weight of Active |
|---|---|
| Fluid 245[1] | 2.5% |
| Silwet L77[2] | 2.0% |
| Neodol 23-3[3] | 0.5% |
| Stepanol WAC[4] | 0.1% |
| Perfume | 0–0.04% |
| Preservative | 0–0.1%3 |
| Tris (hydroxy methyl)amino mentane | 0.57% |
| HCl | 0.05% |
| pH | 8–9 |
| Water | balance |

[1]Decamethylcylcopentasiloxane available from Dow Corning.
[2]Pendant copolymer of polydimethyl siloxane and ethylenoxide with average molecular weight of 600, available from CK-Witco.
[3]Alkyl ethoxylate surfactant with 12–13 carbons and an average of three ethoxylate groups available from Shell.
[4]Sodium lauryl sulfate available from Stepan.

A variety of spray dispensers are tested according to the Patternator Test. The results of the test are given in terms of a spray pattern having a volume per unit of surface area and standard deviation thereof, and are shown in the following table:

| Sprayer | Volume/Surface Area | Standard Deviation in Volume Surface |
|---|---|---|
| Mixor[1] 1.00 cc × 0.025 × 0.030 | 0.087 ml/inch$^2$ (0.014 ml/cm$^2$) | 0.080 ml/inch$^2$ (0.0124 ml/cm$^2$) |
| Mixor[2] 1.00 cc MP | 0.076 ml/inch$^2$ (0.012 ml/cm$^2$) | 0.056 ml/inch$^2$ (0.0087 ml/cm$^2$) |
| Calmar TS-800-2G[3] | 0.069 ml/inch$^2$ (0.011 ml/cm$^2$) | 0.065 mJ/inch$^2$ (0.010 ml/cm$^2$) |
| T-8500 1 cc Dow Shroud[4] | 0.020 ml/inch$^2$ (0.0031 ml/cm$^2$) | 0.021 ml/inch$^2$ (0.0033 ml/cm$^2$) |
| Calmar TS-800-2E[5] | 0.023 ml/inch$^2$ (0.0036 ml/cm$^2$) | 0.016 ml/inch$^2$ (0.0025 ml/cm$^2$) |
| Calmar TS-800-2E RO[6] | 0.017 ml/inch$^2$ (0.0026 ml/cm$^2$) | 0.009 ml/inch$^2$ (0.0014 ml/cm$^2$) |
| Calmar TS-800-2[7] | 0.012 ml/inch$^2$ (0.0019 ml/cm$^2$) | 0.007 ml/inch$^2$ (0.0011 ml/cm$^2$) |

[1]Available from Calmar, land length is 0.030, diameter of orifice in the nozzle is 0.025, the nozzle part number is 1PD04105.
[2]Available from Calmar, land length is 0.020, diameter of the orifice in the nozzle is 0.025, the nozzle part number is 1PD04105.
[3]Available from Calmar, land length is 0.060, diameter of the orifice is 0.025, the nozzle part number is 7PD04105.
[4]Available from CSI, land length is 0.031, diameter of the orifice is 0.025, and the nozzle part number is 8501.
[5]Available from Calmar, land length is 0.060, diameter of the orifice is 0.025, and the nozzle part number is 7PD04105.
[6]Available from Calmar, specifications equivalent to those in reference 5.
[7]Available from Calmar, land length is 0.040, diameter of the orifice is 0.030, and the nozzle part number is 8PD04105.

EXAMPLE VI

This Example illustrates the need to utilize a spray dispenser which provides a spray pattern as desired in the present invention in order to minimize the potential staining of fabrics treated with a wrinkle controlling composition.

A variety of spray dispensers are evaluated using the Staining Test as described in Section V.B. supra. The following wrinkle controlling composition of the present invention is used to evaluate the affect the spray dispener has on the potential to stain fabrics treated with the wrinkle controlling composition:

| Composition | Active Weight |
|---|---|
| Luviflex Soft[1] | 0.7% |
| Silwet L7001[2] | 1.5% |
| LaraCare A200[3] | 0.5% |
| Hydroxylpropyl-β-cyclodextrin | 0.35% |
| Ethanol | 3.0% |
| Perfume | 0–0.04% |
| Preservative | 0–0.02% |
| pH | 5–6 |
| Water | Balance |

[1]Ethylacrylate methacrylic acid copolymer (approximately 250,000 MW) available from BASF.
[2]Silicone glycol copolymer available from CK-Witco.
[3]Arabinoglactan polysaccharide (approximately 20,000 MW) available from Larex.

The wrinkle controlling composition is sprayed using a given sprayer according to the Staining Test method. The results of the Staining Test are shown in the following table:

| Sprayer | # Swatches Sprayed | # Swatches Stained |
|---|---|---|
| 1.0 cc Mixor | 10 | 10 |
| Calmar TS-800-2G | 10 | 10 |
| Indesco T-8500 | 10 | 2 |
| Calmar TS-800-2E | 10 | 3 |

This shows that spray dispensers that provide the desired spray pattern according to the present invention, have a reduced tendency to stain fabrics treated with the wrinkle controlling composition.

EXAMPLE VII

This Example demonstrates the affect a spray dispenser having a particular spray pattern has on the amount of time required for a fabric to dry which has been treated with a wrinkle controlling composition.

In this Example, a variety of spray dispensers are tested according to the Dry Time Test method disclosed in Section V.C. supra. The following wrinkle controlling composition of the present invention is used to evaluate the spray dispensers according to the Dry Time Test: Composition Active Weight

| Composition | Active Weight |
|---|---|
| Luviflex Soft[1] | 0.7% |
| Silwet L7001[2] | 1.5% |
| LaraCare A200[3] | 0.5% |
| Hydroxylpropyl-β-cyclodextrin | 0.35% |
| Ethanol | 3.0% |
| Perfume | 0–0.04% |
| Preservative | 0–0.02% |
| pH | 5–6 |
| Water | Balance |

[1]Ethylacrylate methacrylic acid copolymer (approximately 250,000 MW) available from BASF.
[2]Silicone glycol copolymer available from CK-Witco.
[3]Arabinoglactan polysaccharide (approximately 20,000 MW) available from Larex.

Figure 2:
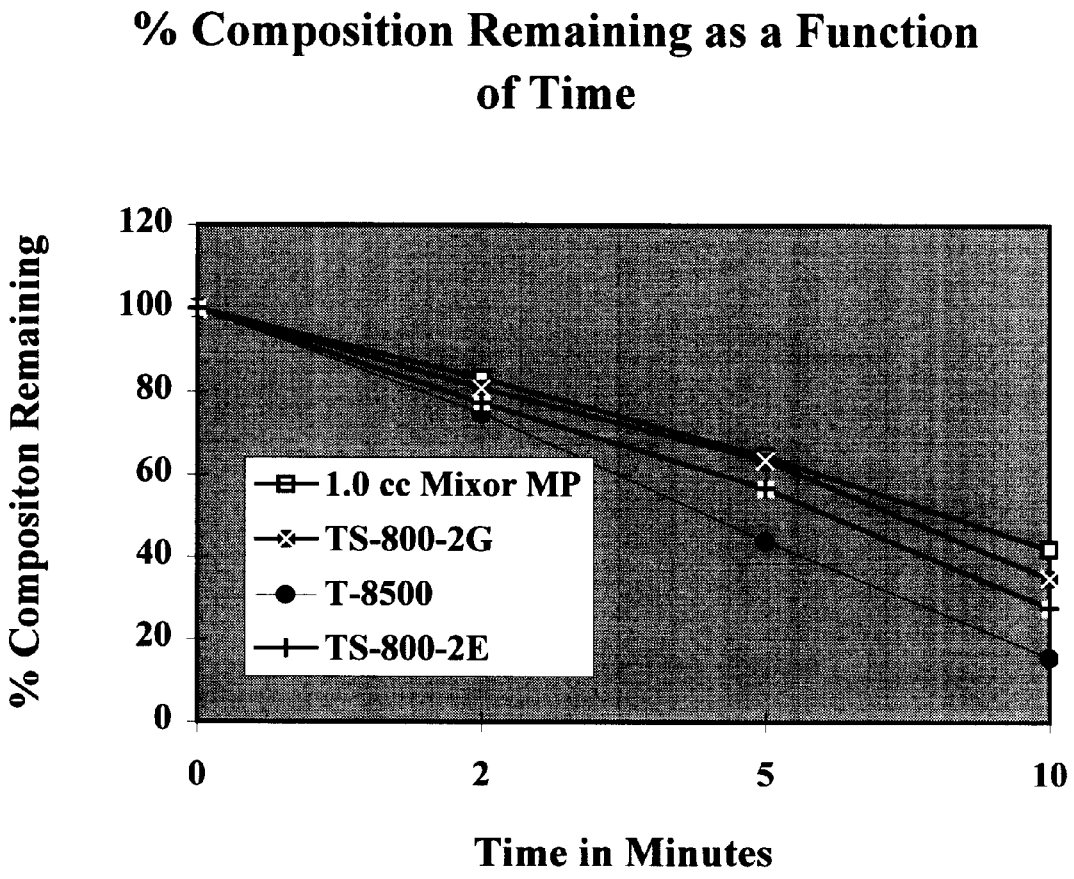
FIG. 2 is graph illustrating the percent of composition remaining as a function of drying time based on the composition being sprayed from four different sprayers.

The data from the Dry Time Test method is collected for the given spray dispensers and plotted as a function of time vs. percent composition remaining. This data is represented in the graph of FIG. 2.

The selection of the spray dispenser cani have an affect on the amount of time required for a fabric treated with a wrinkle controlling composition to dry. The preferred spray dispensers herein exhibit faster dry times.

What is claimed is:

1. An aqueous composition for controlling wrinkles in fabric comprising:

(a) an effective amount to control wrinkles in fabric of a polymer comprising carboxylic acid moieties;

(b) a carrier comprising water;

(c) optionally, silicone compounds and/or emulsions;

(d) optionally, an effective amount of a supplemental wrinkle control agent to remove and/or reduce wrinkle selected from the group consisting of an adjunct polymer free of carboxylic acid moieties, fabric care saccharides, lithium salts, fiber fabric lubricants, and mixtures thereof;

(e) optionally, an effective amount of a supplemental surface tension control agent to facilitate dispersion, emulsification and/or solubilization;

(f) optionally, an effective amount to absorb or reduce malodor, of odor control agent;

(g) optionally, an effective amount to provide olfactory effects of perfume;

(h) optionally, an effective amount of solubilized, water-soluble, antimicrobial preservative to inhibit and/or regulate microbial growth;

(i) optionally, an effective amount of a buffering system to prevent large changes in pH;

(j) optionally, adjunct ingredients selected from the group consisting of adjunct odor-controlling materials, chelating agents, viscosity control agents, additional anti-static agents, insect and moth repelling agents, colorants, anti-clogging agents, and mixtures thereof;

wherein said composition has a pH of from about 3 to about 6.5 and a viscosity of less than about 20 cP.

2. The aqueous composition of claim 1, wherein said polymer comprising carboxylic acid moieties is at a level of from about 0.001% to about 25% by weight of said composition, and wherein said composition has a pH of from about 5 to about 6.5 and a viscosity of less than about 15 cP.

3. The aqueous composition of claim 1, wherein said polymer comprising carboxylic acid moieties is selected from the group consisting of polymers and copolymers of methacrylic acid.

4. The aqueous composition of claim 3, wherein the said copolymer of methacrylic acid comprises a hydrophobic monomer.

5. The aqueous composition of claim 4, wherein the said hydrophobic monomer is an ester of a carboxylic acid with $C_1$–$C_{12}$ alcohols selected from the group of methanol, ethanol, 1-propanol, 2-propanol, 1-butanol, 2-methyl-1-propanol, 1-pentanol, 2-pentanol, 3-pentanol, 2-methyl-1-butanol, 1-methyl-1-butanol, 3-methyl-1-butanol, 1-methyl-1-pentanol, 2-methyl-1-pentanol, 3-methyl-1-pentanol, t-butanol, cyclohexanol, 2-ethyl-1-butanol, neodecanol, 3-heptanol, benzyl alcohol, 2-octanol, 6-methyl-1-heptanol, 2-ethyl-1-hexanol, 3,5-dimethyl-1-hexanol, 3,5,5-trimethyl-1-hexanol, 1-decanol, 1-dodecanol, and mixtures thereof.

6. The aqueous composition of claim 1, wherein said polymer comprising carboxylic acid moieties comprises methacrylic acid and ethylacrylate.

7. The aqueous composition of claim 1, wherein said polymer comprising carboxylic acid moieties is selected from the group consisting of silicone graft copolymers, silicone block copolymers, and mixtures thereof.

8. The aqueous composition of claim 1, wherein said composition further comprises a silicone compound, silicone emulsion, or mixtures thereof.

9. The aqueous composition of claim 4, wherein said silicone compound is a polyalkylene oxide polysiloxane having the formula:

$$R^1—(CH_3)_2SiO—[(CH_3)_2SiO]_a—[(CH_3)(R^1)SiO]_b—Si(CH_3)_2—R^1$$

wherein a+b are from about 1 to about 50, and each $R^1$ is the same or different and is selected from the group consisting of a methyl group and a poly(ethyleneoxide/propyleneoxide) copolymer group having the general formula:

$$—(CH_2)_nO(C_2H_4O)_c(C_3H_6O)_dR^2$$

wherein at least one $R^1$ is a poly(ethyleneoxy/propyleneoxy) copolymer group, and wherein n is 3 or 4; total c (for all polyalkyleneoxy side groups) has a value of from 1 to about 100; total c+d has a value of from about 5 to about 150, and each $R^2$ is the same or different and is selected from the group consisting of hydrogen, an alkyl having 1 to 4 carbon atoms, and an acetyl group.

10. The composition of claim 9, wherein the said silicone compound has a molecular weight of less than about 2000.

11. The composition of claim 9, wherein the said silicone compound has an aqueous surface tension of less than about 30 dynes/cm.

12. The composition of claim 9, wherein the said silicone compound has a molecular weight of greater than about 10,000.

13. The composition of claim 9, wherein the said silicone compound is a mixture of a silicone compound having a molecular weight of greater than about 10,000 combined with a silicone compound having a molecular weight of less than about 2,000 and an aqueous surface tension of less than about 30 dynes/cm.

14. The aqueous composition of claim 1 wherein said composition further comprises a supplemental wrinkle control agent selected.from the group consisting of adjunct polymers free of carboxylic acid moieties, starches, fabric care saccharides, lithium salts, fiber fabric lubricant, and mixtures thereof.

15. The aqueous composition of claim 1, wherein said supplemental wrinkle control agent is a fabric care saccharide selected from the group consisting of primary fabric care polysaccharide, adjunct fabric care oligosaccharide, and mixtures thereof.

16. The aqueous composition of claim 1 wherein said carrier further comprises solvent, plasticizer, or mixtures thereof.

17. The aqueous composition of claim 16, wherein said solvent, plasticizer or mixtures thereof are present at a level below about 15%.

18. The aqueous composition of claim 16, wherein said solvent, plasticizer or mixtures thereof are present at a level equal to or below about 3%.

19. The aqueous composition of claim 16, wherein said solvent is ethanol.

20. The aqueous composition of claim 1, wherein said composition further comprises a supplemental surface tension control agent selected from the group consisting of nonionic surfactant, ionic surfactant, zwitterionic surfactant, fluorine-based surfactant, and mixtures thereof.

21. The aqueous composition of claim 20, wherein said supplemental surface tension control agent is a fluorine-based surfactant selected from the group consisting of fluorinated alkyl polyoxyalkylene, fluorinated alkyl esters, and mixtures thereof.

22. The aqueous composition of claim 1, wherein said composition further comprises a buffering system.

23. The aqueous composition of claim 22, wherein said buffering system is selected from the group consisting of:

(i) D(+)-Tartaric acid and sodium hydroxide;

(ii) citric acid and sodium hydroxide;

(iii) glycine and hydrogen chloride;

(iv) citric acid and sodium citrate;

(v) phenylacetic acid and sodium phenyl acetate;

(vi) sodium acetate and acetic acid;

(vii) succinic acid and sodium hydroxide;

(viii) potassium hydrogen phthalate and sodium hydroxide;

(ix) maleic acid, tris, and sodium hydroxide;

(x) potassium dihydrogen phospate and sodium hydroxide;

(xi) 2,4,6-trimethylpyridine and hydrogen chloride;

(xii) tris(hydroxymethyl)aminomethanie and hydrochloric acid; and (xiii) mixtures thereof.

24. The aqueous composition of claim 22, wherein said buffering system has a buffering capacity of at least about 0.01.

25. The aqueous composition of claim 1, wherein the said buffering system provides stability to pH drift for at least about 3 months.

26. The aqueous composition of claim 1, wherein the composition further comprises a whiteness preservative selected from the group consisting of metal chelating agents, brighteners, bluing agents, ultra-violet absorbers, oxidative stabilizers, and mixtures thereof.

27. The aqueous composition of claim 1, wherein the composition further comprises a a malodor control agent selected from the group consisting of cyclodextrin, polyols, metal salts, soluble carbonate and/or bicarbonate salts, enzymes, zeolites, activated carbon, and mixtures thereof.

28. An aqueous composition for controlling wrinkles in fabric comprising:

(a) a polymer comprising carboxylic acid moieties in an amount between about 0.001% and about 25%;

(b) a silicone compound in an effective amount to impart lubricity and smoothness to fibers;

(c) a fabric care saccharide in an amount between about 0.01% and about 20%;

(d) an odor control agent comprising cyclodextrin in an amount between about 0.01% and about 5%;

(e) an antimicrobial preservative in an amount between about 0.0001% and about 0.5%;

(f) perfume present in an amount less than about 0.5%; and (g) a carrier comprising water wherein said composition has a pH of from about 5 to about 6.5 and a viscosity of less than about 15 cP.

29. The aqueous composition of claim 28, wherein said silicone compound is a polyalkylene oxide polysiloxane having the formula:

$$R^1—(CH_3)_2SiO—[(CH_3)_2SiO]_a—[(CH_3)(R^1)SiO]_b—Si(CH_3)_2—R^1$$

wherein a+b are from about 1 to about 50, and each $R^1$ is the same or different and is selected from the group consisting of a methyl group and a poly(ethyleneoxide/propyleneoxide) copolymer group having the general formula:

$$—(CH_2)_nO(C_2H_4O)_c(C_3H_6O)_dR^2$$

wherein at least one $R^1$ is a poly(ethyleneoxy/propyleneoxy) copolymer group, and wherein n is 3 or 4; total c (for all polyalkyleneoxy side groups) has a value of from 1 to about 100; total c+d has a value of from about 5 to about 150, and each $R^2$ is the same or different and is selected from the group consisting of hydrogen, an alkyl having 1 to 4 carbon atoms, and an acetyl group.

30. The aqueous composition of claim 28, wherein the said silicone compound has a molecular weight of less than about 2000.

31. The composition of claim 28, wherein the said silicone compound has an aqueous surface tension of less than about 30 dynes/cm.

32. The composition of claim 28, wherein the said silicone compound has a molecular weight of greater than about 10,000.

33. The composition of claim 28, wherein the said silicone compound is a mixture of a silicone compound having a molecular weight of greater than about 10,000 combined with a silicone compound having a molecular weight of less than about 2,000 and an aqueous surface tension of less than about 30 dynes/cm.

34. The composition of claim 28, wherein said carrier further comprised a solvent and/or plasticizer that is at least 3% by weight of the composition.

35. The composition of claim 34, wherein the solvent is ethanol.

36. A method of controlling wrinkles in fabric comprising contacting fabric with an aqueous composition according to claim 1.

37. The method of claim 36, wherein said fabrics are contacted with said composition by dispensing said composition from a spray dispenser providing a spray pattern having a volume per unit of surface area of less than about 0.011 ml/cm$^2$.

38. The method of claim 37, wherein said spray dispenser provides a spray pattern having a volume per unit of surface area of less than about 0.0054 ml/cm$^2$.

39. The method of claim 38, wherein said spray dispenser provides a spray pattern having a volume per unit of surface area of less than about 0.0031 ml/cm$^2$.

40. The method of claim 37, wherein said spray pattern has a standard deviation of said volume per unit of surface area of less than about 0.0087 ml/cm$^2$.

41. The method of claim 40, wherein said spray pattern has a standard deviation of said volume per unit of surface area of less than about 0.0047 ml/cm$^2$.

42. The method of claim 41, wherein said spray pattern has a standard deviation of said volume per unit of surface area of less than about 0.0031 ml/cm$^2$.

43. The method of claim 37, wherein said wrinkle controlling composition has a Trouton ratio of less than about 10,000.

44. The method of claim 43, wherein said Trouton ratio is less than about 1,000.

45. The method of claim 44, wherein said Trouton ratio is less than about 100.

46. The method of claim 36, wherein fabrics are air-dried following contact with the composition.

47. The method of claim 36, wherein fabrics are heated following contact with the composition.

48. The method of claim 47, wherein fabrics are heated using a clothes dryer.

49. An article of manufacture for controlling wrinkles in fabric comprising:

(a) a spray dispenser, wherein said spray dispenser provides a spray pattern having a volume per unit of surface area of less than about 0.011 ml/cm$^2$; and (b) an aqueous composition for controlling wrinkles in fabric of claim 1.

50. The article of claim 49, further comprising a set of instructions in association with said spray dispenser comprising an instruction to dispense said aqueous composition from said spray dispenser onto said fabric and smooth said fabric.

51. The article of claim 49, wherein said spray dispenser is selected from the group consisting of manually operated sprayers, non-manually operated sprayers, trigger sprayers, pre-compression sprayer, and pump sprayers.

52. The article of claim 51, wherein said spray dispenser is powered by electricity.

53. The article of claim 50, wherein said instructions comprise an instruction to employ said article during travel.

54. The article of claim 50, wherein said instructions comprise an instruction to iron the fabric following treatment with the said composition.

* * * * *